US009210525B2

(12) United States Patent
Kano

(10) Patent No.: US 9,210,525 B2
(45) Date of Patent: Dec. 8, 2015

(54) SOUND FIELD CONTROL APPARATUS AND SOUND FIELD CONTROL METHOD

(71) Applicant: Panasonic Corporation, Osaka (JP)

(72) Inventor: Hiroyuki Kano, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 259 days.

(21) Appl. No.: 14/000,925

(22) PCT Filed: Nov. 15, 2012

(86) PCT No.: PCT/JP2012/007330

§ 371 (c)(1),
(2) Date: Aug. 22, 2013

(87) PCT Pub. No.: WO2013/099093

PCT Pub. Date: Jul. 4, 2013

(65) Prior Publication Data

US 2014/0056431 A1 Feb. 27, 2014

(30) Foreign Application Priority Data

Dec. 27, 2011 (JP) ..... 2011-285007

(51) Int. Cl.
*H04S 7/00* (2006.01)
*H04R 27/00* (2006.01)

(52) U.S. Cl.
CPC . *H04S 7/30* (2013.01); *H04S 7/302* (2013.01); *H04R 27/00* (2013.01); *H04R 2499/13* (2013.01); *H04S 2400/11* (2013.01); *H04S 2400/15* (2013.01)

(58) Field of Classification Search
None
See application file for complete search history.

(56) References Cited

U.S. PATENT DOCUMENTS 7,835,529 B2 * 11/2010 Hernandez et al. ..... 381/71.2
2006/0215853 A1 * 9/2006 Hiruma et al. ..... 381/97

(Continued)

FOREIGN PATENT DOCUMENTS

JP 2004-349795 12/2004
JP 2005-142632 6/2005

(Continued)

OTHER PUBLICATIONS

International Search Report issued Jan. 22, 2013 in corresponding International Application No. PCT/JP2012/007330.

(Continued)

*Primary Examiner* — Brenda Bernardi
(74) *Attorney, Agent, or Firm* — Wenderoth, Lind & Ponack, L.L.P.

(57) ABSTRACT

A sound field control apparatus appropriately presenting desired sound in a listening area and sufficiently reducing the sound in a nearby area without constraint on configuration arrangement includes: a listening compensation filter processing a signal from a sound source using a control characteristic and outputting the signal to a second speaker; and a control filter processing the signal from the listening compensation filter using a control characteristic and outputting the signal to a first speaker. The characteristic of the control filter is a first previously-set characteristic whereby reproduced sound from the second speaker is reduced by reproduced sound from the first speaker at a first control position. The characteristic of the listening compensation filter is a second previously-set characteristic whereby sound having a predetermined target acoustic characteristic is presented by reproduced sounds from the first and second speakers at a second control position.

13 Claims, 89 Drawing Sheets

(56) References Cited

U.S. PATENT DOCUMENTS

| | | | | |
|---|---|---|---|---|
| 2007/0098183 | A1 | 5/2007 | Enamito et al. | |
| 2009/0129604 | A1 | 5/2009 | Enamito et al. | |
| 2009/0154723 | A1* | 6/2009 | Choi et al. | 381/80 |
| 2010/0272292 | A1* | 10/2010 | Taufour et al. | 381/119 |
| 2012/0140945 | A1* | 6/2012 | Harris | 381/86 |
| 2012/0170762 | A1* | 7/2012 | Kim et al. | 381/59 |

FOREIGN PATENT DOCUMENTS

| | | |
|---|---|---|
| JP | 2005-142634 | 6/2005 |
| JP | 2005-249989 | 9/2005 |
| JP | 2006-74442 | 3/2006 |
| JP | 2007-121439 | 5/2007 |
| JP | 2009-111920 | 5/2009 |
| JP | 4359208 | 11/2009 |

OTHER PUBLICATIONS

Hisashi Uematsu et al., "A local area sound reproduction taking the arrangements of loud speakers into account" The institute of electronics, information and communication engineers, Oct. 2004.

Hisashi Uematsu et al., "Localized sound reproduction method that takes into consideration desired sound characteristics in a localized area", Journal of Acoustical Society of Japan, vol. 62, No. 2 (2006), pp. 89 to 97, Received on Feb. 25, 2005 and determined to be recorded on the journal on Oct. 3, 2005 (with partial English translation).

Seigo Enomoto et al., "An experimental study on the reproduction system in the localized sound field", Collected papers of Acoustical Society of Japan, Sep. 3-5-18, 2002, pp. 567 to 568 (with English translation).

Shiro Ise, "A principle of active control of sound based on the Kirchhoff-Helmholtz integral equation and the inverse system theory", Journal of Acoustical Society of Japan, vol. 53, No. 9 (1997), pp. 706 to 713 Received on Dec. 11, 1996 (with partial English translation).

Elliot et. al., "A multiple error LMS algorithm and its application to active control of sound and vibration", IEEETrans. on Acoustics, Speech, and Signal Processing, vol. 35, Oct. 1987.

M. Miyoshi et. al., "Inverse Filtering of Room Acoustics", IEEE Trans. on Acoustics, Speech, And Signal Processing, vol. 36, No. 2, Feb. 1988.

* cited by examiner

SOUND FIELD CONTROL APPARATUS AND SOUND FIELD CONTROL METHOD

TECHNICAL FIELD

The present invention relates to sound field control apparatuses which change sound field characteristics of a space such as a room. In particular, the present invention relates to a sound field control apparatus and so forth which control a sound field to allow, in the case of television (TV) watching for example, TV audio to be heard only in a specific area and to be reduced in other areas.

BACKGROUND ART

Sounds that a person hears include pleasant sounds and unpleasant sounds. Typical examples of the unpleasant sound are factory noises and transportation noises made by cars, airplanes, and the like. On the other hand, examples of the pleasant sound include music. Here, music may be pleasant for a person who is willing to enjoy this music. However, this music is not always pleasant for any other person present nearby. For example, suppose that audio listening and TV watching are enjoyed in a living room of a house. In this case, these sounds are pleasant for those who listen to the sounds near the audio system and the TV. However, for those who enjoy a conversation in the same living room, these sounds may make the conversation hard to hear and thus disturb the conversation. Although those who enjoy the audio listening and TV watching would like to enjoy the sounds at high-volume levels, the volume levels just have to be turned down because the sounds may interrupt the conversation. This leaves much to be desired by those who enjoy these sounds. Here, suppose that elderly man and woman are watching the TV. In general, the elderly have reduced hearing ability and, for this reason, the elderly tend to turn up the volume level considerably high. As a result, the sound from the TV becomes noise that increasingly interrupts the conversation, and this may possibly lead to a family problem.

In order to solve such a problem, the sound may be reproduced (outputted) only in an area for listening to, for example, TV and thus may not be reproduced in other areas. One of the most typical conventional techniques to solve the problem is to use a directional speaker. Classical examples include a geometrically-shaped speaker, such as a horn speaker. With the geometric form, it is relatively easy to obtain directivity at high frequencies. At low frequencies, however, the diameter and depth needs to be long in order to obtain sharp directivity, thereby increasing the size of the speaker. With this being the situation, in recent years, techniques of a parametric speaker (an ultrasonic speaker) and an array speaker may be used. The parametric speaker demodulates an original audio signal in air from ultrasound modulated by an audio signal, using nonlinearity of air with respect to ultrasound. The array speaker obtains directivity by the synthesis of sounds radiated from a plurality of speakers arranged linearly.

However, any of the above directivity control techniques performs control to allow a reproduced sound to propagate in a certain direction (the front direction of the speaker, for example). This means that when a person is present in this direction regardless of whether the person is ahead (in front) of the speaker or behind the speaker, the sound is transferred and thus heard by this person. To be more specific, by strongly controlling the directivity into the front direction of the speaker, it is possible to make it difficult to hear the sound in the right and left directions. However, it is impossible to perform control to allow the sound to be heard only by a person present in front of the speaker in the front direction and not to be heard by a person present behind the speaker in the front direction. In other words, the reaching distance of the sound cannot be controlled. In order to solve this, in a gallery or a museum for example, a directional speaker is fixed to the ceiling to limit the reproduction area to the front of a subject of appreciation, like spotlighting. However, in the case of the environment to watch TV, since the TV screen is located in front of a viewer, the sound needs to be reproduced from the front of the viewer. Otherwise, the image on the screen and the reproduced sound image do not agree with each other, thereby causing extreme discomfort. This can also be said to the case of audio listening. More specifically, it is the most common and pleasant to reproduce the sound image in front of a listener. This is because, since the original sound field of music recorded into a sound source such as a compact disc (CD) is a concert hall or a studio, the original sound field and sound image need to be reproduced to recreate the presence as if the orchestra were actually present at the location.

On account of this, it is desired for the speaker to be placed in front of the listener. The problem described above cannot be appropriately solved by the conventional directivity control technique.

Moreover, in the case of the directivity control technique, a geometrically-shaped speaker such as a horn speaker, a plurality of speakers, or an ultrasound device is used. Thus, a problem arises, for example, that the size of the speaker increases in order to control the sound at low frequencies or that the low-frequency control is difficult. For this reason, the directivity control technique is usually employed for the high-frequency control.

Furthermore, research and development have been conducted on a technique that recreates any sound field by sound field control fully employing signal processing. One of the examples is the boundary sound field control technique employing the Kirchhoff-Helmholtz integral equation. This method controls a sound pressure and sound pressure gradient (sound particle velocity) on the boundary surface in a certain enclosed space to faithfully recreate the original sound field in a different enclosed space having the same form. This method has an advantage in the low-frequency control. However, it is difficult for the method to perform the high-frequency control. Moreover, a problem arises that, for example, since the system scale increases in order to perform the high-frequency control, it is difficult to implement broadband control.

The problems and measures of the directivity control technique and the boundary sound field control technique are disclosed in Patent Literature 1, Patent Literature 2, and Patent Literature 3. Moreover, Patent Literatures 4 and 5 and Non Patent Literatures 1 to 5 also disclose the measures and the like for sound field control.

CITATION LIST

Patent Literature

[PTL 1]
Japanese Unexamined Patent Application Publication No. 2004-349795
[PTL 2]
Japanese Unexamined Patent Application Publication No. 2005-142632
[PTL 3]
Japanese Unexamined Patent Application Publication No. 2005-142634

[PTL 4]
Japanese Unexamined Patent Application Publication No. 2005-249989
[PTL 5]
Japanese Unexamined Patent Application Publication No. 2006-074442

Non Patent Literature

[NPL 1]
Uematsu, "A local area sound reproduction taking the arrangements of loud speakers into account", Technical report of the Institute of Electronics, Information and Communication Engineers, 2004.
[NPL 2]
Uematsu, "Localized sound reproduction method that takes into consideration desired sound characteristics in a localized area", Journal of the Acoustical Society of Japan, Vol. 62, No. 2, 2006.
[NPL 3]
Enomoto, "Onba no kyokushoteki saisei sisutemu no jikkenteki kento (Japanese)" ("An experimental study on the reproduction system in the localized sound field"), Collected papers of Acoustical Society of Japan, 2002.
[NPL 4]
Ise, "A principle of active control of sound based on the Kirchhoff-Helmholtz integral equation and the inverse system theory", Journal of the Acoustical Society of Japan, Vol. 53, No. 9, 1997
[NPL 5]
Elliot et. al, "A multiple error LMS algorithm and its application to active control of sound and vibration", IEEE Trans. on Acoustics, Speech, and Signal Processing, Vol. 35, 1988.
[NPL 6]
M. Miyoshi et. al, "Inverse Filtering of Room Acoustics", IEEE Trans. on Acoustics, Speech, and Signal Processing, Vol. 36, 1988.

SUMMARY OF INVENTION

Technical Problem

However, even the sound field control apparatuses disclosed in Patent Literatures 1 to 5 and Non Patent Literatures 1 to 5 above cannot perform appropriate and sufficient sound field control in the listening area for listening a desired sound and in the nearby area, without any constraint on the arrangement of the configuration.

In view of this, the present invention provides a sound field control apparatus capable of appropriately presenting a desired sound in a listening area and sufficiently reducing the sound in a nearby area without any constraint on an arrangement of a configuration.

Solution to Problem

The sound field control apparatus in an aspect according to the present invention includes: a listening compensation filter which generates a second output signal by performing signal processing on an input signal from a sound source according to a control characteristic that is previously set, and outputs the second output signal to a second speaker; and a control filter which generates a first output signal by performing signal processing on the second output signal from the listening compensation filter according to a control characteristic that is previously set, and outputs the first output signal to a first speaker, wherein the control characteristic of the control filter is previously set as a first control characteristic that allows a reproduced sound from the second speaker to be reduced at a first control position by a reproduced sound from the first speaker, and the control characteristic of the listening compensation filter is previously set as a second control characteristic that allows a sound having a predetermined target acoustic characteristic to be presented at a second control position by the reproduced sounds from the first and second speakers.

It should be noted that this general and specific aspect may be implemented using a system, a method, an integrated circuit, a computer program, or a computer-readable recording medium such as a CD-ROM. Alternatively, the aspect may be implemented by any combination of systems, methods, integrated circuits, computer programs, and recording media.

Advantageous Effects of Invention

The sound field control apparatus according to the present invention can appropriately present a desired sound in a listening area and sufficiently reduce the sound in a nearby area without any constraint on an arrangement of a configuration.

DESCRIPTION OF EMBODIMENTS

Figure 1:
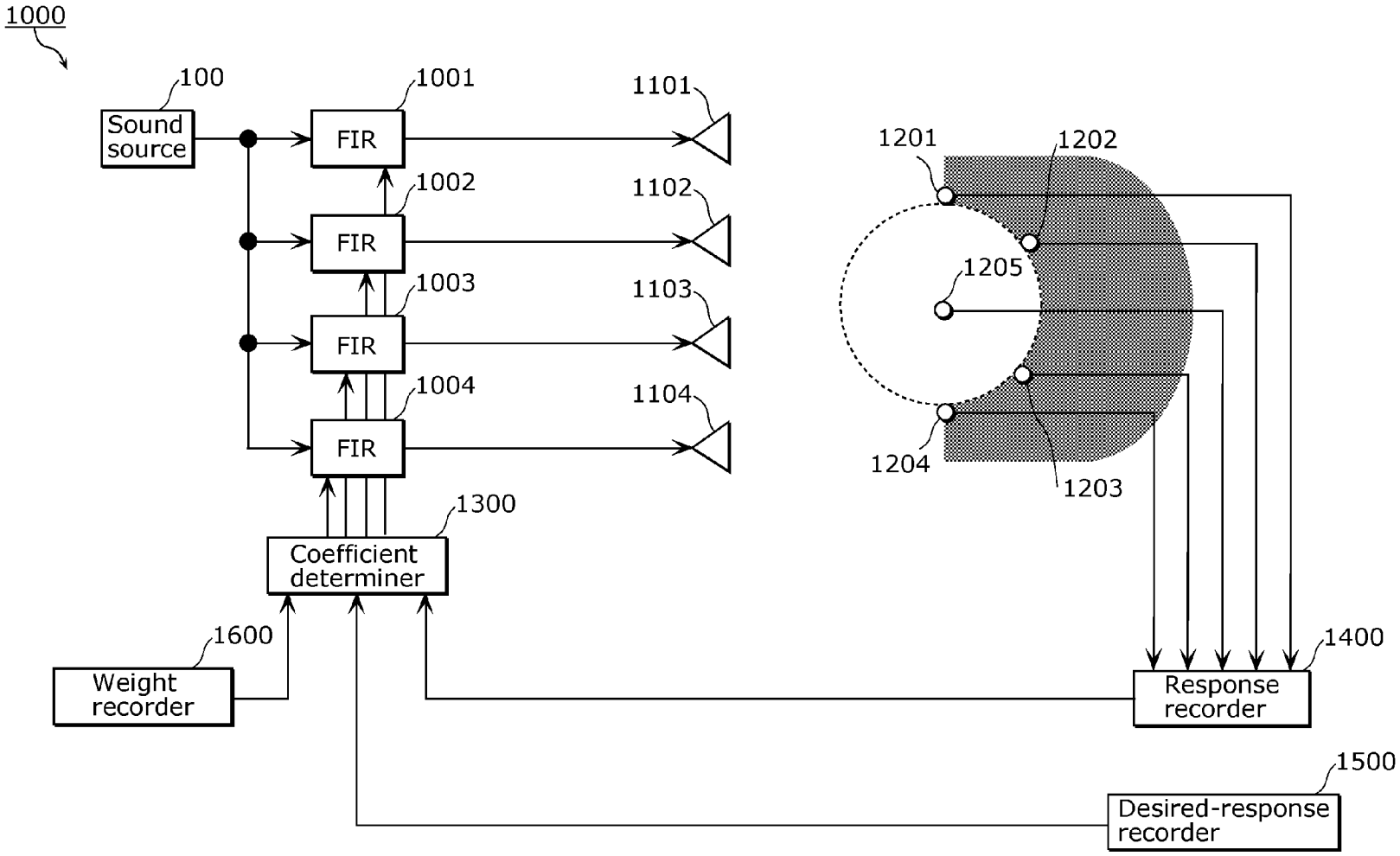
FIG. 1 is a diagram showing a configuration of a conventional sound field control apparatus.

Underlying Knowledge Forming Basis of the Present Invention

Each of the sound field control apparatuses disclosed in Patent Literatures 1 to 3 above divides a signal from a sound source into at least two frequency bands such as a low frequency band and a high frequency band, and employs the aforementioned boundary sound field control technique for a specific frequency band such as a low frequency band or individually for each frequency band. In addition to this technique, the sound field control apparatus also uses an ultrasonic vibration element. Moreover, spacings between speakers and between sensors in the arrangement are devised. Accordingly, the sound field control apparatus attempts to solve the aforementioned problem that it is difficult to implement the broadband control of the sound field.

Non Patent Literature 1 and Non Patent Literature 2 are published by the inventors of Patent Literature 1, Patent Literature 2, and Patent Literature 3. These Literatures describes that "a conventional method based on the boundary sound field control only controls the characteristics of an area where no sound is desired, and plays no role in what kind of sound is reproduced in an area where the sound is supposed to be reproduced", regarding the area reproduction employing the boundary sound field control technique. Moreover, Non Patent Literature 2 further describes that "it is suggested that a sound having characteristics different from the characteristics of the original sound is reproduced in the reproduction area". Furthermore, Non Patent Literature 3 cited as a reference literature in Non Patent Literature 1 and Non Patent Literature 2 describes that the local sound field reproduction system based on the boundary sound field control "can implement sound pressure distribution whereby sound reproduction is confined to the immediate vicinity of the speaker and the sound is sharply reduced in an area at a short distance from the speaker". It can be understood from this description that, only by an application of the conventional boundary sound field control technique, the original sound source or any sound source cannot be recreated in the reproduction area (such as a living room where the speaker is placed) at any place (for example, an area located at a short distance from the speaker, that is, a viewing position for watching TV such as a sofa that is located at a short distance from the TV instead of being located immediately in front of the TV).

Here, the boundary sound field control technique disclosed in Patent Literatures 1 to 3 corresponds to the conventional technique described in Non Patent Literatures 1 to 3. To be more specific, even the inventions disclosed in Patent Literatures 1 to 3 cannot recreate the original sound source or any sound source at any place in the reproduction area.

In order to solve the problem of the local reproduction system (the sound field control apparatus) based on this conventional boundary sound field control technique, Non Patent Literature 1 describes the method whereby: at least one response control point having a desired characteristic other than 0 is set to define the sound in the reproduction area; and a control weight for a zero control point set on the boundary of the reproduction area and a control weight for the response control point are individually set. This method for performing control by assigning a weight for each control point is disclosed in Patent Literature 4 as well.

Similarly, in order to solve the problem of the local reproduction system based on the conventional boundary sound field control technique, Non Patent Literature 1 and Non Patent Literature 2 describe the method for devising the arrangement of the control speakers. This method is disclosed in Patent Literature 5 as well.

FIG. 1 shows a sound field control apparatus 1000 based on Patent Literature 4. As one example, the sound field control apparatus 1000 includes an N (=4) number of speakers 1101 to 1104 arranged in a space. Moreover, as an example, an M (=5) number of microphones 1201 to 1205 are arranged in this space. It should be noted that a relationship where M≥N+1 is established.

The speakers 1101 to 1104 are applied with the same input signal from a sound source 100 via finite impulse response (FIR) filters 1001 to 1004. By controlling coefficients of the FIR filters 1001 to 1004, the signals applied to the speakers 1101 to 1104 can be individually controlled.

Firstly, impulse responses $h_{ij}$ (i=1, 2, 3, 4 and j=1, 2, 3, 4, 5) from the speakers 1101 to 1104 to the microphones 1201 to 1205 are recorded into a response recorder 1400. On the other hand, desired impulse responses $a_j$ (j=1, 2, 3, 4, 5) that are desired to be implemented at control points (the positions of the microphones 1201 to 1205) are recorded into a desired-response recorder 1500. Then, outputs from the response recorder 1400 and the desired-response recorder 1500 are inputted into the coefficient determiner 1300. Weight coefficients $g_j$ (j=1, 2, 3, 4, 5) of the control points are previously stored in a weight recorder 1600, and these weight coefficients are also inputted into the coefficient determiner 1300. The coefficient determiner 1300 determines filter coefficients $w_i$ (i=1, 2, 3, 4) by performing an arithmetic operation indicated by Equation 1 below using the impulse responses $h_{ij}$ and $a_j$ and the weight coefficients $g_j$, and sets these filter coefficients to the FIR filters 1001 to 1004.

[Math. 1]

$$W=(GH^TGH+\delta I)^{-1}\times GH^TGA \qquad \text{Equation 1}$$

Here, "b" represents a constant smaller than the maximum eigenvalue of "$GH^TGH$", and "I" represents a unit matrix. Moreover, "W" represents a transfer function expressing the filter coefficient $w_i$ by a frequency domain, and "H" represents a transfer function expressing the impulse response $h_{ij}$ by a frequency domain. Furthermore, "A" represents a transfer function expressing the impulse response $a_j$ by a frequency domain, and "G" represents a transfer function expressing the weight coefficient $g_j$ by a frequency domain.

Here, when a reproduction sound pressure is to be reduced in the hatched area shown in FIG. 1, the desired characteristics (the impulse responses) $a_1$, $a_2$, $a_3$, and $a_4$ of the microphones 1201 to 1204 arranged on the dotted line that is the boundary surface of the area may be set to 0. At the same time, the desired characteristic $a_5$ of the microphone 1205 is set to a characteristic of the case, for example, where the sound is reproduced solely by the speaker 1102. In this case, suppose that the weight coefficients are set as, for example, $g_1=g_2=g_3=g_4=1.0$ and $g_5=0.1$. As a result, the reproduction sound pressures of the microphones 1201 to 1204 can be reduced and the reproduction sound pressure of the microphone 1205 can be prevented from decreasing. Hence, the local reproduction system can be implemented.

Figure 2:
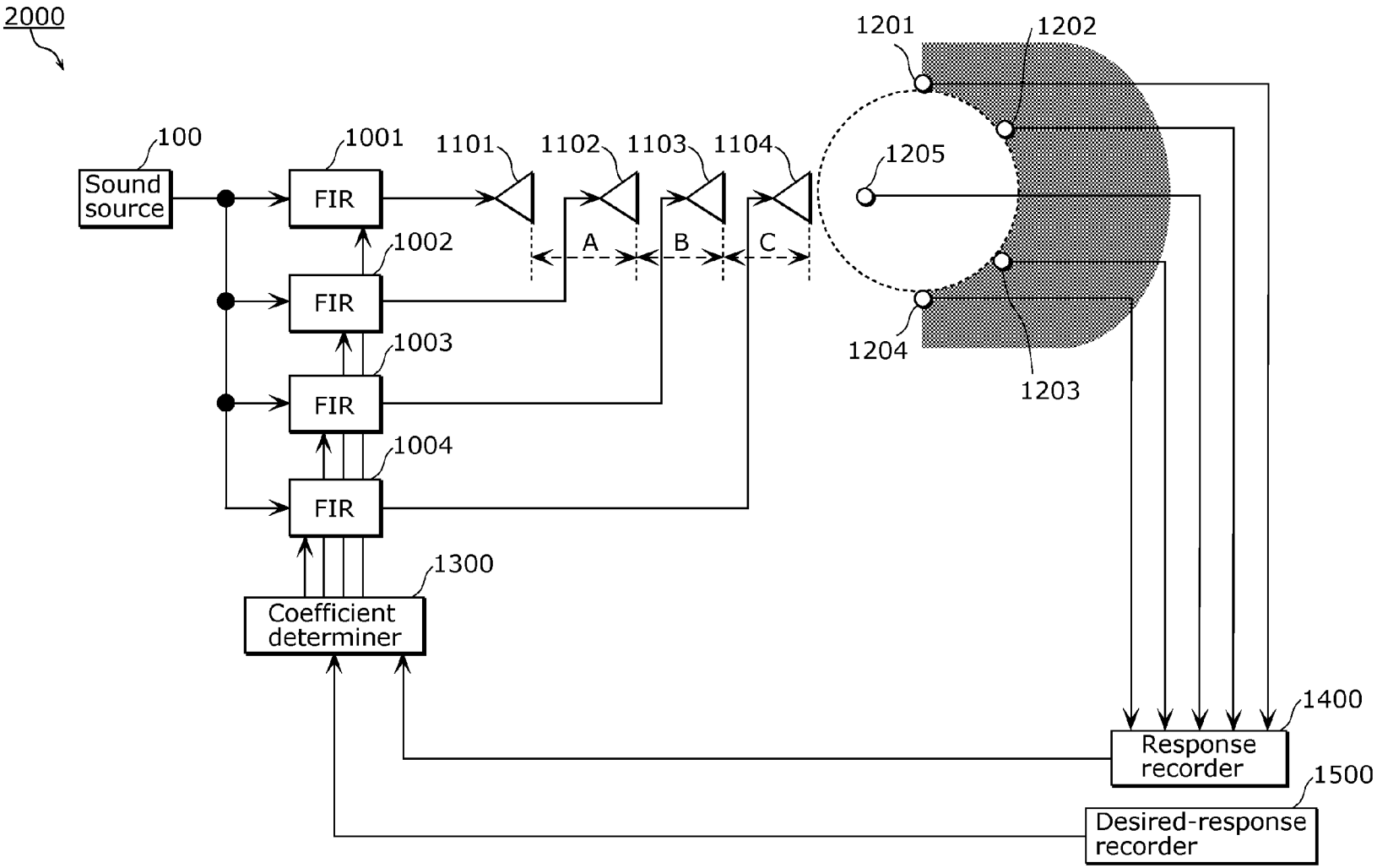
FIG. 2 is a diagram showing a configuration of another conventional sound field control apparatus.

Next, FIG. 2 shows a sound field control apparatus 2000 based on Patent Literature 5. In the sound field control apparatus 2000 in FIG. 2, the weight recorder 1600 shown in FIG. 1 is omitted and the arrangement of the speakers 1101 to 1104 is changed. The coefficient determiner 1300 determines the filter coefficients $w_i$ (i=1, 2, 3, 4) by performing an arithmetic operation indicated by Equation 2 below using the impulse responses $h_{ij}$ from the response recorder 1400 and the desired impulse responses $a_j$ from the desired-response recorder 1500, and sets these filter coefficients to the FIR filters 1001 to 1004.

[Math. 2]

$$W=(H^TH+\delta I)^{-1}\times H^TA \qquad \text{Equation 2}$$

Here, "δ" represents a constant smaller than the maximum eigenvalue of "$H^TH$", and "I" represents a unit matrix. Moreover, "W" represents a transfer function expressing the filter coefficient $w_i$ by a frequency domain, and "H" represents a transfer function expressing the impulse response $h_{ij}$ by a frequency domain. Furthermore, "A" represents a transfer function expressing the impulse response $a_j$ by a frequency domain.

Here, when a reproduction sound pressure is to be reduced in the hatched area shown in FIG. 2, the desired characteristics $a_1$, $a_2$, $a_3$, and $a_4$ of the microphones 1201 to 1204 arranged on the dotted line that is the boundary surface of the area may be set to 0. At the same time, the desired characteristic $a_5$ of the microphone 1205 is set to a characteristic of the case, for example, where the sound is reproduced solely by the speaker 1102. In this case, suppose that a spacing A between the speaker 1101 and the speaker 1102, a spacing B between the speaker 1102 and the speaker 1103, and a spacing C between the speaker 1103 and the speaker 1104 are set to establish a relationship where B<C≤A. As a result, the reproduction sound pressures of the microphones 1201 to 1204 can be reduced and the reproduction sound pressure of the microphone 1205 can be prevented from decreasing. Hence, the local reproduction system can be implemented.

Here, Patent Literature 4 describes, as to the sound field control apparatus 1000, that "since the equation is unusable when M (the number of microphones)>N (the number of speakers), $w_i$ (the filter coefficient) whereby the square error is minimum is actually calculated." Moreover, Patent Literature 4 further describes, "However, this method calculates the filter coefficient whereby the error is minimum" and, unlike the conventional method "that includes an error in principle, by performing an arithmetic operation using a weight coefficient matrix in which an allowable error is set for each control point, the rate of the allowable error can be set for each control point." To be more specific, in the case of the sound field control apparatus 1000 described above, the results obtained by the microphones 1201 to 1204 corresponding to the weight coefficient $g_1=g_2=g_3=g_4=1.0$ include errors in the first place. In addition to this, the result obtained by the microphone 1205 corresponding to the weight coefficient $g_5=0.1$ includes more errors. On account of this, it is impossible to make the sound quality implemented at the listening position of the microphone 1205 equivalent to the quality of the original sound source having the accuracy desired to be recreated (the characteristic of the microphone 1205 when the sound is reproduced solely by the speaker 1102 in FIG. 1). In some circumstances, the quality may be substantially reduced. Although Patent Literature 4 describes the effect of the case where the frequency is at 1000 Hz, whether this resulting effect can be generally applied to the cases of other frequencies is not described.

Here, Non Patent Literature 1 related to Patent Literature 4 describes as follows. "The size of the weight coefficient depends largely on the arrangement and numbers of speakers and control points. When these are changed, performance of the area reproduction also greatly changes. As of now, there are no certain guidelines for determining the arrangement method of the speakers and control points, the numbers of the speakers and control points, and the weight coefficients. It is not easy to determine these." Moreover, Non Patent Literature 1 further describes that "even when weighted multi-point control is performed, the characteristics are changed depending on the arrangement of the speakers and control points." To be more specific, Patent Literature 4 filed before the publication of Non Patent Literature 1 cannot describe either with assurance that, even with the introduction of the weight coefficients, the effect whereby the reproduced sound pressure is reduced at the zero control points (the microphones 1201 to 1204) and is not reduced at the response control point (the microphone 1205) can be obtained universally and generally for all frequencies regardless of the arrangement and number of the speakers and control points.

Next, Patent Literature 5 describes the effect achieved by the above-mentioned sound field control apparatus 2000 in the case where the frequency is at 1000 Hz. However, Patent Literature 5 does not describe whether this resulting effect can be generally applied to the cases of other frequencies.

Here, Non Patent Literature 1 and Non Patent Literature 2 related to Patent Literature 5 describe as follows. "The arrangement of the speakers was determined under the following conditions. Firstly, a rectangle or a circle having the response control point at the center was determined." "Under the condition that the speakers were to be positioned on the edge of this selected rectangle or circle, each of the positions of five speakers was randomly determined." "In many cases where excellent characteristics were obtained, four speakers were arranged on one vertical edge of the rectangle and one speaker was arranged on the other vertical edge. Moreover, in many cases, out of the spacings among the four speakers arranged on the one edge, the spacing between the middle two speakers was smaller than each of the spacings between these two speakers and the respective outwardly adjacent speakers. On the other hand, no clear tendency was found based on the arrangement of the zero control points." "As a result of performing the similar simulation at other frequencies, nearly excellent characteristics could also be obtained for frequencies lower than 1 kHz. On this account, it is believed that although the speaker arrangement determined based only on the result of the simulation at 1 kHz was employed, the result of the experiment using a band noise as the sound source was excellent." To be more specific, on the precondition that this speaker arrangement and the installation condition for the response control point are to be maintained, the effect is obtained for other frequencies different from 1 kHz. Claim 1 in Japanese Patent No. 4359208 cited as Patent Literature 5 includes a matter used to specify the invention that "an arrangement is made to allow a spacing between the sound sources positioned in the middle, out of sound sources arranged on a straight line, to be the smallest and allow a spacing between the sound sources to be larger towards an edge." From this, it is understood that to maintain the installation condition is essential.

In other words, conversely, it is understood from these descriptions that the invention described in Patent Literature 5 cannot achieve the desired effect unless the speaker arrangement and the installation condition for the response control point are maintained. To be more specific, the arrangement of the speakers 1101 to 1104 of the sound field control apparatus 2000 shown in FIG. 2 and the installation condition for the microphone 1205 are essential.

In this way, the installation conditions for the speakers and microphones of the sound field control apparatus 2000 are limited. Therefore, a problem arises that the sound field control apparatus 2000 cannot be arbitrary applied to various places and products.

Figure 3:
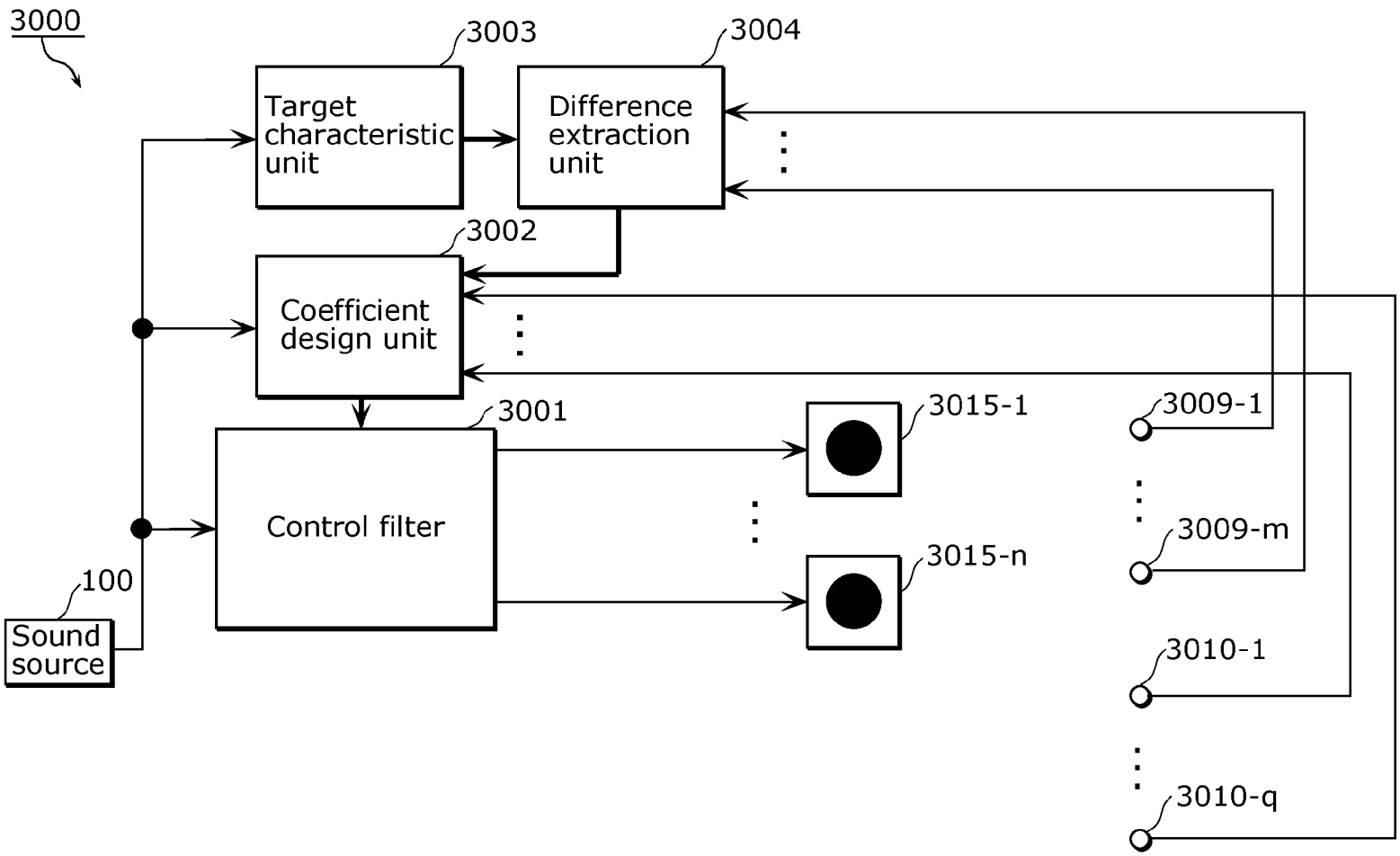
FIG. 3 is a schematic diagram showing a conventional sound field control apparatus.

A sound field control apparatus 3000 in FIG. 3 schematically shows a control configuration that forms the basis of the sound field control apparatus 1000 in FIG. 1 and the sound field control apparatus 2000 in FIG. 2. The sound field control apparatus 3000 includes a control filter 3001, a coefficient design unit 3002, a target characteristic unit 3003, a difference extraction unit 3004, microphones 3009-1 to **3009-*m*, microphones 3010-1 to 3010-*q*, and speakers 3015-1 to 3015-*n***.

The microphones 3009-1 to **3009-*m* are arranged at listening positions (in a listening area) where a sound field having a desired characteristic is wished to be recreated. Moreover, the microphones 3010-1 to 3010-*m* are arranged at positions where a quiet area is wished to be recreated. The microphones 3009-1 to 3009-*m* and the microphones 3010-1 to 3010-*q* detect sounds at the respective sound fields, and the control filter 3001 controls sounds to be reproduced from the speakers 3015-1 to 3015-*n***.

To be more specific, the sound field control apparatus 3000 has a configuration where the listening area and the quiet area are controlled at the same time only by the control filter 3001.

With the basic configuration of the sound field control apparatus 3000, the sound field control apparatus 1000 in FIG. 1 takes the weight into consideration when the coefficient are designed and the sound field control apparatus 2000 in FIG. 2 devises the arrangement of the speakers. Accordingly, each of the sound field control apparatus 1000 and the sound field control apparatus 2000 enables local reproduction. However, the aforementioned problem is not solved.

Therefore, in view of the stated problem, the present invention has an object to provide a sound field control apparatus capable of appropriately presenting a desired sound in a listening area and sufficiently reducing the sound in a nearby area without any constraint on an arrangement of a configuration. To be more specific, the present invention has an object to provide a sound field control apparatus which performs control to precisely recreate a desired sound in a listening area for listening the desired sound and to reduce the level of the sound in a nearby area in order not to interrupt, for example, a conversation.

Moreover, the present invention has an object to provide a sound field control apparatus which implements areas for listening different desired sounds at individually different areas in one space.

Furthermore, the present invention has an object to obtain, without limiting a condition for arranging acoustic devices used for control such as speakers and microphones, the effects of the speakers and microphones in the entire frequency band to be controlled, especially when the control speakers are arranged in, for example, the same plane in front of a listener.

In order to solve the stated problem, the sound field control apparatus in an aspect according to the present invention includes: a listening compensation filter which generates a second output signal by performing signal processing on an input signal from a sound source according to a control characteristic that is previously set, and outputs the second output signal to a second speaker; and a control filter which generates a first output signal by performing signal processing on the second output signal from the listening compensation filter according to a control characteristic that is previously set, and outputs the first output signal to a first speaker, wherein the control characteristic of the control filter is previously set as a first control characteristic that allows a reproduced sound from the second speaker to be reduced at a first control position by a reproduced sound from the first speaker, and the control characteristic of the listening compensation filter is previously set as a second control characteristic that allows a sound having a predetermined target acoustic characteristic to be presented at a second control position by the reproduced sounds from the first and second speakers.

With this, the reproduced sound based on the second output signal is outputted from the second speaker. Then, the signal processing is performed on the second output signal by the control filter and, as a result, the reproduced sound is outputted from the first speaker. To be more specific, as the control characteristic of the control filter, the appropriate first control characteristic to reduce the reproduction sound from the second speaker can be set based on the second output signal without consideration of the control characteristic of the listening compensation filter generating the second output signal. Moreover, regardless of the set first control characteristic, the appropriate second control characteristic to present the sound having the predetermined target acoustic characteristic at the second control position can be set as the control characteristic of the listening compensation filter, in accordance with the first control characteristic. As a result, without any constraint on the arrangement of speakers and the like, the desired sound can be appropriately presented in the listening area that is the second control position and the sound is sufficiently reduced in the nearby area that is the first control area.

In other words, since the control filter has the first control characteristic to reduce the reproduced sound from the second speaker at the first control position, the reproduced sound from the second speaker can be always reduced at the first control position regardless of the control characteristic of the listening compensation filter. At the same time, since the listening compensation filter has the second control characteristic to recreate the predetermined target acoustic characteristic at the second control position, the reproduced sounds from the first and second speakers can recreate the predetermined target acoustic characteristic at the second control position. As a result, any sound field characteristics can be implemented at different areas in one space.

Moreover, by performing: generating a target characteristic signal by performing signal processing on the input signal from the sound source according to the predetermined target acoustic characteristic; generating a second detection signal by detecting the reproduced sounds from the first and second speakers using a microphone located at the second control position; and updating the control characteristic of the listening compensation filter according to the input signal, the target characteristic signal, and the second detection signal, the updated control characteristic may be calculated and set as the second control characteristic.

For example, in the updating, a difference between the target characteristic signal and the second detection signal is calculated and the control characteristic of the listening compensation filter is updated using the input signal to reduce the difference.

With this, by the repetition of the above steps, the acoustic characteristic of the sound obtained by synthesizing the reproduced sound from the first speaker and the reproduced sound from the second speaker at the second control position can be sufficiently approximated to the predetermined target acoustic characteristic. More specifically, the second control characteristic can be set to bring about agreement between the acoustic characteristic of the above-mentioned synthesized sound and the predetermined target acoustic characteristic. Thus, the sound having the predetermined target acoustic characteristic can be reliably presented at the second control position.

Furthermore, the first control characteristic of the control filter may be calculated and set before the second control characteristic is set.

With this, the appropriate first and second control characteristics can be set. As a result, the desired sound can be more appropriately presented in the listening area, and this sound can be more sufficiently reduced in the nearby area that is the first control position.

Moreover, by performing: generating a first detection signal by detecting the reproduced sounds from the first and second speakers using a microphone located at the first control position; and updating the control characteristic of the control filter according to the second output signal from the listening compensation filter and the first detection signal, the updated control characteristic may be calculated and set as the first control characteristic.

With this, by the repetition of the above steps to reduce, for example, the acoustic level indicated by the first detection signal, the acoustic level of the sound obtained by synthesizing the reproduced sound from the first speaker and the reproduced sound from the second speaker at the first control position can be sufficiently approximated to 0. To be more specific, the first control characteristic can be set to make the acoustic level equivalent to 0 and, as a result, the reproduced sound from the second speaker can be reliably reduced at the first control position.

Furthermore, the sound field control apparatus may include an n number of the control filters, n being an integer that is at least 2, wherein the listening compensation filter may output the second output signal to an n number of the second speakers, and each of the n control filters may perform signal processing on the second output signal to be outputted to one of the n second speakers that corresponds to the control filter.

With this, the first control characteristic corresponding only to the reproduced sound from the second speaker that is one of the n second speakers can be set as the control characteristic of the control filter. As a result, even when a plurality of the second speakers are present, the appropriate first control characteristic can be set and thus the aforementioned effect can be more reliably obtained.

Moreover, the sound field control apparatus may further include an adder which adds the first output signals outputted from the n control filters and outputs an addition signal, wherein the first speaker may output the reproduced sound according to the addition signal outputted from the adder.

With this, the reproduced sound which corresponds to the first output signals outputted from the n control filters is outputted from the first speaker. Therefore, the first speaker does not need to be used for each of the control filters and the configuration of the whole system including the sound field control apparatus can be simplified.

Furthermore, the sound field control apparatus may include: a first listening compensation filter and a first control filter which are the listening compensation filter and the control filter, respectively; and a second listening compensation filter and a second control filter, wherein the second listening compensation filter may generate a third output signal by performing, according to a control characteristic that is previously set, signal processing on a current acoustic signal to be processed, and output the third output signal to a third speaker, the second control filter may generate a fourth output signal by performing signal processing on the third output signal from the second listening compensation filter according to a control characteristic that is previously set, and output the fourth output signal to the first speaker, the control characteristic of the second control filter may be previously set as a third control characteristic that allows a reproduced sound from the third speaker to be reduced at the second control position by the reproduced sound from the first speaker, and the control characteristic of the second listening compensation filter may be previously set as a fourth control characteristic that allows a sound having a predetermined target acoustic characteristic to be presented at the first control position by the reproduced sounds from the first and third speakers.

With this, at the first control position, the reproduced sound from the second speaker based on the input signal from the sound source can be reduced, and the sound that is based on the acoustic signal and has the predetermined target acoustic characteristic can be presented. At the second control position, the reproduced sound from the third speaker based on the acoustic signal is reduced and the sound that is based on the input signal from the sound source and has the predetermined target acoustic characteristic can be presented. To be more specific, the reproduced sounds to be reduced and the sounds to be presented can be made clearly different between the first control position and the second control position.

Moreover, the second listening compensation filter may perform signal processing on the input signal, as the acoustic signal, which is from the sound source and on which signal processing is performed by the first listening compensation filter.

With this, the first listening compensation filter and the second listening compensation filter perform signal processing according to the respective second and fourth control characteristics on the input signals from the same sound source. Thus, although the sounds are from the same sound source, the acoustic characteristics (the predetermined target acoustic characteristics) of the sounds can be made clearly different between the first control position and the second control position.

Furthermore, the second listening compensation filter may perform signal processing on a signal as the acoustic signal, the signal being different from the input signal which is outputted from the sound source and on which signal processing is performed by the first listening compensation filter.

With this, the first listening compensation filter and the second listening compensation filter perform signal processing according to the respective second and fourth control characteristics on the different signals (the input signal and the acoustic signal). Thus, the sounds to be presented and the acoustic characteristics (the predetermined target acoustic characteristics) of the sounds can be made clearly different between the first control position and the second control position.

Moreover, the third output signal from the second listening compensation filter may be added to the second output signal from the first listening compensation filter by an adder, and a resulting signal is outputted to the second speaker instead of the third speaker.

With this, the second speaker also serves as the third speaker. Thus, the third speaker does not need to be used, and thus the configuration of the whole system including the sound field control apparatus can be simplified.

Furthermore, each of the listening compensation filter and the control filter may include a plurality of taps and perform filtering using previous data included in a current signal to be processed.

With this, filtering such as FIR filtering can be appropriately performed on the signal (the input signal or the acoustic signal) to be processed.

The following is a concrete description of Embodiments, with reference to the drawings.

It should be noted that each of Embodiments described below shows a general or specific example. The numerical values, shapes, materials, structural elements, the arrangement and connection of the structural elements, steps, the processing order of the steps, and so forth described in Embodiments below are only examples, and are not intended to limit the present invention. Thus, among the structural elements in Embodiments below, structural elements not recited in any one of the independent claims indicating top concepts according to the present invention are described as arbitrary structural elements.

Embodiment 1

Figure 4:
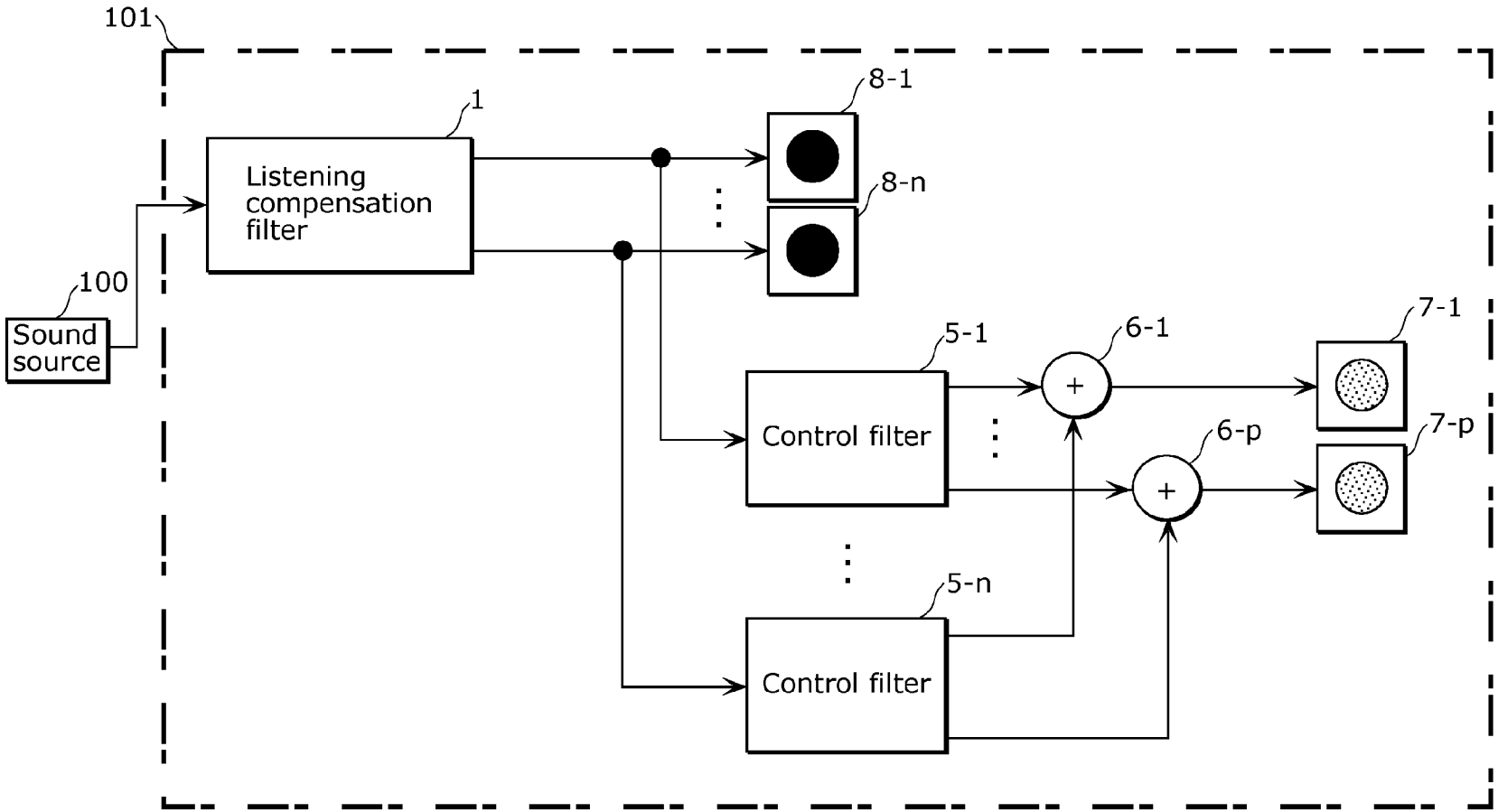
FIG. 4 is a diagram showing a configuration of a sound field control apparatus in Embodiment 1.

A configuration of a sound field control apparatus 101 in Embodiment 1 is described. FIG. 4 is a diagram showing the configuration of the sound field control apparatus 101 in Embodiment 1.

The sound field control apparatus 101 in Embodiment 1 includes a listening compensation filter 1, an n number of control filters 5-1 to **5-*n*, a p number of adders 6-1 to 6-*p*, a p number of speakers 7-1 to 7-*p*, and an n number of speakers 8-1 to 8-*n*. In the present configuration, appropriate (final) coefficients are previously set to the listening compensation filter 1 and the control filters 5-1 to 5-*n*. Thus, the sound field control apparatus 101 shown in FIG. 4 has, so to speak, the final configuration. Here, each of the listening compensation filter 1 and the control filters 5-1 to 5-*n*** is, for example, an FIR filter. More specifically, each of these filters has a plurality of taps and performs filtering using previous data included in a current signal to be processed.

The sound field control apparatus 101 shown in FIG. 4 includes the n control filters 5-1 to **5-*n*. However, the sound field control apparatus 101 may include only one control filter instead of the adders 6-1 to 6-*p*. Moreover, the sound field control apparatus 101 includes the n speakers 8-1 to 8-*n* and the p speakers 7-1 to 7-*p*. However, the sound field control apparatus 101** may not include these speakers.

To be more specific, a sound field control apparatus in an aspect according to the present invention includes: a listening compensation filter which generates a second output signal by performing signal processing on an input signal from a sound source according to a control characteristic that is previously set, and outputs the second output signal to a second speaker; and a control filter which generates a first output signal by performing signal processing on the second output signal from the listening compensation filter according to a control characteristic that is previously set, and outputs the first output signal to a first speaker. Here, the control characteristic of the control filter is previously set as a first control characteristic that allows a reproduced sound from the second speaker to be reduced at a first control position (a control point) by a reproduced sound from the first speaker. Moreover, the control characteristic of the listening compensation filter is previously set as a second control characteristic that allows a sound having a predetermined target acoustic characteristic to be presented at a second control position (a listening point) by the reproduced sounds from the first and second speakers. It should be noted that the sound source, the listening compensation filter, the control filter, the first speaker, and the second speaker mentioned above correspond, respectively, to the sound source 100, the listening compensation filter 1, any one of the control filters 5-1 to **5-*n*, at least one of the speakers 7-1 to 7-*p*, and at least one of the speakers 8-1 to 8-*n***.

Moreover, like the sound field control apparatus 101 shown in FIG. 4, a sound field control apparatus in an aspect according to the present invention may include an n number of the control filters, n being an integer that is at least 2, wherein the listening compensation filter may output the second output signal to an n number of the second speakers, and each of the n control filters may perform signal processing on the second output signal to be outputted to one of the n second speakers that corresponds to the control filter. In this case, a sound field control apparatus in an aspect according to the present invention may further include an adder which adds the first output signals outputted from the n control filters and outputs an addition signal, wherein the first speaker may output the reproduced sound according to the addition signal outputted from the adder.

Figure 5:
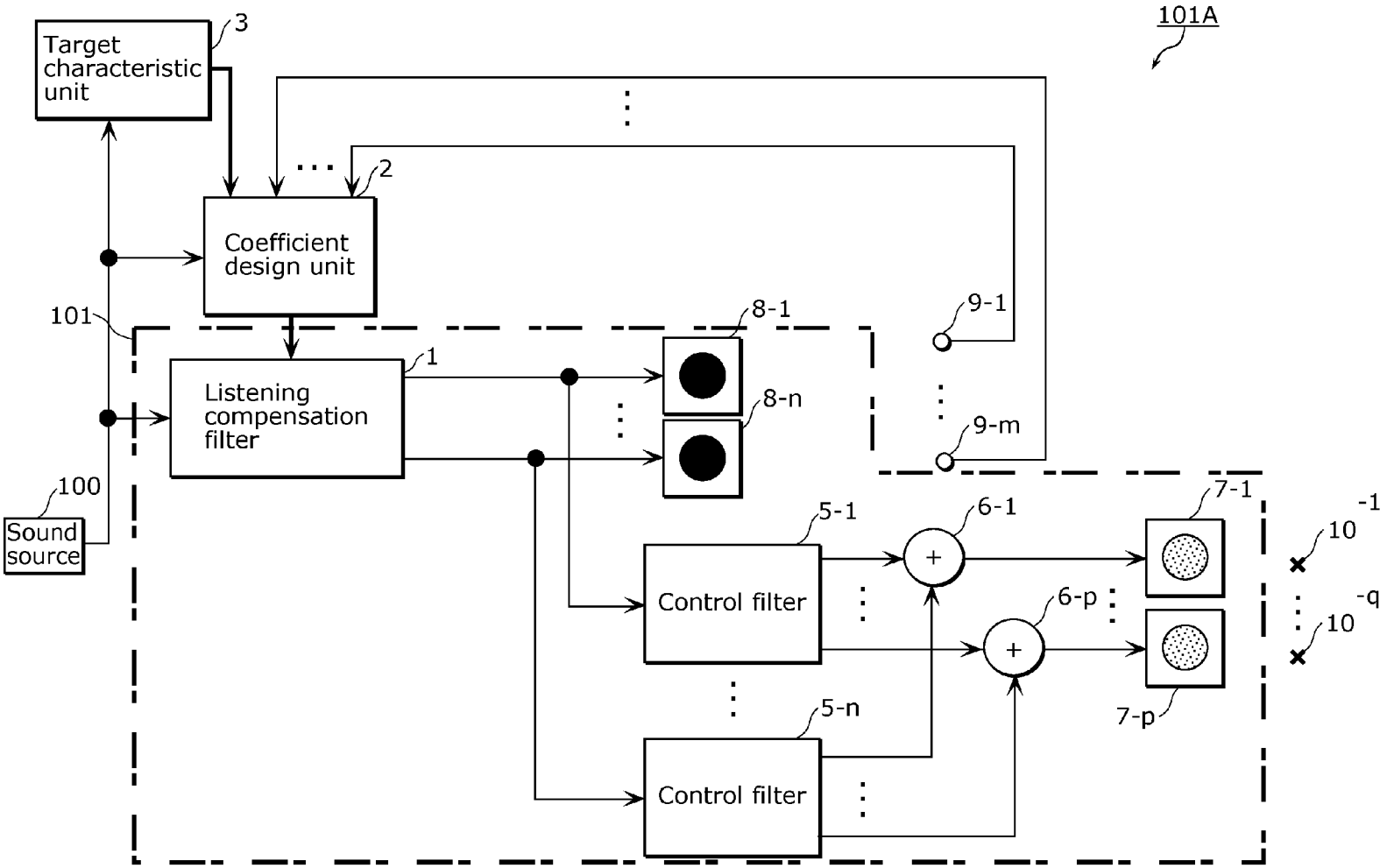
FIG. 5 is a diagram showing a configuration of a system including the sound field control apparatus in Embodiment 1.

Next, FIG. 5 shows a configuration of a system including the sound field control apparatus 101 that is at a stage where a coefficient of the listening compensation filter 1 is to be set. It should be noted that the coefficient of the listening compensation filter 1 is a filter coefficient or a control coefficient that indicates a control characteristic of the listening compensation filter 1 (the second control characteristic). A system 101A at this stage includes the sound field control apparatus 101 in which the coefficient has yet to be set, a coefficient design unit 2, a target characteristic unit 3, and an m number of microphones 9-1 to **9-*m*. The following describes an operation in which the coefficient of the listening compensation filter 1 is set in the sound field control apparatus 101, with reference to FIG. 5**.

In FIG. 5, the listening compensation filter 1 perform signal processing on an input signal from the sound source 100. As a result, n output signals (where n≥1) (the second output signals) are reproduced as sounds by the n speakers 8-1 to **8-*n*. Here, the n output signals from the listening compensation filter 1 are also received by the n control filters 5-1 to 5-*n*. Then, p output signals (where p≥1) (the first output signals) from the control filters 5-1 to 5-*n* are added by the p adders 6-1 to 6-*p* and, as a result, reproduced as sounds by the p speakers 7-1 to 7-*p***.

Here, the control filter 5-1 performs signal processing to reduce the sound reproduced by the speaker 8-1 at a q number of control points 10-1 to **10-*q* (where q p). To be more specific, the control points correspond to the zero control points described above. Similarly, the control filter 5-*n* performs signal processing to reduce the sound reproduced by the speaker 8-*n* at the q control points 10-1 to 10-*q*. As a result, all the sounds reproduced by the speakers 8-1 to 8-*n* are reduced at the control points 10-1 to 10-*q*. It should be noted that control coefficients of the control filters 5-1 to 5-*n* are previously obtained before the control coefficient of the listening compensation filter 1** is obtained.

As described above, the output signal from the listening compensation filter 1 is reproduced by the speakers 8-1 to **8-1*n* and also by the speakers 7-1 to 7-*p* via the control filters 5-1 to 5-*n***.

At the stage for setting the coefficient of the listening compensation filter 1, the sounds reproduced by the speakers 8-1 to **8-*n* and the speakers 7-1 to 7-*p* are detected by the microphones 9-1 to 9-*m* placed at an m number of listening points (the response control points) (where m≤n). It should be noted that each of the reference signs 9-1 to 9-*m* refers to a listening point or a microphone placed at the listening point. Each of the detection signals is inputted into the coefficient design unit 2. The input signal from the sound source 100 is inputted into the coefficient design unit 2 and also into the target characteristic unit 3. Here, the target characteristic unit 3 previously stores a desired characteristic (the predetermined target acoustic characteristic) for each of the listening points 9-1 to 9-*m*. According to this desired characteristic, the target characteristic unit 3 performs signal processing on the input signal from the sound source 100, and outputs the output signal obtained as a result of the signal processing (the target characteristic signal) to the coefficient design unit 2. The coefficient design unit 2 obtains the control coefficient of the listening compensation filter 1 from: the signal from the target characteristic unit 3; the signals from the microphones 9-1 to 9-*m*; and the input signal from the sound source 100. Then, the listening compensation filter 1 performs signal processing on the input signal from the sound source 100 using this control coefficient, and outputs the output signal obtained as a result of the signal processing to the speakers 8-1 to 8-*n* and the control filters 5-1 to 5-*n*. As a result, the sounds are reproduced by the speakers 8-1 to 8-*n* and the speakers 7-1 to 7-*p*, meaning that the desired characteristics are recreated at the listening points 9-1 to 9-*m***.

Figure 6:
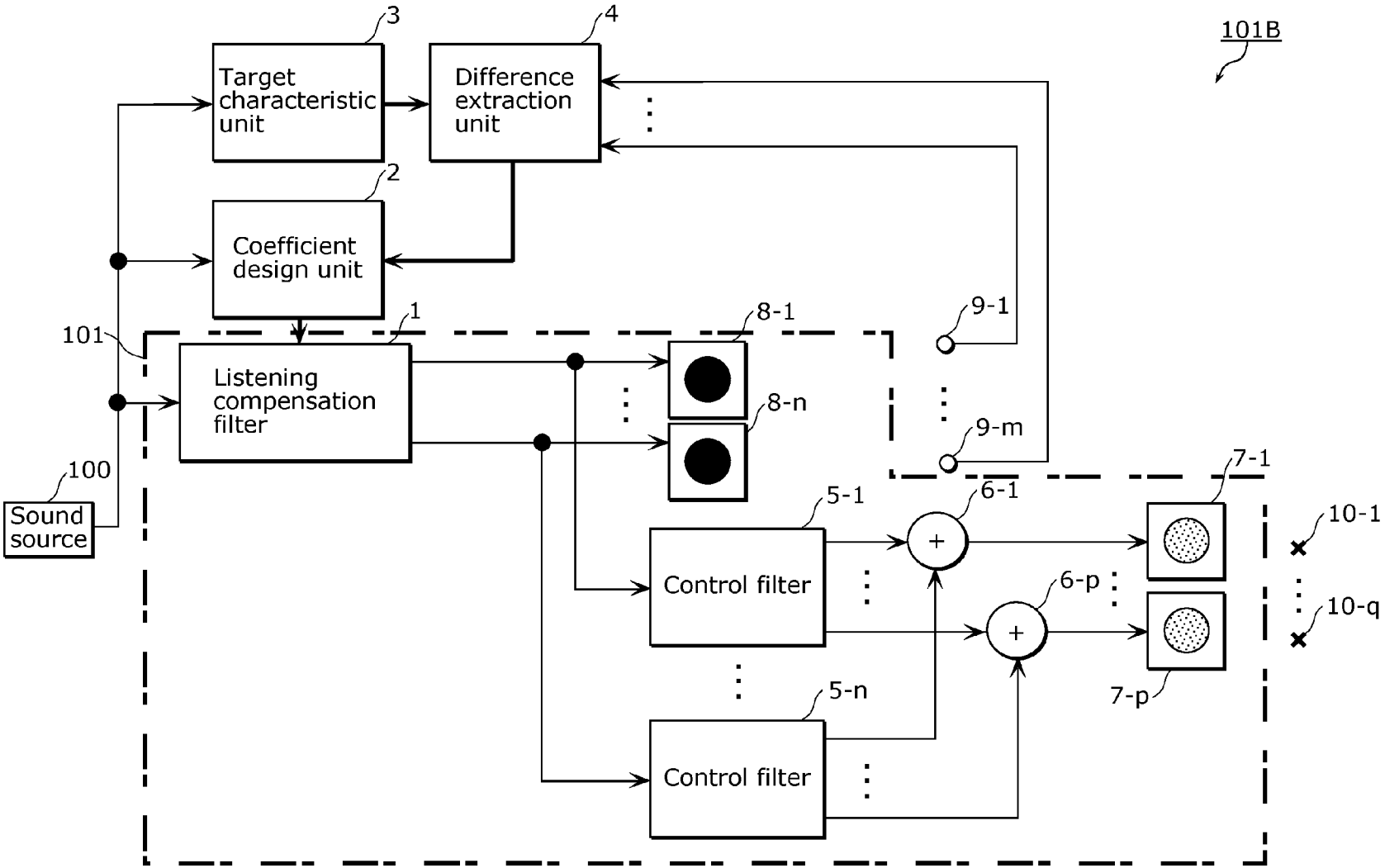
FIG. 6 is a diagram showing a configuration of another system including the sound field control apparatus in Embodiment 1.

Here, the system for setting the coefficient of the listening compensation filter 1 may further include a difference extraction unit 4 as in a system 101B shown in FIG. 6.

After the target characteristic unit 3 performs the signal processing on the input signal from the sound source 100 according to the desired characteristic, the resulting signal is inputted into the difference extraction unit 4. The signals of the sounds reproduced by the speakers 8-1 to **8-*n* and the speakers 7-1 to 7-*p* and detected by the microphones 9-1 to 9-*m* are also inputted as the detection signals to the difference extraction unit 4**.

The difference extraction unit 4 extracts a difference between the output signal from the target characteristic unit 3 and each of the signals from the microphones 9-1 to **9-*m*. Then, the difference extraction unit 4 outputs the resulting signal as the difference signal to the coefficient design unit 2. On the basis of the input signal from the sound source 100 and the difference signal from the difference extraction unit 4, the coefficient design unit 2 obtains the control coefficient of the listening compensation filter 1 to allow the difference signal from the difference extraction unit 4 to be minimum (ideally, 0). Accordingly, the desired characteristics can be recreated at the listening points 9-1 to 9-*m***.

Here, the reproduced sounds of the speakers 8-1 to **8-*n* are reduced at the control points 10-1 to 10-*q* by the control filters 5-1 to 5-*n*. On account of this, regardless of the characteristic of the control coefficient of the listening compensation filter 1, the reduction effect is always maintained. Therefore, eventually, the desired characteristics can be recreated at the listening points 9-1 to 9-*m* and, at the same time, it is quiet at the control points 10-1 to 10-*q*** since the sounds are reduced at these points.

As described above, in a sound field control apparatus in an aspect according to the present invention, the updated control characteristic is calculated and set as the second control characteristic by performing, for example, the following steps. The steps include: generating a target characteristic signal by performing signal processing on the input signal from the sound source according to the predetermined target acoustic characteristic; generating a second detection signal by detecting the reproduced sounds from the first and second speakers using a microphone located at the second control position; and updating the control characteristic of the listening compensation filter according to the input signal, the target characteristic signal, and the second detection signal. For example, in the updating, a difference between the target characteristic signal and the second detection signal is calculated and the control characteristic of the listening compensation filter is updated using the input signal to reduce the difference.

Figure 7:
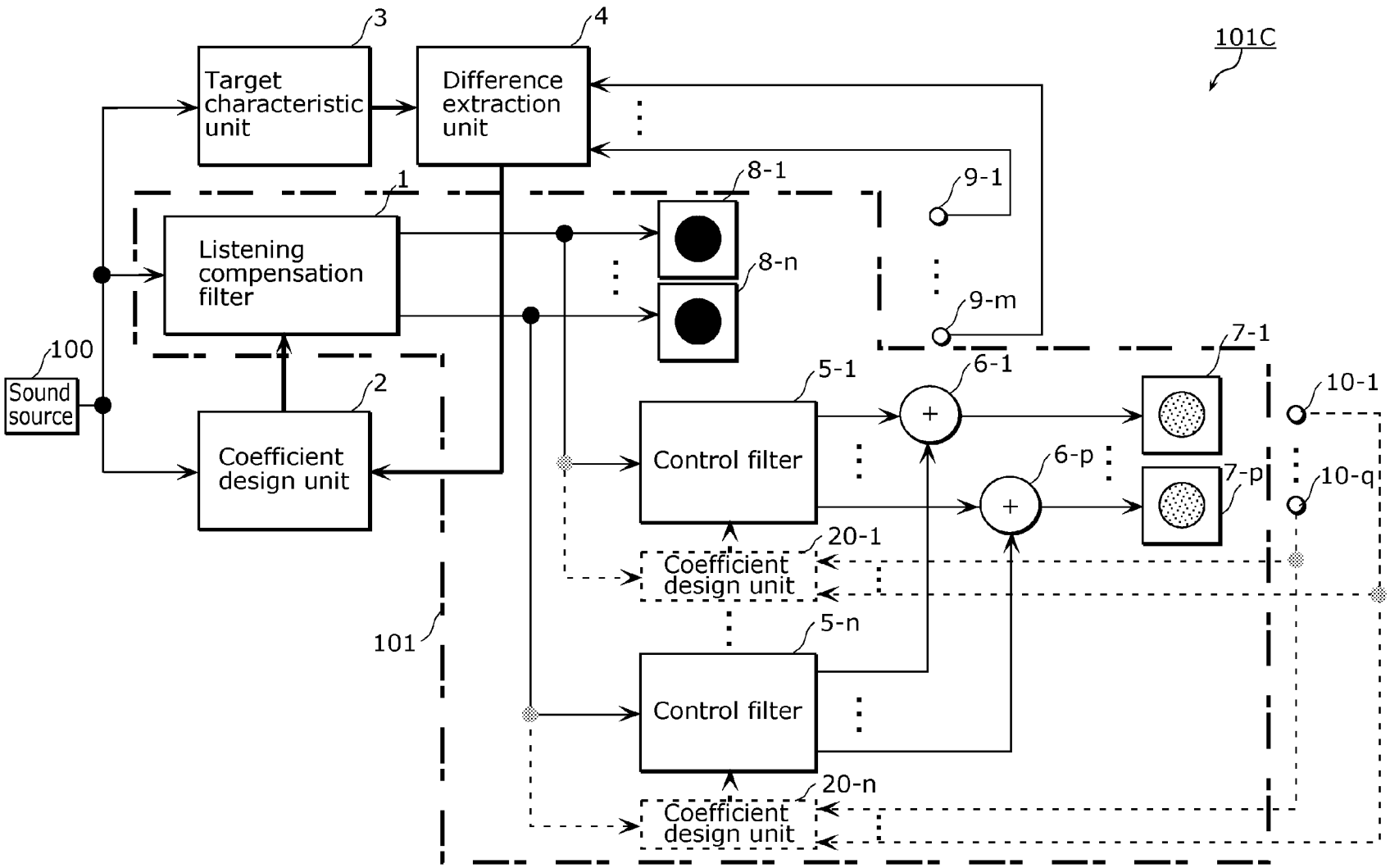
FIG. 7 is a diagram showing a configuration of another system including the sound field control apparatus in Embodiment 1.

Next, FIG. 7 shows a configuration of a system including the sound field control apparatus 101 that is at a stage where the coefficients of the control filters 5-1 to **5-*n* are to be set in addition to the coefficient of the listening compensation filter 1. A system 101C at this stage further includes coefficient design units 20-1 to 20-*n***.

As described above, the control coefficients of the control filters 5-1 to **5-*n* (the first control characteristics) of the sound field control apparatus 101 in Embodiment 1 are previously obtained before the control coefficient of the listening compensation filter 1 (the second control characteristic) is obtained. The method for calculating the control coefficients of the control filters 5-1 to 5-*n* is described as follows. Firstly, like the system 101C shown in FIG. 7 for example, the detection signals from the microphones 10-1 to 10-*q* placed at the control points and the output signal from the listening compensation filter 1 are inputted into the coefficient design units 20-1 to 20-*n*. It should be noted that each of the reference signs 10-1 to 10-*q* refers to a control point or a microphone placed at the control point. Next, on the basis of these input signals, the coefficient design units 20-1 to 20-*n* obtain the control coefficients of the control filters 5-1 to 5-*n* to allow the detection signals of the microphones 10-1 to 10-*q*** to be minimum (ideally, 0).

As described above, in a sound field control apparatus in an aspect according to the present invention, the first control characteristic of the control filter is set before the second control characteristic is calculated and set, for example. Moreover, in a sound field control apparatus in an aspect according to the present invention, the updated control characteristic is calculated and set as the first control characteristic by performing, for example, the following steps. The steps include: generating a first detection signal by detecting the reproduced sounds from the first and second speakers using a microphone located at the first control position; and updating the control characteristic of the control filter according to the second output signal from the listening compensation filter and the first detection signal.

It should be noted that the coefficient design units 2 and 20-1 to **20-*n* shown in FIG. 5 to FIG. 7 may obtain the control coefficients of the listening compensation filter 1 and the control filters 5-1 to 5-*n*** according to, for example: the method disclosed in Non Patent Literature 3 based on the boundary sound field control disclosed in Non Patent Literature 4; the method for solving the determinant that is disclosed in Patent Literature 5; the multiple error filtered-X least mean square (MEFX-LMS) algorithm disclosed in Non Patent Literature 5 described in Patent Literature 1, Patent Literature 2, and Patent Literature 3; or the multiple-input/output inverse filtering theorem (MINT) method disclosed in Non Patent Literature 6. The method for calculating the control coefficients is described in detail as follows.

Figure 8:
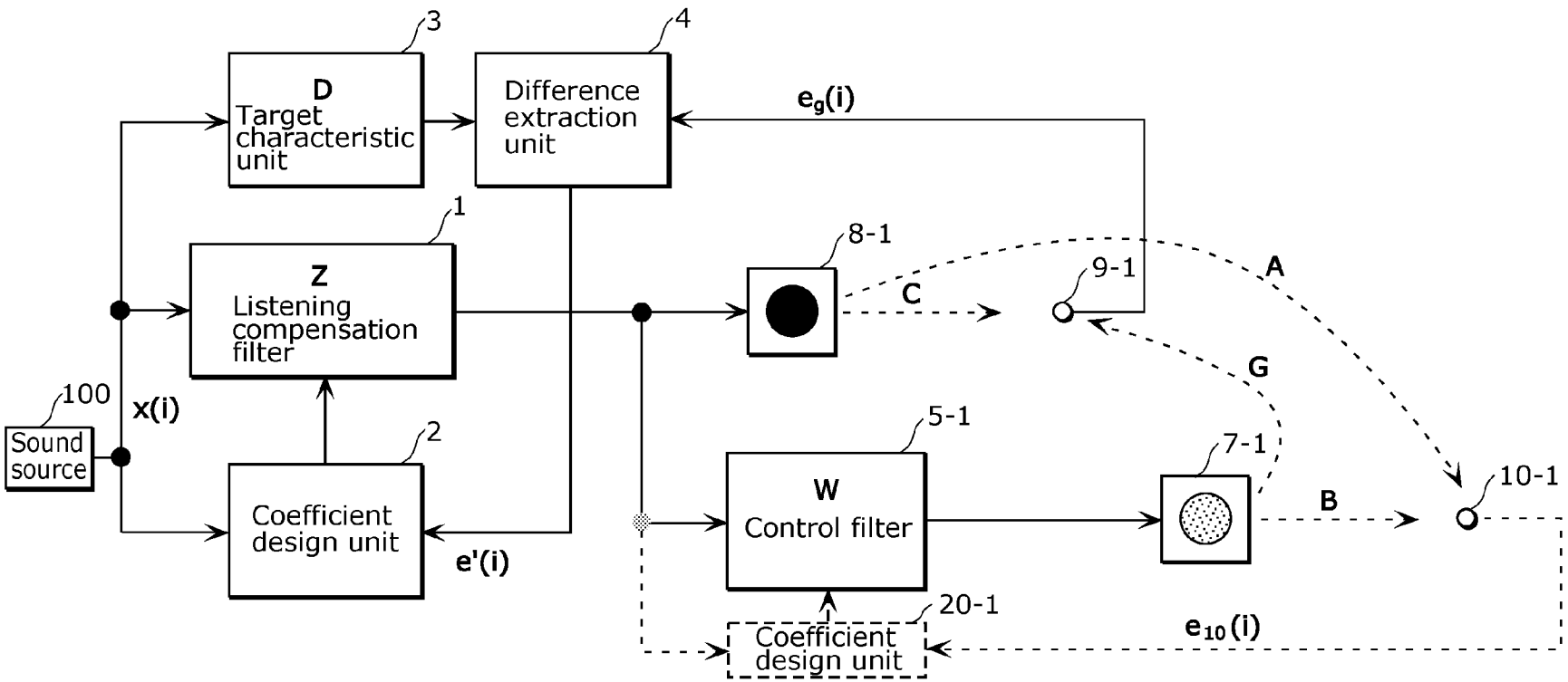
FIG. 8 is a diagram explaining signal processing performed by the sound field control apparatus in Embodiment 1.

Here, for the sake of simplicity, suppose that a system includes a single speaker 7-1, a single speaker 8-1, a single microphone 9-1, and a single microphone 10-1 as shown in FIG. 8.

Firstly, in order to obtain a characteristic of the control filter 5-1 shown in FIG. 8, the input signal from the sound source 100 bypasses the listening compensation filter 1 and is inputted directly into the speaker 8-1, the control filter 5-1, and the coefficient design unit 20-1. Here, suppose that: the target acoustic characteristic is represented by "d (i)"; a transfer characteristic from the speaker 8-1 to the microphone 10-1 is represented by "a (i)"; a transfer characteristic from the speaker 7-1 to the microphone 10-1 is represented by "b (i)"; a transfer characteristic from the speaker 8-1 to the microphone 9-1 is represented by "c (i)"; a transfer characteristic from the speaker 7-1 to the microphone 9-1 is represented by "g (i)"; and the coefficient of the control filter 5-1 is represented by "w (i)". In this case, since convolution in the time domain is equivalent to multiplication in the frequency domain, a detection signal $E_{10}$ of the microphone 10-1 formulates the following indicated as Equation 3 below. It should be noted that the capital letters included in Equation 3 represent the signals in the time domain and the coefficients in the frequency domain.

[Math. 3]

$$E_{10}=AX+WBX \qquad \text{Equation 3}$$

When the detection signal $E_{10}$ in Equation 3 is minimum, this means that this signal ideally becomes 0. When the solution is found based on this, Equation 4 shown below is obtained.

[Math. 4]

$$W=-A/B \qquad \text{Equation 4}$$

Next, a coefficient z (i) of the listening compensation filter 1 is obtained. Similarly, in FIG. 8, an output signal E' of the difference extraction unit 4 is represented by Equation 5 shown below.

[Math. 5]

$$\begin{aligned} E' &= DX - E9 \qquad \text{Equation 5} \\ &= DX - (ZCX + ZWGX) \\ &= DX - ZCX + ZAGX / B \end{aligned}$$

When the output signal E' in Equation 5 is minimum, this means that this signal ideally becomes 0. When the solution is found based on this, Equation 6 shown below is obtained.

[Math. 6]

$$Z=BD/(BC-AG) \qquad \text{Equation 6}$$

When the coefficients obtained by Equation 4 and Equation 6 as described are applied to FIG. 8, the detection signal of the microphone 10-1 becomes 0 regardless of the listening compensation filter 1, as indicated by Equation 7. At the same time, the input signal applied with the target acoustic characteristic can be heard at the position of the microphone 9-1, as indicated by Equation 8.

[Math. 7]

$$ZAX + ZWBX = X\{ABD/(BC - AG) - ABD/(BC - AG)\} = 0 \quad \text{Equation 7}$$

[Math. 8]

$$ZCX + ZWCX = X\{BCD/(BC - AG) - ADG/(BC - AG)\} = XD(BC - AG)/(BC - AG) = XD \quad \text{Equation 8}$$

Figure 9:
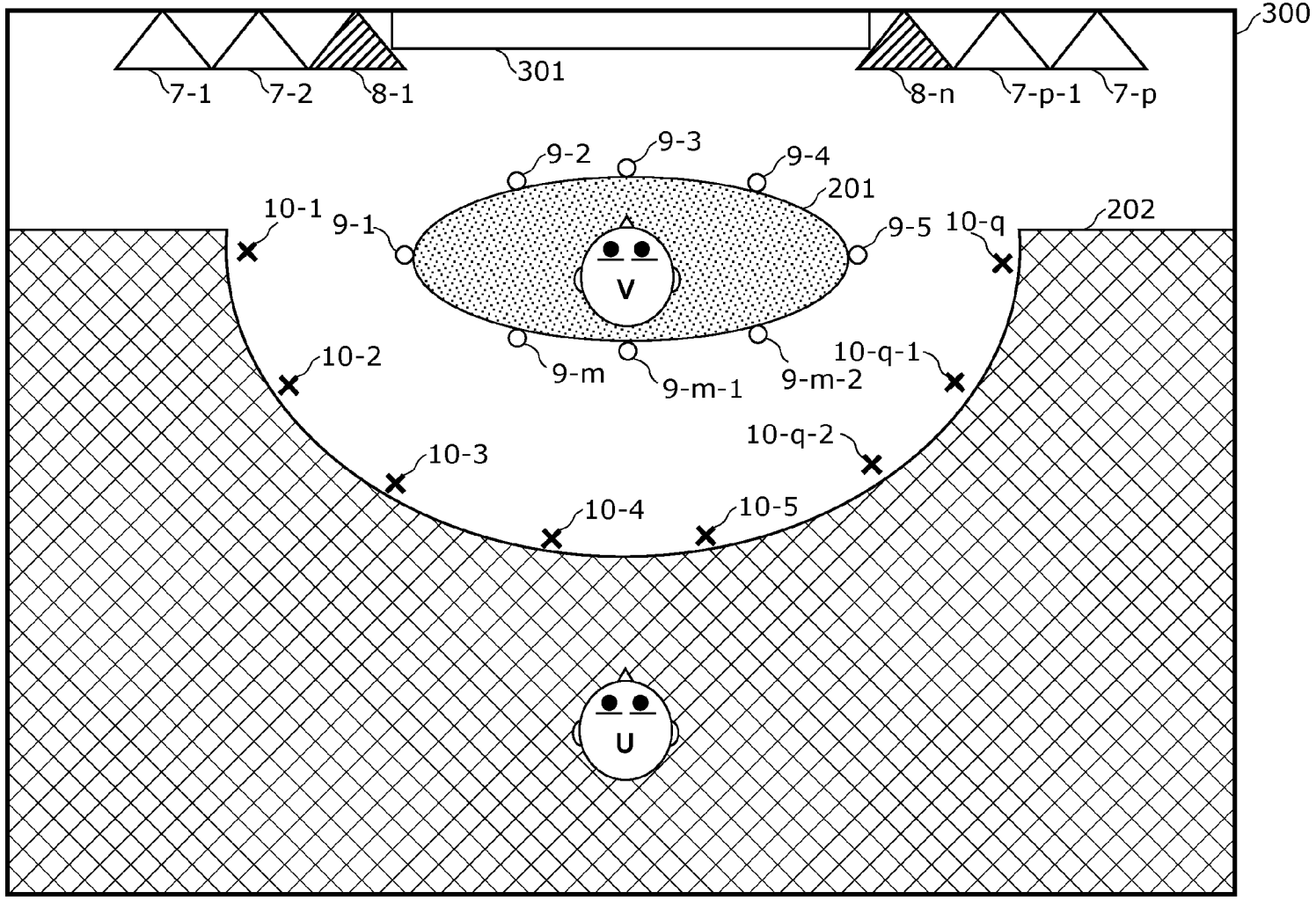
FIG. 9 is a diagram explaining a listening area and a quiet area of the sound field control apparatus in Embodiment 1.

FIG. 9 is a top view of a space (a laboratory) 300 in which the sound field control apparatus in Embodiment 1 is installed. For example, a viewer V is watching a television set (TV) 301 in the space 300 as shown in FIG. 9. Here, in an area (a listening area) 201 surrounded by the listening points 9-1 to **9-*m*, a sound field characteristic which is the same as the sound field characteristic of the sound reproduced by an internal speaker of the TV 301 is recreated by the reproduced sounds from the speakers 8-1 to 8-*n* and the speakers 7-1 to 7-*p* placed on both sides of the TV 301. At the same time, it is quiet in an area (a quiet area) 202 surrounded by the control points 10-1 to 10-*q* because the reproduced sounds from the speakers 8-1 to 8-*n* are reduced by the reproduced sounds from the speakers 7-1 to 7-*q*. Hence, the viewer V can feel as if the sound of the TV 301 were being reproduced by the internal speaker of the TV 301. At the same time, a viewer U can feel as if no sound were being reproduced by the TV 301** or that it has become quiet since the level of the reproduced sound is sufficiently low.

Figure 10:
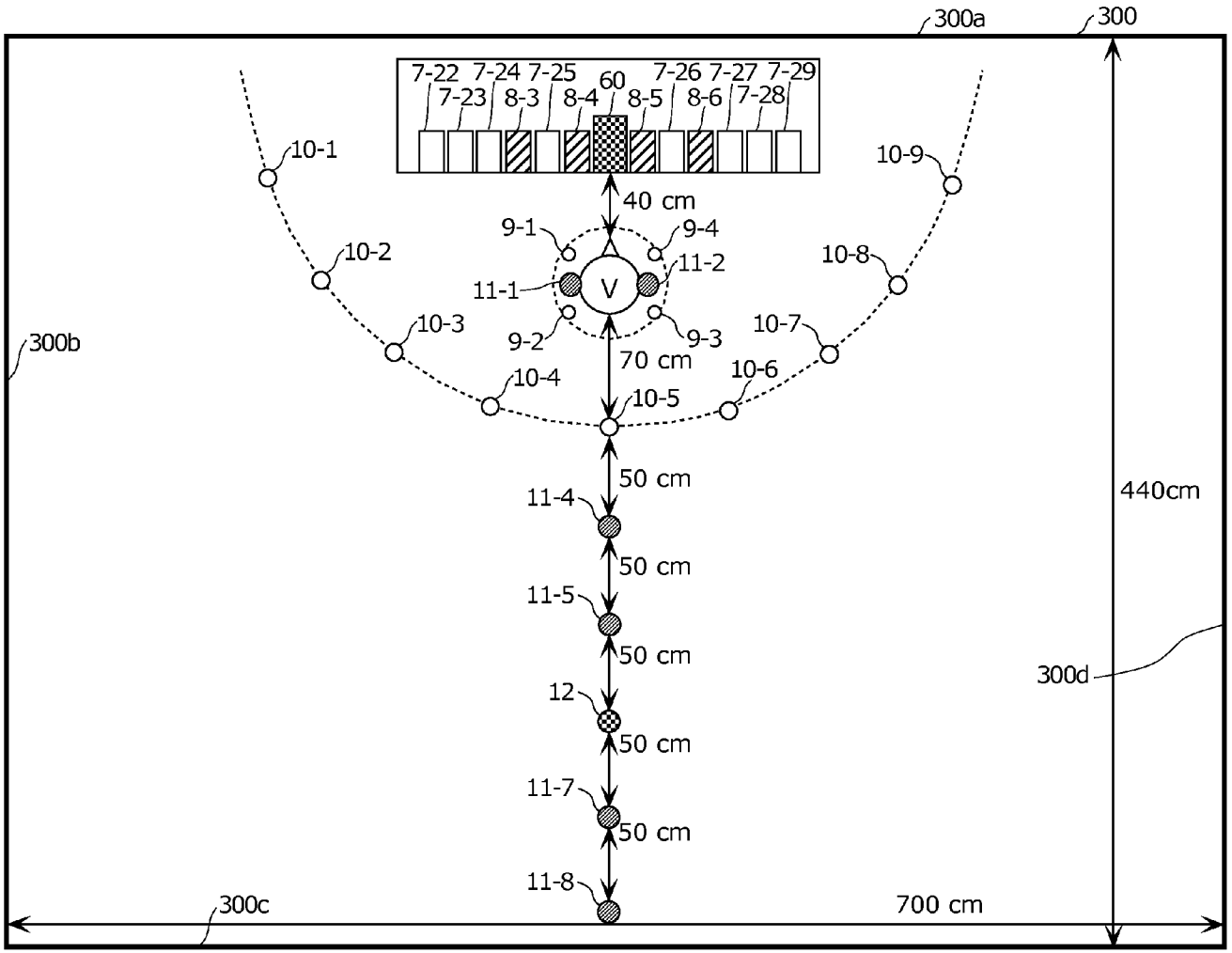
FIG. 10 is a top view showing an arrangement of microphones and speakers in a laboratory of the sound field control apparatus in Embodiment 1.
Figure 11:
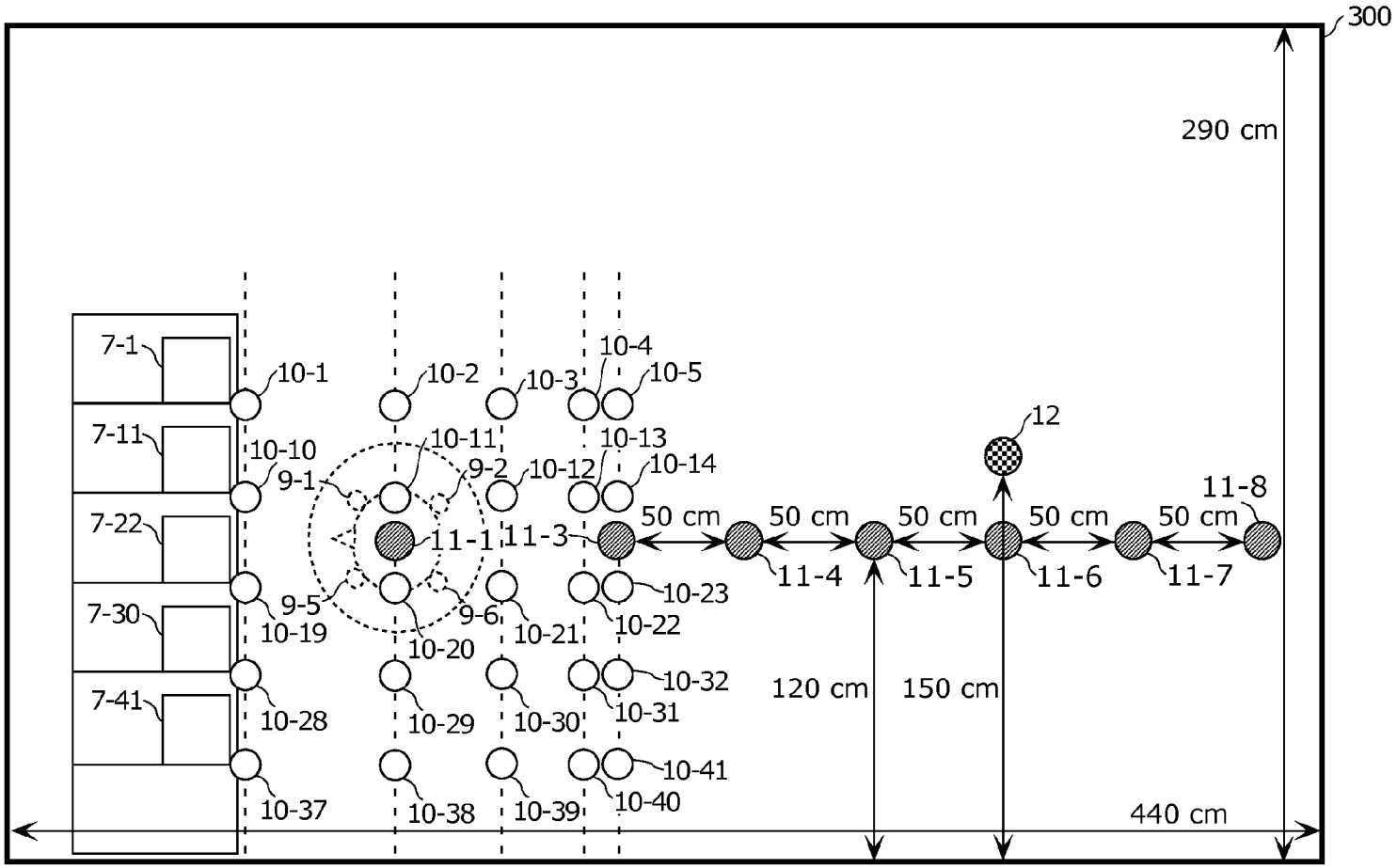
FIG. 11 is a diagram showing, from the left-hand side, the arrangement of the microphones and the speakers in the laboratory of the sound field control apparatus in Embodiment 1.
Figure 12:
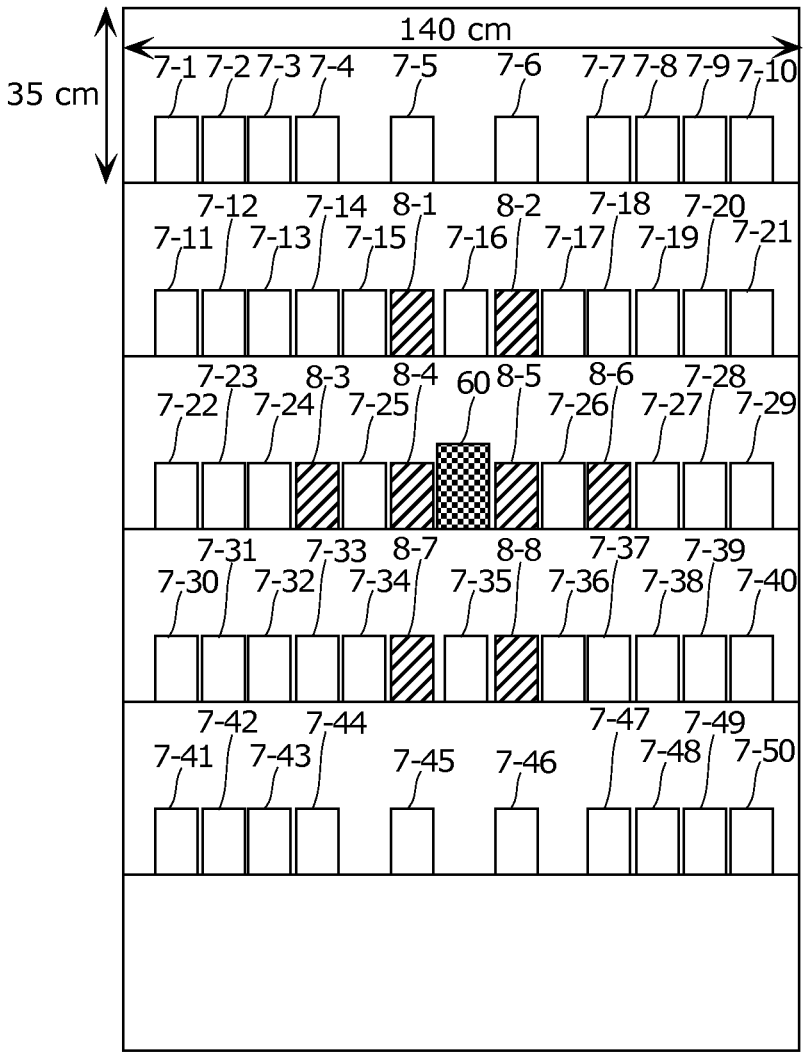
FIG. 12 is a diagram showing the arrangement of the speakers in the laboratory of the sound field control apparatus in Embodiment 1.

An experiment was actually carried out in order to verify the effectiveness. FIG. 10 to FIG. 12 are diagrams each showing the configuration in the experiment. FIG. 10 shows a top view, FIG. 11 shows a left-side view, and FIG. 12 shows an arrangement of the speakers in the configuration.

As shown in FIG. 10 to FIG. 12, a plurality of speakers 7-1 to 7-50 are placed in the laboratory 300 which is about 16 to 18 tatami mats in size, and microphones 10-1 to 10-45 for the control points are placed to surround the speakers 7-1 to 7-50. Then, around the head of the viewer V who is present inside this (inside the semicircle indicated by the dotted line in FIG. 10), microphones 9-1 to 9-8 for the listening points are placed. Here, for the sake of simplicity, the speakers shown in FIG. 10 correspond to the speakers 7-22 to 7-29, 8-3 to 8-6, and 60 which are shown in the middle section of FIG. 12. Moreover, the speakers 7-1 to 7-50 correspond to the speakers 7-1 to **7-*p* shown in FIG. 5 to FIG. 7 and, similarly, the speakers 8-1 to 8-8 correspond to the speakers 8-1 to 8-*n* shown in FIG. 5 to FIG. 7. It should be noted that the speaker 60 outputs the reproduced sound which is the target sound at the listening point. The acoustic characteristics from the speaker 60 to the listening points 9-1 to 9-8 are previously recorded as the desired characteristics (the target acoustic characteristics) into the target characteristic unit 3 shown in FIG. 5 to FIG. 7. Therefore, the speaker 60 is never used in the actual sound field control. Moreover, as shown in FIG. 12, the speakers 7-1 to 7-50, the speakers 8-1 to 8-8, and the speaker 60 are arranged in the vertical and horizontal directions to form a matrix. In this arrangement, the speaker 60 is positioned in the center and the speakers 8-1 to 8-8 are placed to surround the speaker 60**.

Furthermore, in order to verify the effect achieved by the sound field control, microphones 11-1 to 11-8 and 12 used for evaluation are placed as shown in FIG. 10 and FIG. 11. In particular, the evaluation microphone 11-1 is placed near the left ear of the viewer V and the evaluation microphone 11-2 is placed near the right ear of the viewer V.

Here, the laboratory 300 is an ordinary room. As shown in FIG. 10, a wall **300*a* and a wall 300*d* (having a door for in and out) are made of boards and a wall 300*c* is made of concrete. Moreover, a wall 300*b* includes a glass window almost occupying the wall 300*b***. The ceiling that is not illustrated is made of a board. The floor is made of concrete and a wall-to-wall carpet is installed on the floor. No particular processes such as a sound absorption process, a reflection process, and a solution process for standing-wave are performed intentionally or additionally.

Next, an actual signal processing operation is described.

Figure 13:
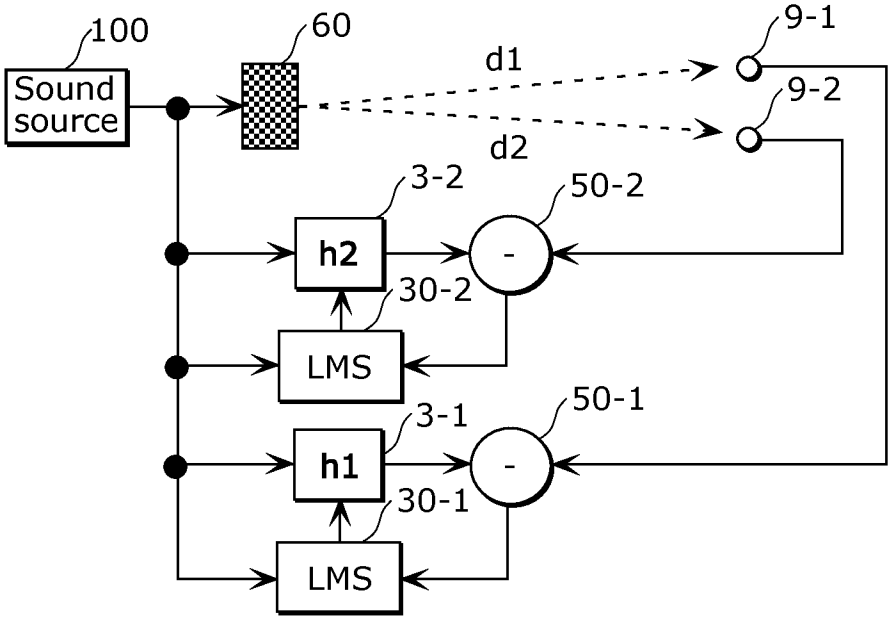
FIG. 13 is a configuration diagram explaining signal processing performed to obtain target acoustic characteristics of a target characteristic unit in Embodiment 1.

Firstly, the target acoustic characteristics to be set in the target characteristic unit 3 shown in FIG. 5 to FIG. 7 are obtained. FIG. 13 is an example showing a configuration employing the least mean square (LMS) algorithm shown by Equation 3. More specifically, FIG. 13 shows an adaptive filter. In FIG. 13, the input signal used for measurement that is outputted from the sound source 100 is reproduced as sound from the speaker 60. This reproduced sound is detected, via transfer characteristics d1 and d2, by the microphones 9-1 and 9-2 placed at the listening points, and the resulting signals are inputted into subtracters 50-1 and 50-2. On the other hand, the measurement input signal outputted from the sound source 100 is convoluted by filters 3-1 and 3-2 with coefficients h1 and h2 thereof, and the resulting signals are inputted as the output signals into the subtracters 50-1 and 50-2. The subtracters 50-1 and 50-2 subtract the output signals of the filters 3-1 and 3-2 from the detection signals of the microphones 9-1 and 9-2, and then output the results as the difference signals to LMSs 30-1 and 30-2. The LMSs 30-1 and 30-2 update the coefficients h1 and h2 of the filters 3-1 and 3-2 to allow the difference signals from the subtracters 50-1 and 50-2 to be minimum, on the basis of the measurement input signal from the sound source 100 and the difference signals from the subtracters 50-1 and 50-2. As a result, the acoustic characteristics d1 and d2 from the speaker 60 to the microphones 9-1 and 9-2 are obtained and set as the coefficients to the filters 3-1 and 3-2. To be more specific, with an update performed on the coefficients h1 and h2 one by one to allow difference signals e1 and e2 included in Equation 9 below to be minimum, the coefficients converge into: h1=d1 and h2=d2.

[Math. 9]

$$h1(i+1)=h1(i)+\mu x(i)e1(i)$$

$$h2(i+1)=h2(i)+\mu x(i)e2(i) \quad \text{Equation 9}$$

In Equation 9, "h1 (i)" represents the coefficient (vector) of the filter 3-1 and "h2 (i)" represents the coefficient (vector) of the filter 3-2. Moreover, "x (i)" represents the measurement input signal (vector) outputted from the sound source 100, and "e1 (i)" represents the difference signal (scalar) of the subtracter 50-1. Furthermore, "e2 (i)" represents the difference signal (scalar) of the subtracter 50-2, and "p" represents a step parameter (scalar) that is an update constant.

FIG. 13 shows the case where the number of microphones placed at the listening points are two for the sake of simplicity. However, when the number of microphones is eight as in FIG. 10 and FIG. 11, the acoustic characteristics d1 to d8 from the speaker 60 to the microphones 9-1 to 9-8 may be similarly obtained.

Moreover, the target acoustic characteristic can be set freely. The target acoustic characteristic is not limited to the acoustic characteristic obtained when a specific speaker 60 is placed in a listening room or in an anechoic room. The target acoustic characteristic may be: the acoustic characteristic of a speaker built in the TV 301 or in a different video audio apparatus; an ideal flat electrical characteristic with respect to the frequency (simple delay, for example); or a high pass filter (HPF) characteristic in consideration of the low-frequency performance of the speakers 7-1 to 7-50 and 8-1 to 8-8. Depending on the circumstances, the sound field characteristic of a concert hall or a baseball stadium can be set as the target acoustic characteristic. Thus, when this target acoustic characteristic is recreated in the listening area, the viewer can also experience a feeling of actually being in the location.

Figure 14:
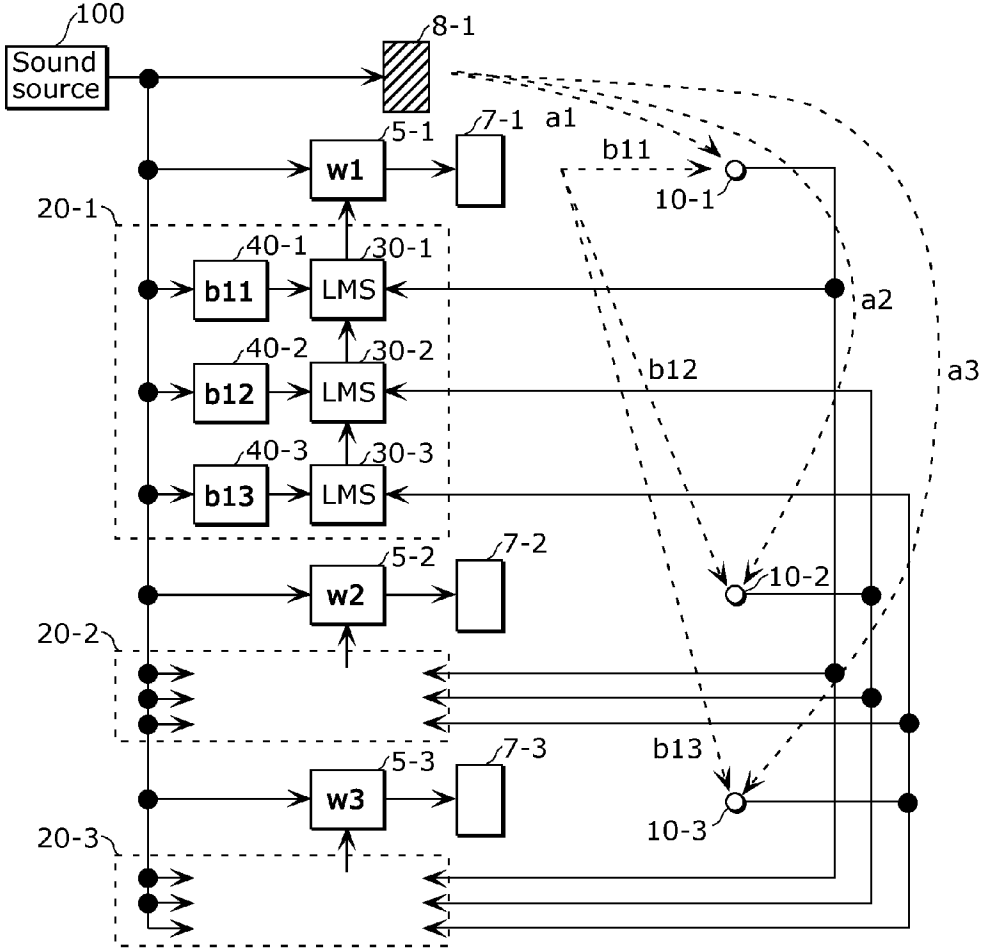
FIG. 14 is a configuration diagram explaining signal processing performed to obtain control characteristics of control filters in Embodiment 1.

After the target acoustic characteristic is obtained in advance, the control points 10-1 to 10-45 are next controlled using the speakers 7-1 to 7-50 in order for the reproduced sounds from the speakers 8-1 to 8-8 used for adjusting the listening points to be reduced in a quiet area 202 shown in FIG. 9. FIG. 14 shows a configuration for a so-called "1-3-3 control" using the MEFX-LMS algorithm disclosed in Non Patent Literature 5, in the case where the single speaker 8-1, the three speakers 7-1 to 7-3, and the three microphones 10-1 to 10-3 for the control points are provided. Here, in the case of "1-50-45 control" where the 50 speakers 7-1 to 7-50 and the 45 microphones 10-1 to 10-45 are provided, the coefficients may be obtained similarly as in the case of the above 1-3-3 control by increasing the number of control points.

In FIG. 14, the measurement input signal outputted from the sound source 100 is reproduced as sound from the speaker 8-1. This reproduced sound is propagated, via transfer characteristics a1, a2, and a3, to the microphones 10-1 to 10-3 placed at the control points. On the other hand, the measurement input signal outputted from the sound source 100 is convoluted by control filters 5-1 to 5-3 with coefficients w1, w2, and w3 thereof, and the resulting signals are reproduced as sounds by the speakers 7-1 to 7-3. Then, the measurement sound from the sound source 100 and the reproduced sounds from the speakers 7-1 to 7-3 interfere with each other at the microphones 10-1 to 10-3. The microphones 10-1 to 10-3 detect the interference sounds as the detection signals, and output the detection signals to the coefficient design units 20-1 to 20-3. Moreover, the coefficient design units 20-1 to 20-3 also obtain the measurement input signal from the sound source 100, and thus obtain the coefficients of the control filters 5-1 to 5-3 from the measurement input signal and the detection signals.

For example, the coefficient design unit 20-1 inputs the measurement input signal from the sound source 100 into Fx filters 40-1 to 40-3 where the input signals are convoluted with respective coefficients b11, b12, and b13 which are previously obtained. The coefficient b11 represents a transfer characteristic from the speaker 7-1 to the microphone 10-1. The coefficient b12 represents a transfer characteristic from the speaker 7-1 to the microphone 10-2. The coefficient b13 represents a transfer characteristic from the speaker 7-1 to the microphone 10-3. Then, the output signals from the Fx filters 40-1 to 40-3 are inputted into LMSs 30-1 to 30-3. Here, the signals detected by the microphones 10-1 to 10-3 (i.e., the detection signals) are also inputted into the LMSs 30-1 to 30-3. Based on these signals, the LMSs 30-1 to 30-3 update the coefficients w1, w2, and w3 of the control filters 5-1 to 5-3 to allow the detection signals of the microphones 10-1 to 10-3 to be minimum. This coefficient update arithmetic operation is similarly performed by the coefficient design units 20-2 and 20-3.

Note that the Fx filters and the LMSs of the coefficient design units 20-2 and 20-3 are simply omitted in FIG. 14 since each of the coefficient design units 20-2 and 20-3 has the same configuration as the coefficient design unit 20-1. Consequently, at the microphones 10-1 to 10-3, the measurement sound reproduced by the speaker 8-1 is cancelled by the reproduced sounds from the speakers 7-1 to 7-3. To be more specific, with an update performed on the coefficients w1, w2, and w3 one by one to allow difference signals e1, e2, and e3 included in Equation 10 below to be minimum, the coefficients w1, w2, and w3 converge in order for the reproduced sounds from the speakers 7-1 to 7-3 to cancel the measurement sound reproduced by the speaker 8-1.

[Math. 10]

$$w1(i+1)=w1(i)+\mu\{r11(i)e1(i)+r12(i)e2(i)+r13(i)e3(i)\}$$

$$w2(i+1)=w2(i)+\mu\{r21(i)e1(i)+r22(i)e2(i)+r23(i)e3(i)\}$$

$$w3(i+1)=w3(i)+\mu\{r31(i)e1(i)+r32(i)e2(i)+r33(i)e3(i)\}$$

$$rjk(i)=x(i)*bjk(i) \qquad \text{Equation 10}$$

In Equation 10, "w1 (i)" represents the coefficient (vector) of the filter 5-1, "w2 (i)" represents the coefficient (vector) of the filter 5-2, and "w3 (i)" represents the coefficient (vector) of the filter 5-3. Moreover, "x (i)" represents the measurement input signal (vector) outputted from the sound source 100, and "bjk (i)" represents the coefficients (vectors) of the Fx filters 40-1 to 40-3. Furthermore, "e1 (i)" represents the detection signal (scalar) of the microphone 10-1, "e2 (i)" represents the detection signal (scalar) of the microphone 10-2, and "e3 (i)" represents the detection signal (scalar) of the microphone 10-3. Moreover, "p" represents a step parameter (scalar) that is an update constant.

FIG. 14 shows the case where the speaker 8-1 for adjusting the listening point is provided. However, when the eight speakers 8-1 to 8-8 are provided as in FIG. 10 and FIG. 11, the arithmetic operation explained in FIG. 14 may be individually performed to obtain the respective coefficients of the control filters 5-1 to 5-8 corresponding to the speakers 8-1 to 8-8. To be more specific, the arithmetic operation to obtain the coefficients of the control filters may be sequentially performed as many as the number of the speakers for adjusting the listening points (eight times when the eight speakers 8-1 to 8-8 are provided). Moreover, the speaker 8-1 outputs the measurement sound corresponding to the measurement input signal from the sound source 100 shown in FIG. 14. However, the speaker 8-1 may output the measurement sound corresponding to the output signal from the listening compensation filter 1 as shown in FIG. 4 to FIG. 8.

Figure 15:
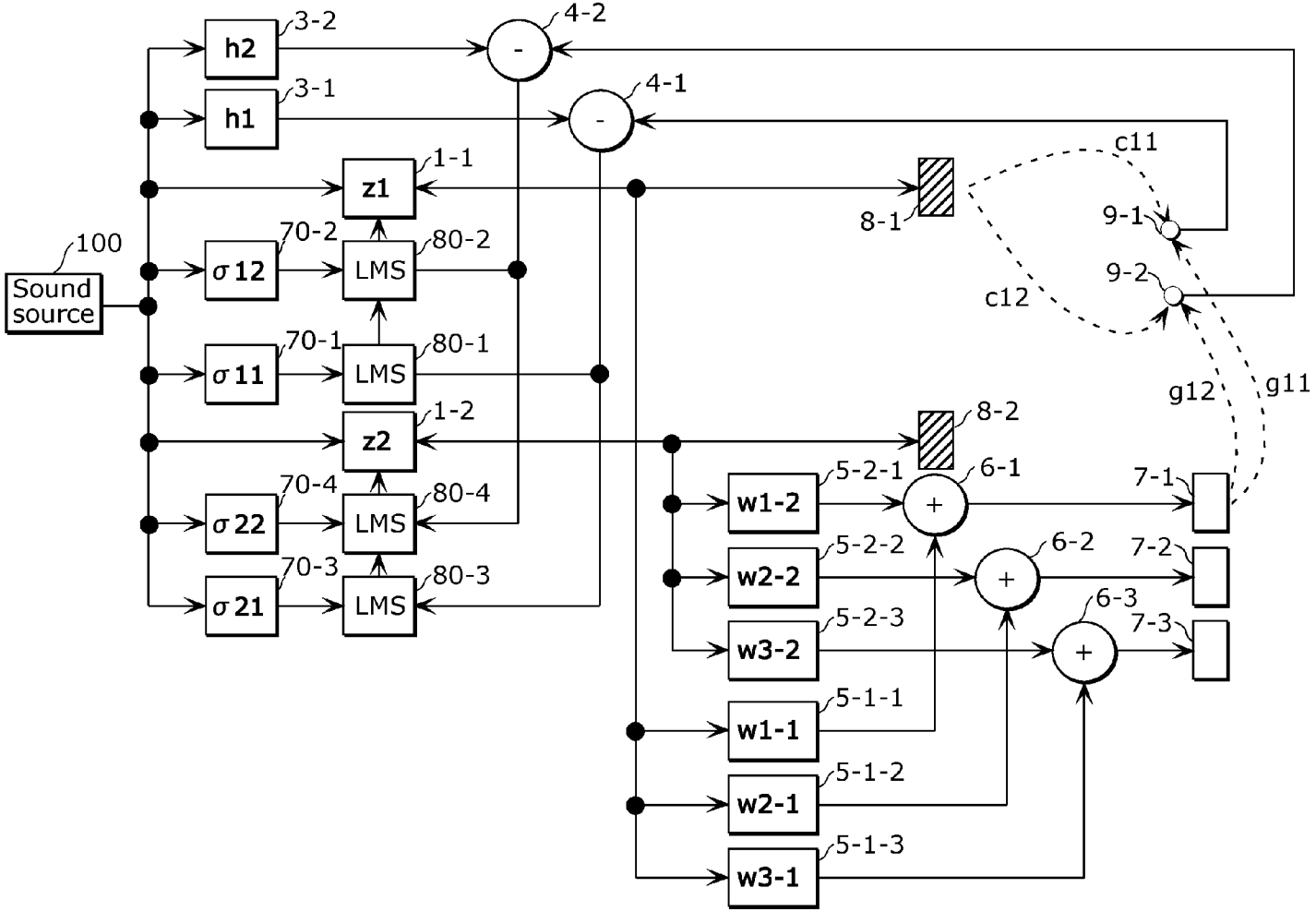
FIG. 15 is a configuration diagram explaining signal processing performed to obtain a control characteristic of a listening compensation filter in Embodiment 1.

After the coefficients of the control filters 5-1 to 5-8 are obtained, the coefficient of the listening compensation filter is obtained using the control filters 5-1 to 5-8 as coefficient-fixed filters. The listening points 9-1 to 9-8 are controlled to recreate the target acoustic characteristics in the listening area 201 shown in FIG. 9, using the speakers 8-1 to 8-8 and the speakers 7-1 to 7-50. FIG. 15 is a diagram showing a configuration for 1-2-2 control based on the MEFX-LMS algorithm disclosed in Non Patent Literature 5, when the two speakers 8-1 and 8-2, the three speakers 7-1 to 7-3, and the two microphones 9-1 and 9-2 for the listening points are provided. In the case of 1-8-8 control where the eight speakers 8-1 to 8-8 and the eight microphones 9-1 and 9-8 for the listening points are provided, the coefficients may be obtained as in the case of the aforementioned 1-2-2 control by increasing the number of listening points.

In FIG. 15, the measurement input signal outputted from the sound source 100 is convoluted with the previously-obtained coefficients h1 and h2 by the target characteristic units 3-1 and 3-2, and the resulting signals are outputted to the subtracters 4-1 and 4-2. On the other hand, the measurement input signal outputted from the sound source 100 is reproduced as the reproduced sounds by the speakers 8-1 and 8-2 via the listening compensation filters 1-1 and 1-2. Moreover, the outputs of the listening compensation filters 1-1 and 1-2 are inputted into the control filters 5-1-1 to 5-1-3 and 5-2-1 to 5-2-3 where the outputs are convoluted with the coefficients w1-1, w2-1, w3-1, w1-2, w2-2, and w3-2 obtained in FIG. 14. Then, after the output signals from these control filters are added by the adders 6-1 to 6-3, the outputs signals are reproduced as the reproduced sounds by the speakers 7-1 to 7-3. Following this, the microphones 9-1 and 9-2 detect the reproduced sounds from the speakers 8-1 and 8-2 and from the speakers 7-1 to 7-3, and then input the reproduced sounds as the detection signals into the subtracters 4-1 and 4-2. The subtracters 4-1 and 4-2 subtract the detection signals of the microphones 9-1 and 9-2 from the output signals from the target characteristic units 3-1 and 3-2, and output the results to LMSs 80-1 to 80-4. Here, the measurement input signal from the sound source 100 is also inputted into Fx filters 70-1 to 70-4 where the measurement signal is convoluted with the previously-obtained coefficients, and the resulting signals are outputted to the LMSs 80-1 to 80-4. It should be noted that coefficients 611, 612, 621, and 622 of the Fx filters 70-1 to 70-4 are previously obtained and expressed by Equation 11 below.

[Math. 11]

$$\delta 11(i)=c11(i)+w1-1(i)*g11(i)+w2-1(i)*g21(i)+w3-1(i)*g31(i)$$

$$\delta 12(i)=c12(i)+w1-1(i)*g12(i)+w2-1(i)*g22(i)+w3-1(i)*g32(i)$$

$$\delta 21(i)=c21(i)+w1-2(i)*g11(i)+w2-2(i)*g21(i)+w3-2(i)*g31(i)$$

$$\delta 22(i)=c22(i)+w1-2(i)*g12(i)+w2-2(i)*g22(i)+w3-2(i)*g32(i) \quad \text{Equation 11}$$

In Equation 11, "c11 (i)" represents a transfer characteristic from the speaker 8-1 to the microphone 9-1, and "c12 (i)" represents a transfer characteristic from the speaker 8-1 to the microphone 9-2. Moreover, "c21 (i)" represents a transfer characteristic from the speaker 8-2 to the microphone 9-1, and "c22 (i)" represents a transfer characteristic from the speaker 8-2 to the microphone 9-2. Furthermore, "w1-1 (i)" represents the coefficient of the control filter 5-1-1, "w2-1 (i)" represents the coefficient of the filter 5-1-2, and "w3-1 (i)" represents the coefficient of the filter 5-1-3. Moreover, "w1-2 (i)" represents the coefficient of the control filter 5-2-1, "w2-2 (i)" represents the coefficient of the filter 5-2-2, and "w3-2 (i)" represents the coefficient of the filter 5-2-3. Furthermore, "g11 (i)" represents a transfer characteristic from the speaker 7-1 to the microphone 9-1, and "g12 (i)" represents a transfer characteristic from the speaker 7-1 to the microphone 9-2. Moreover, "g21 (i)" represents a transfer characteristic from the speaker 7-2 to the microphone 9-1, and "g22 (i)" represents a transfer characteristic from the speaker 7-2 to the microphone 9-2. Furthermore, "g31 (i)" represents a transfer characteristic from the speaker 7-3 to the microphone 9-1, and "g32 (i)" represents a transfer characteristic from the speaker 7-3 to the microphone 9-2.

In this way, the coefficients δ11, δ12, δ21, and δ22 of the Fx filters 70-1 to 70-4 are approximated, thereby assuring that the LMSs 80-1 to 80-4 converge normally. Thus, the LMSs 80-1 to 80-4 update the coefficients of the listening compensation filters 1-1 and 1-2 to minimize the signals from the subtracters 4-1 and 4-2, based on the signals from the Fx filters 70-1 to 70-4 and the signals from the subtracters 4-1 and 4-2. As a result, the target acoustic characteristics d1 and d2 are recreated at the microphones 9-1 and 9-2. The processing described thus far is understood to be based on the MEFX-LMS algorithm disclosed in Non Patent Literature 5, as indicated by Equation 12 below.

[Math. 12]

$$z1(i+1)=z1(i)+\mu\{r11(i)e1(i)+r12(i)e2(i)\}$$

$$z2(i+1)=z2(i)+\mu\{r21(i)e1(i)+r22(i)e2(i)\}$$

$$rjk(i)=x(i)*\delta jk(i) \quad \text{Equation 12}$$

In Equation 12, "z1 (i)" represents the coefficient of the listening compensation filter 1-1, and "z2 (i)" represents the coefficient of the listening compensation filter 1-2. Moreover, "x (i)" represents the measurement input signal outputted from the sound source 100, and "δjk (i)" represents the coefficients of the Fx filters 70-1 to 70-4. Furthermore, "e1 (i)" represents the signal outputted from the subtracter 4-1, and "e2 (i)" represents the signal outputted from the subtracter 4-2. Moreover, "p" represents a step parameter that is an update constant.

FIG. 15 shows the case where the two speakers 8-1 and 8-2 for adjusting the listening points and the three speakers 7-1 to 7-3 for adjusting the control points are provided. However, when the eight speakers 8-1 to 8-8 and the 50 speakers 7-1 to 7-50 are provided as in FIG. 10 and FIG. 11, the aforementioned configuration may be simply increased according to the number of speakers. FIG. 16A to FIG. 18H show the results of the cases in FIG. 10 to FIG. 12 using the coefficients obtained in this way.

Figure 16A:
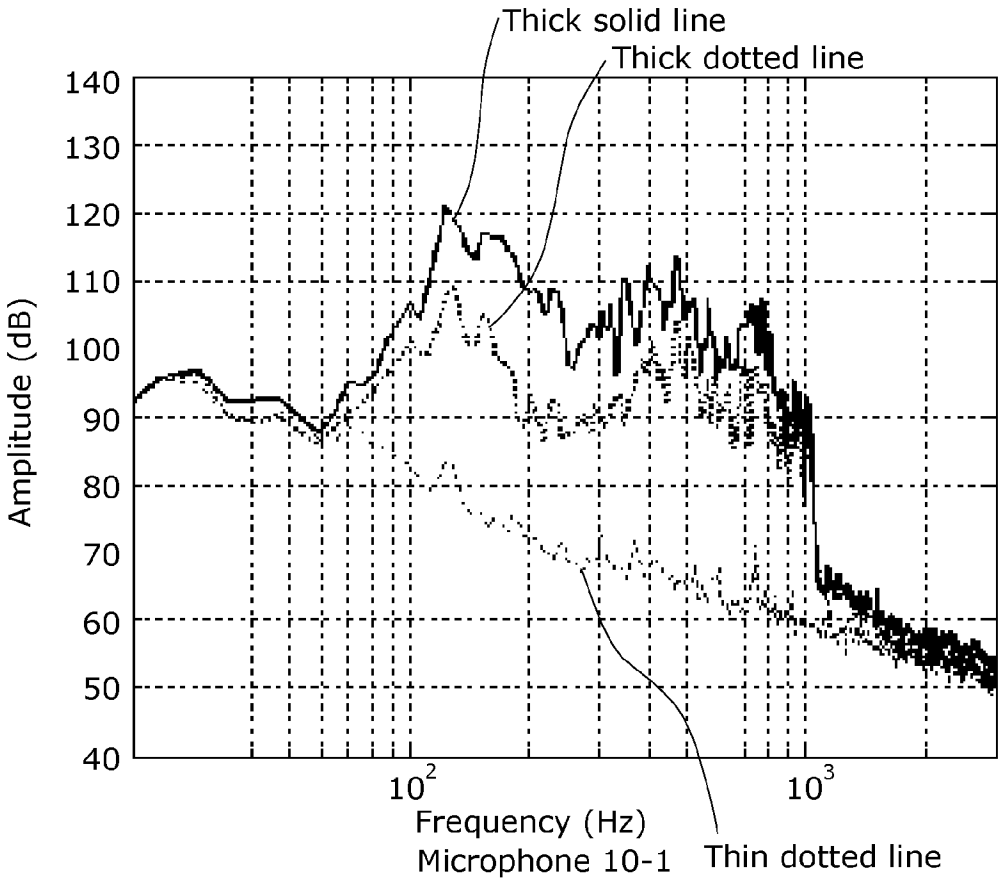
FIG. 16A is a diagram showing a control effect achieved by a microphone 10-1 for a control point, in the laboratory of the sound field control apparatus in Embodiment 1.
Figure 16B:
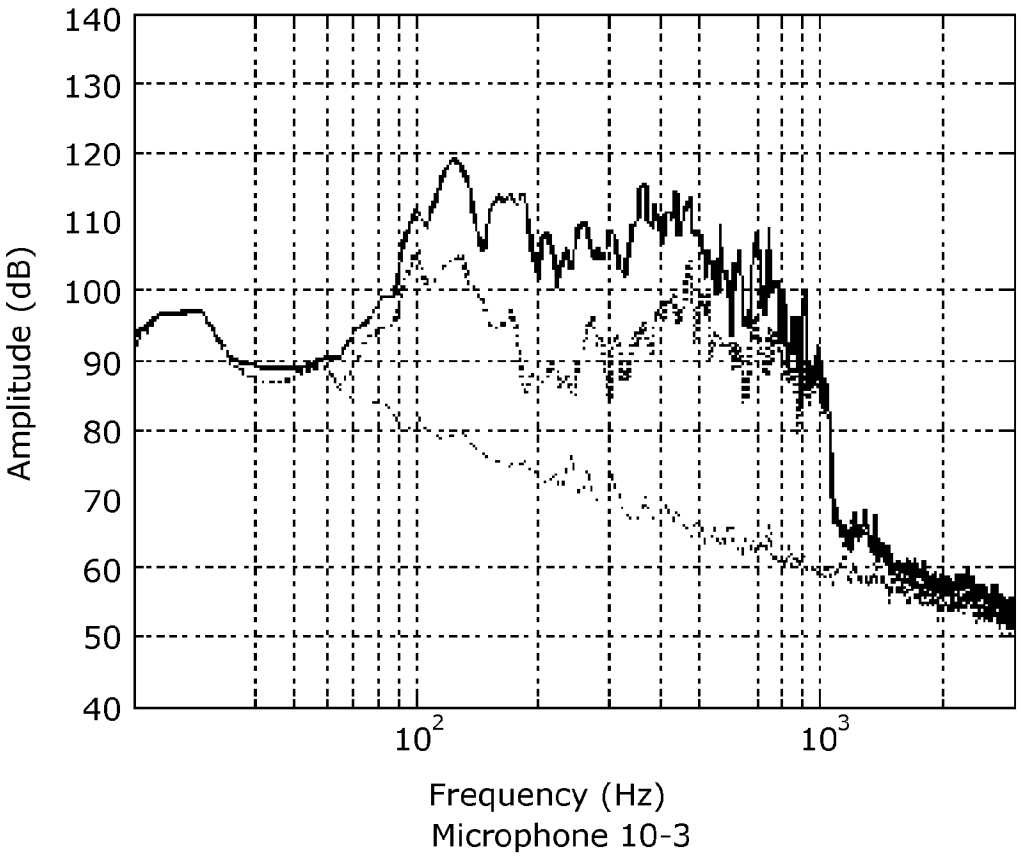
FIG. 16B is a diagram showing a control effect achieved by a microphone 10-3 for a control point, in the laboratory of the sound field control apparatus in Embodiment 1.
Figure 16C:
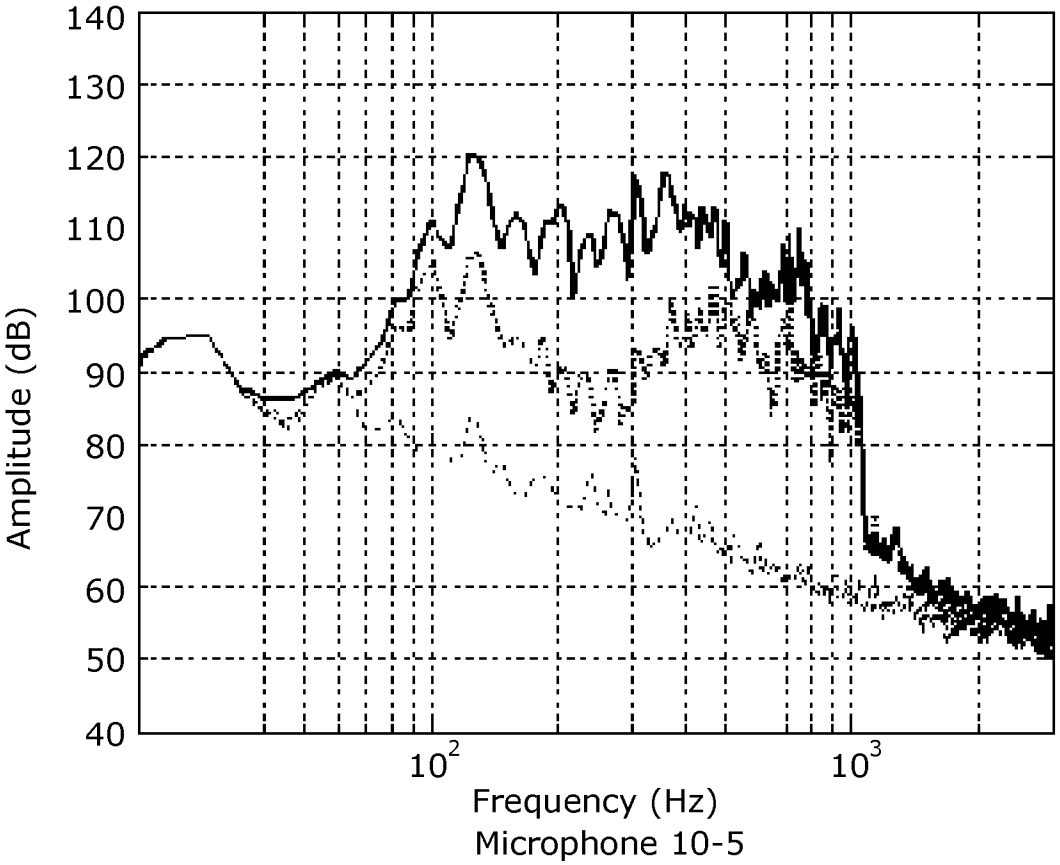
FIG. 16C is a diagram showing a control effect achieved by a microphone 10-5 for a control point, in the laboratory of the sound field control apparatus in Embodiment 1.
Figure 16D:
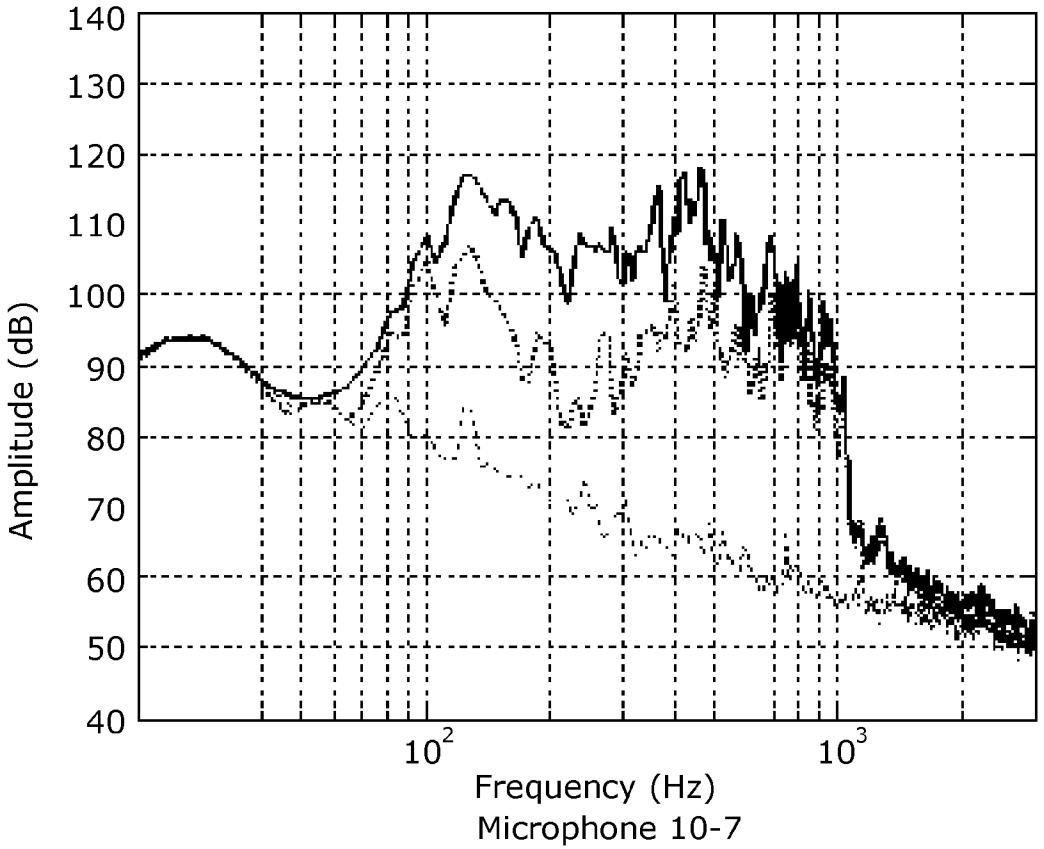
FIG. 16D is a diagram showing a control effect achieved by a microphone 10-7 for a control point, in the laboratory of the sound field control apparatus in Embodiment 1.
Figure 16E:
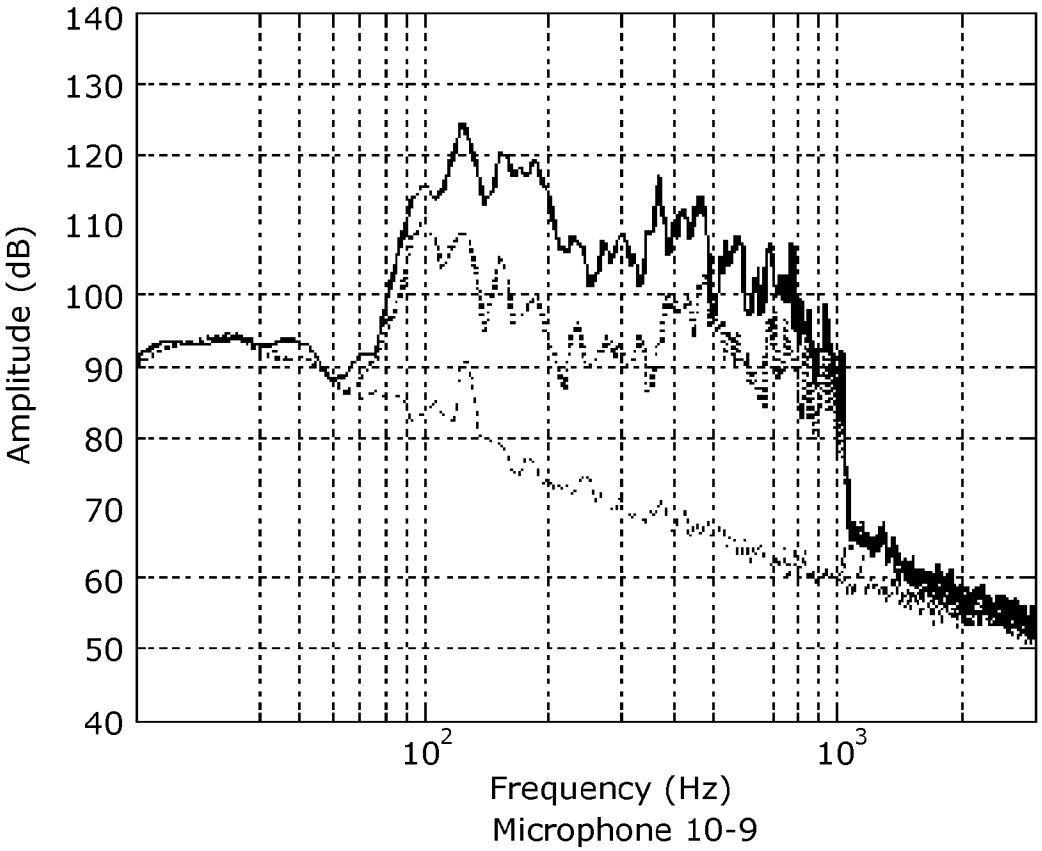
FIG. 16E is a diagram showing a control effect achieved by a microphone 10-9 for a control point, in the laboratory of the sound field control apparatus in Embodiment 1.
Figure 16F:
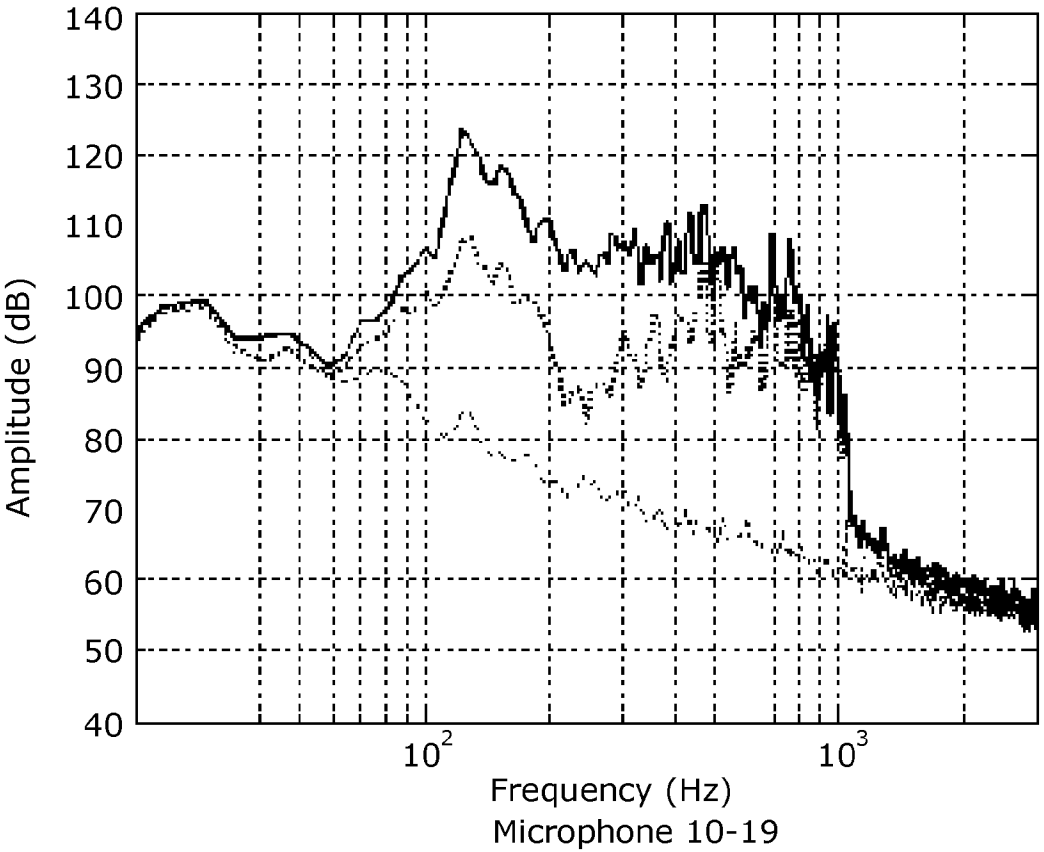
FIG. 16F is a diagram showing a control effect achieved by a microphone 10-19 for a control point, in the laboratory of the sound field control apparatus in Embodiment 1.
Figure 16G:
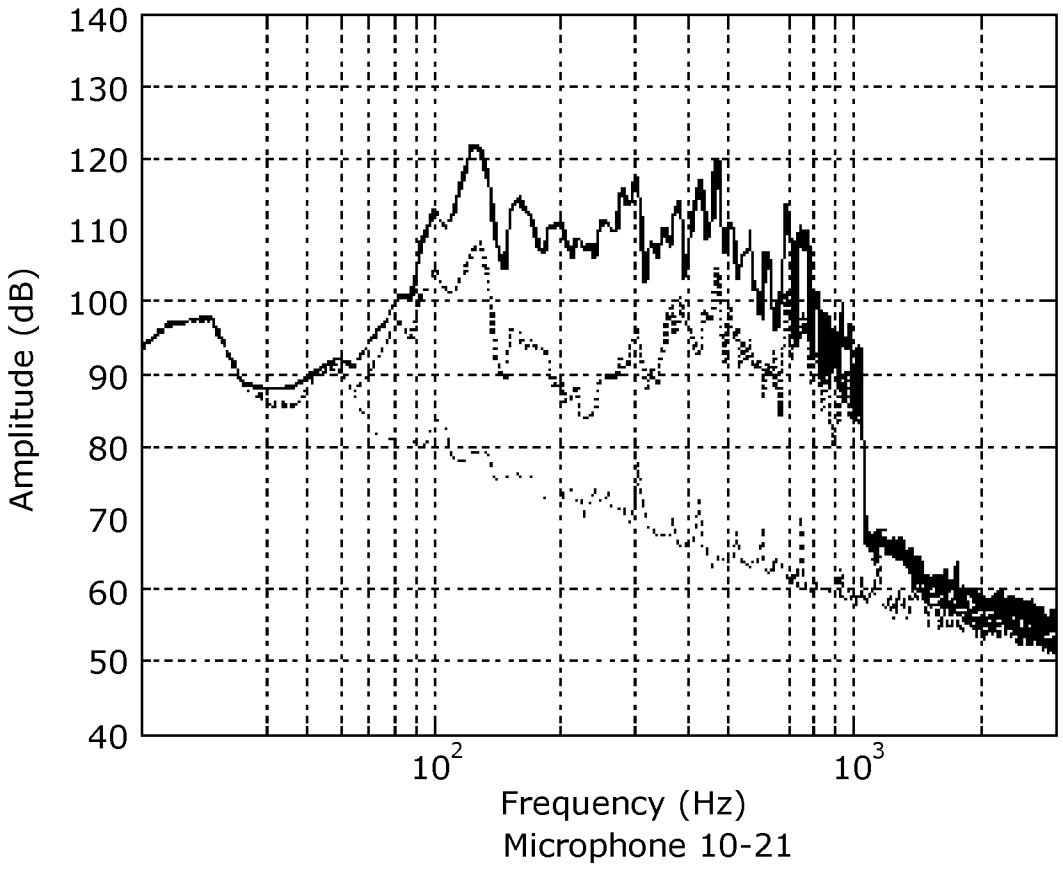
FIG. 16G is a diagram showing a control effect achieved by a microphone 10-21 for a control point, in the laboratory of the sound field control apparatus in Embodiment 1.
Figure 16H:
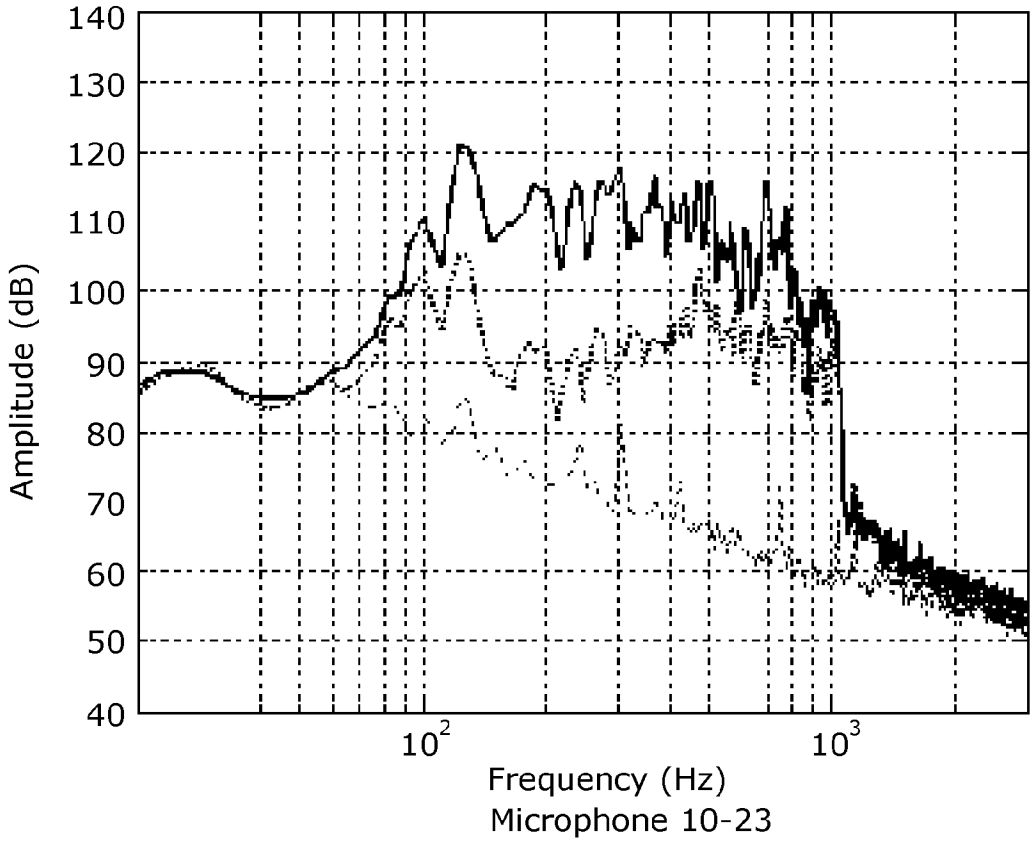
FIG. 16H is a diagram showing a control effect achieved by a microphone 10-23 for a control point, in the laboratory of the sound field control apparatus in Embodiment 1.
Figure 16I:
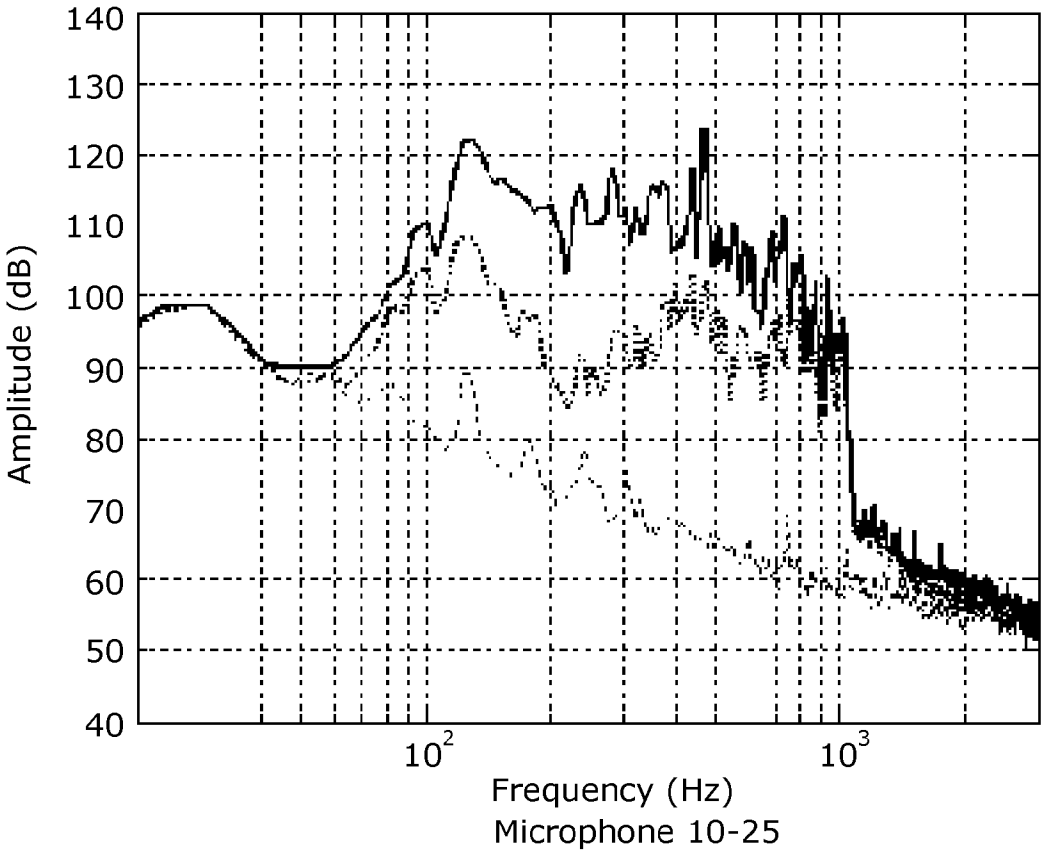
FIG. 16I is a diagram showing a control effect achieved by a microphone 10-25 for a control point, in the laboratory of the sound field control apparatus in Embodiment 1.
Figure 16J:
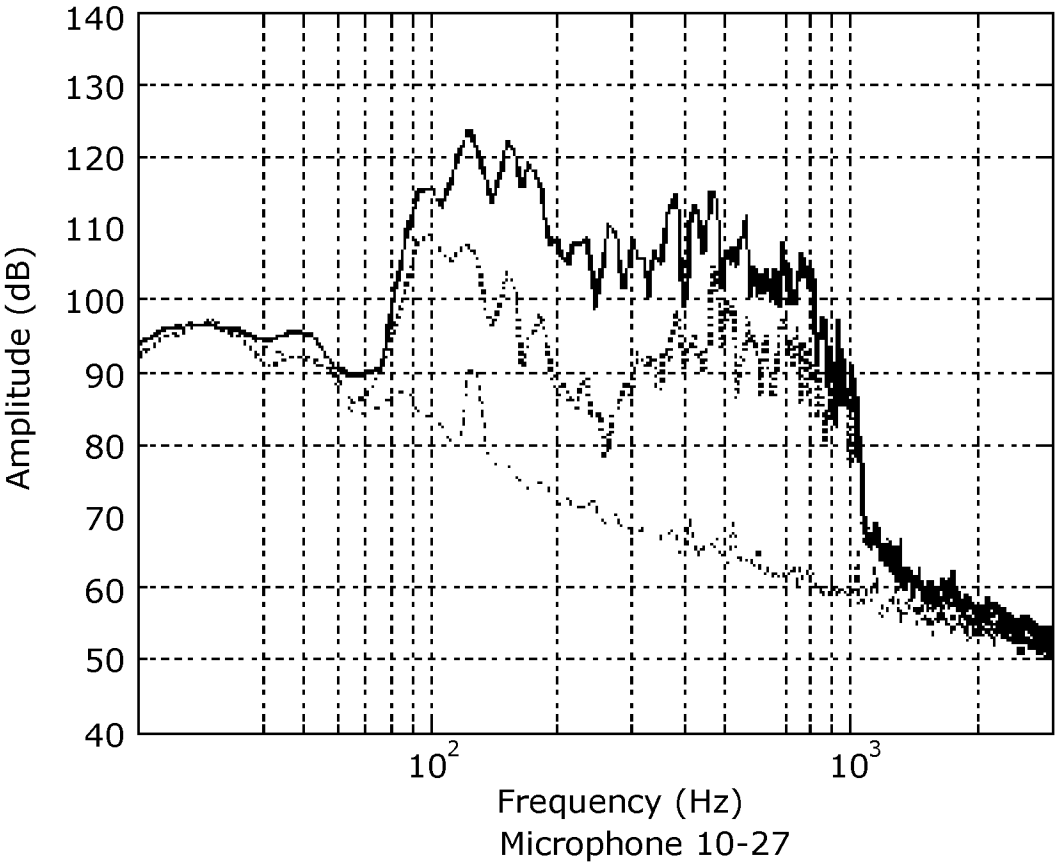
FIG. 16J is a diagram showing a control effect achieved by a microphone 10-27 for a control point, in the laboratory of the sound field control apparatus in Embodiment 1.
Figure 16K:
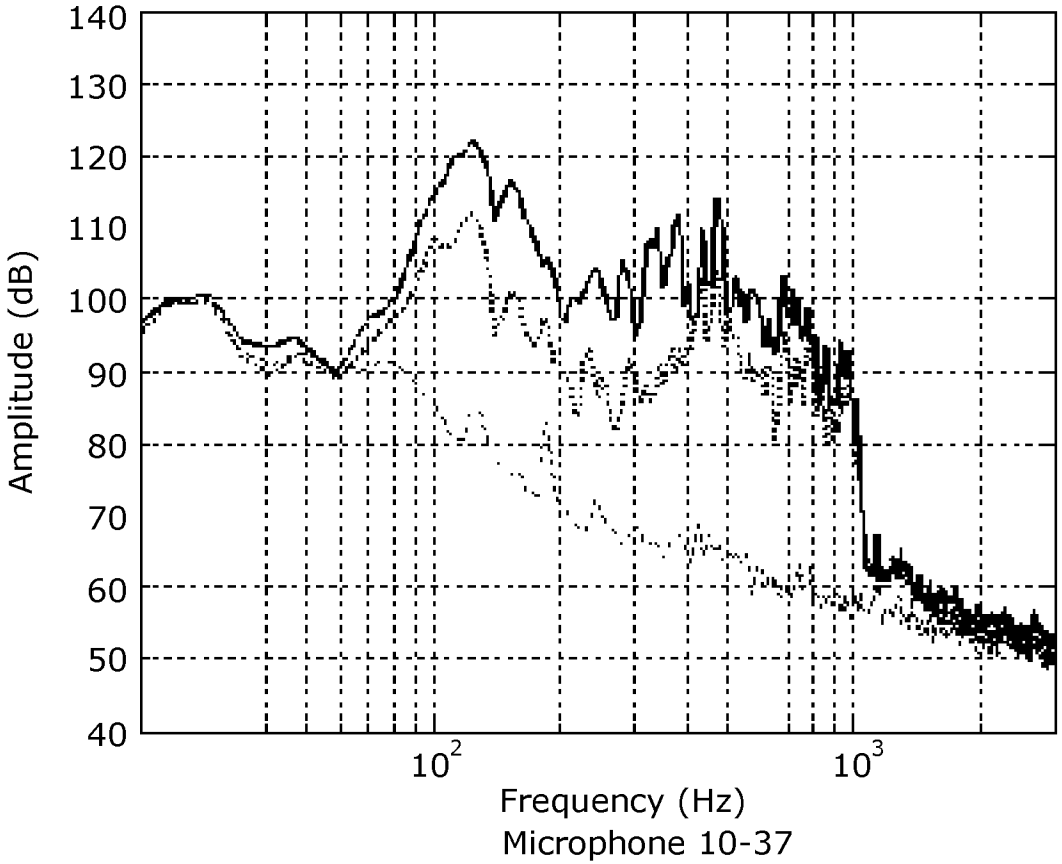
FIG. 16K is a diagram showing a control effect achieved by a microphone 10-37 for a control point, in the laboratory of the sound field control apparatus in Embodiment 1.
Figure 16L:
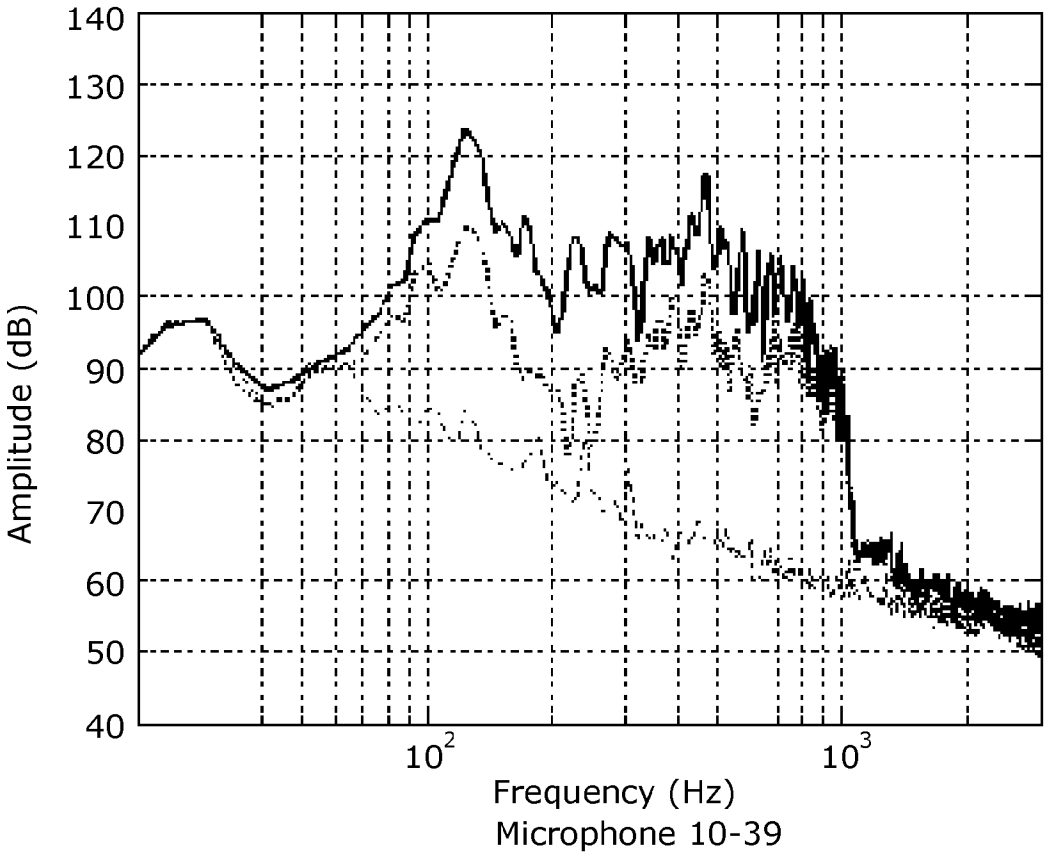
FIG. 16L is a diagram showing a control effect achieved by a microphone 10-39 for a control point, in the laboratory of the sound field control apparatus in Embodiment 1.
Figure 16M:
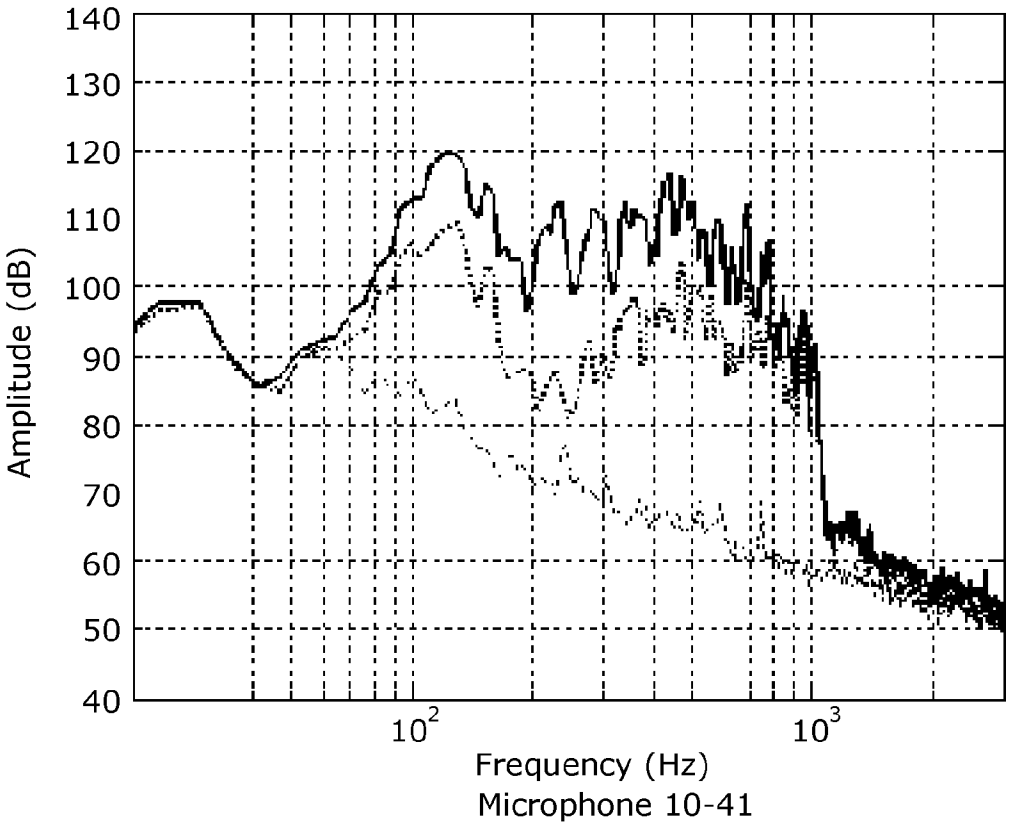
FIG. 16M is a diagram showing a control effect achieved by a microphone 10-41 for a control point, in the laboratory of the sound field control apparatus in Embodiment 1.
Figure 16N:
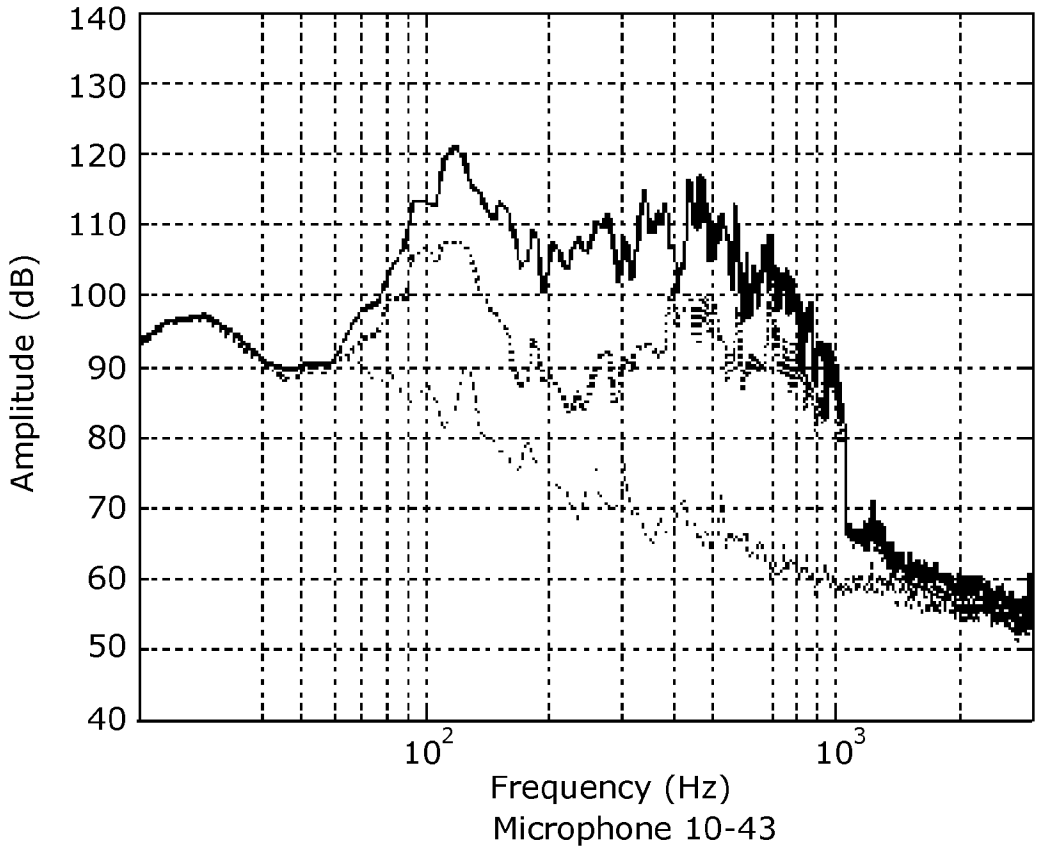
FIG. 16N is a diagram showing a control effect achieved by a microphone 10-43 for a control point, in the laboratory of the sound field control apparatus in Embodiment 1.
Figure 16O:
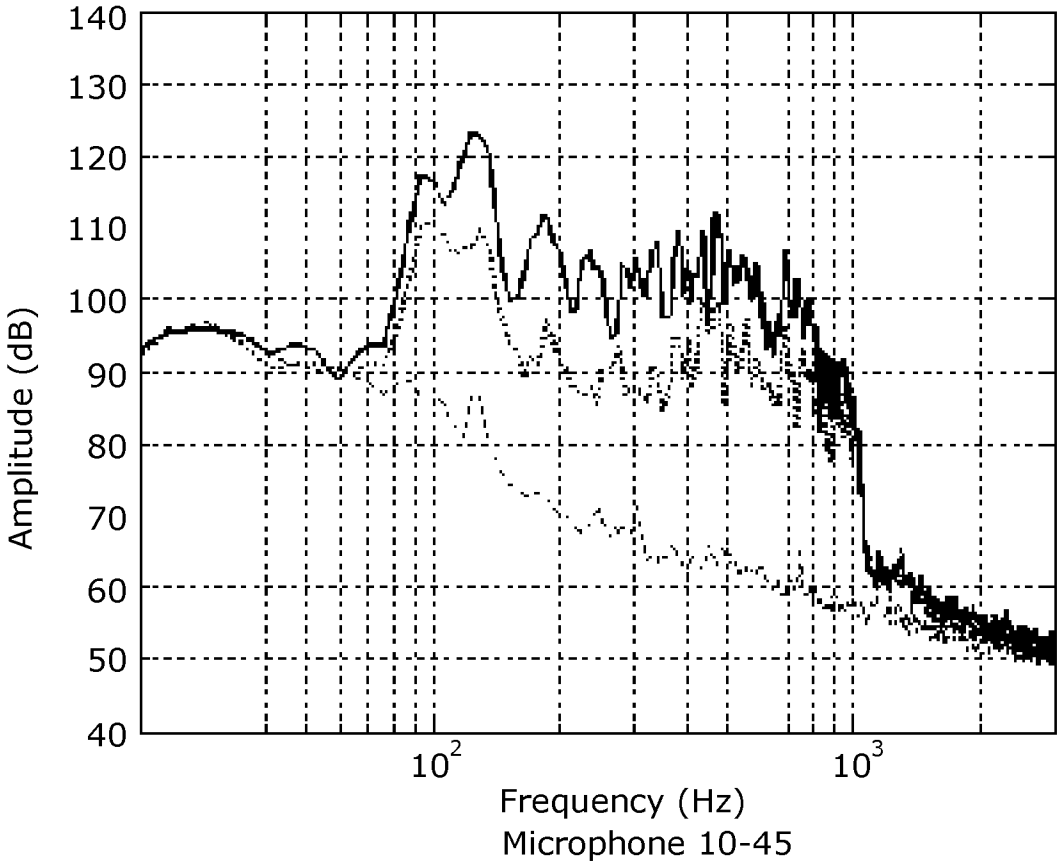
FIG. 16O is a diagram showing a control effect achieved by a microphone 10-45 for a control point, in the laboratory of the sound field control apparatus in Embodiment 1.

FIG. 16A to FIG. 16O show the effects achieved at the control points when the input signal from the sound source 100 is reproduced simultaneously by the eight speakers 8-1 to 8-8. In each of the diagrams, the thick solid line indicates a characteristic of "control-OFF" and the thick dotted line indicates a characteristic of "control-ON". To be more specific, a difference between the control-OFF characteristic and the control-ON characteristic is the reduction effect. In the case of control-OFF (the thick solid line), the reproduced sounds are not outputted from the speakers 7-1 to 7-50 and are outputted from the speakers 8-1 to 8-8. In the case of control-ON (the thick dotted line), the reproduced sounds are outputted from the speakers 7-1 to 7-50 and the speakers 8-1 to 8-8. Here, since it is redundant to show the effects of all the 45 control points, FIG. 16A to FIG. 16O show the effects of every other microphones such as the microphones 10-1 and 10-3. More specifically, the effects of only the microphones that are assigned odd numbers for "*" of "10-*" are shown. Moreover, the microphone 10-* is the control point positioned on the boundary surface and, thus, FIG. 16P shows the effect of the microphone 12 as, so to speak, a representative point in the quiet area 202 shown in FIG. 9.

Firstly, in FIG. 16A to FIG. 16O, the reduction effect of 10 dB to 20 dB is achieved at around 120 Hz to 500 Hz, and the reduction effect of 5 dB to 10 dB is also achieved at 120 Hz and lower and at 500 Hz to 1000 Hz. Here, the thin dotted line indicates background noise, and it can be seen that a sufficient signal-to-noise (S/N) is assured at least at 100 Hz to 1000 Hz.

Figure 16P:
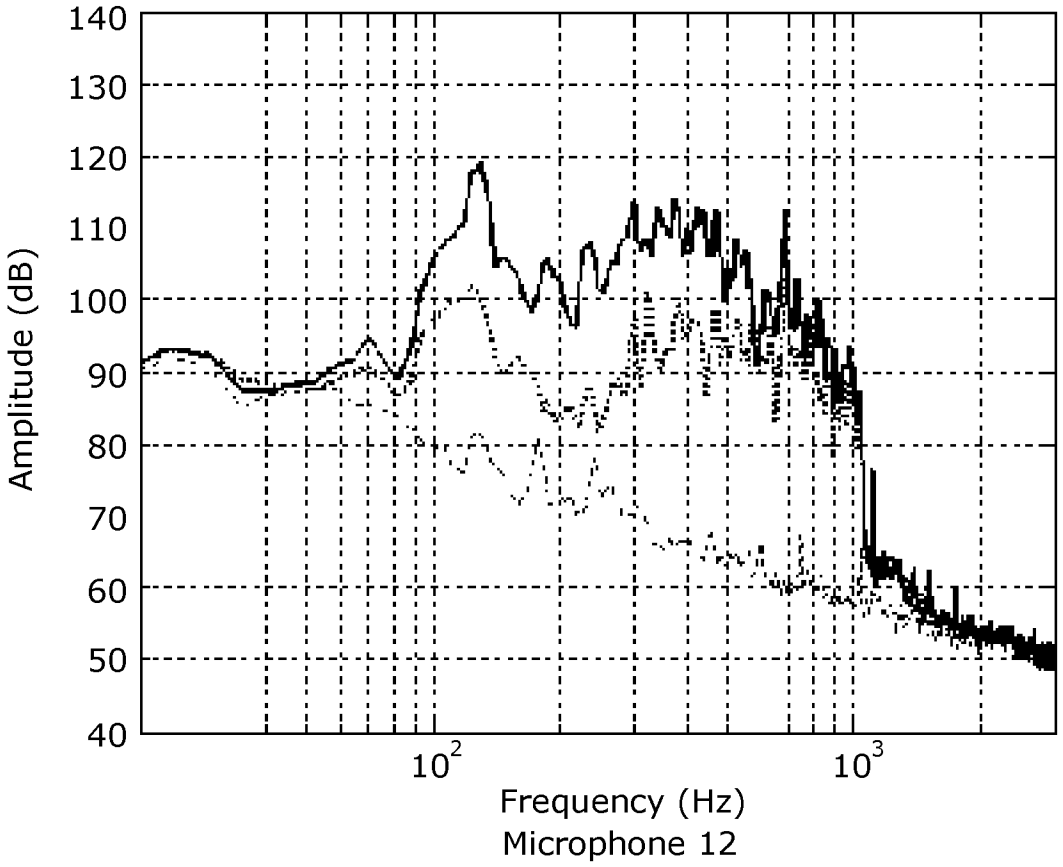
FIG. 16P is a diagram showing a control effect achieved by a microphone 12 used for evaluation, in the laboratory of the sound field control apparatus in Embodiment 1.
Figure 17A:
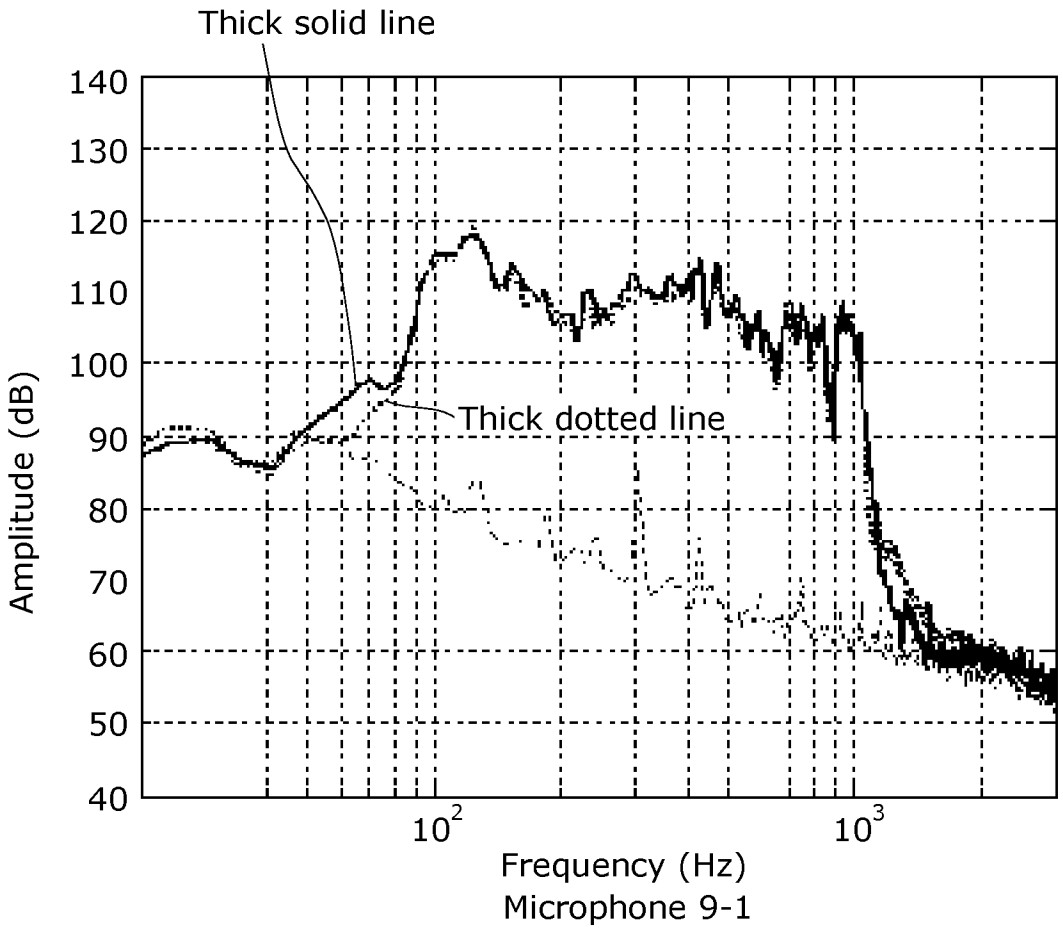
FIG. 17A is a diagram showing a control effect achieved by a microphone 9-1 for a listening point, in the laboratory of the sound field control apparatus in Embodiment 1.
Figure 17B:
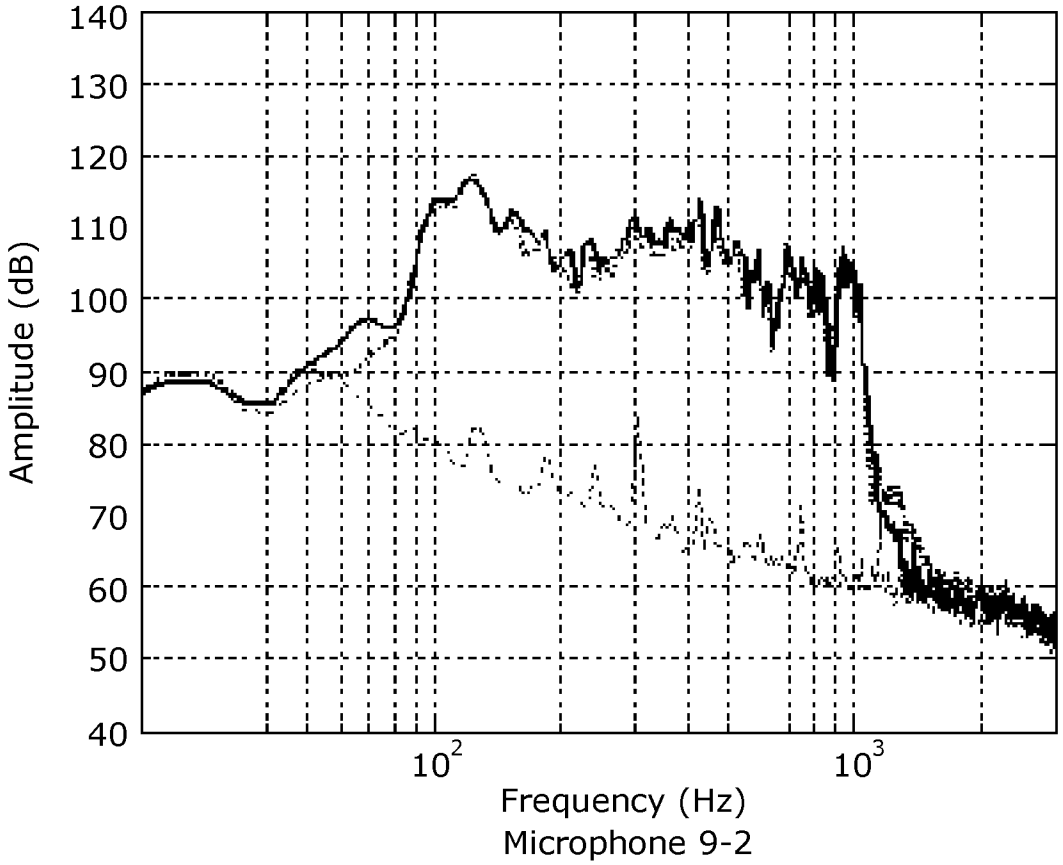
FIG. 17B is a diagram showing a control effect achieved by a microphone 9-2 for a listening point, in the laboratory of the sound field control apparatus in Embodiment 1.
Figure 17C:
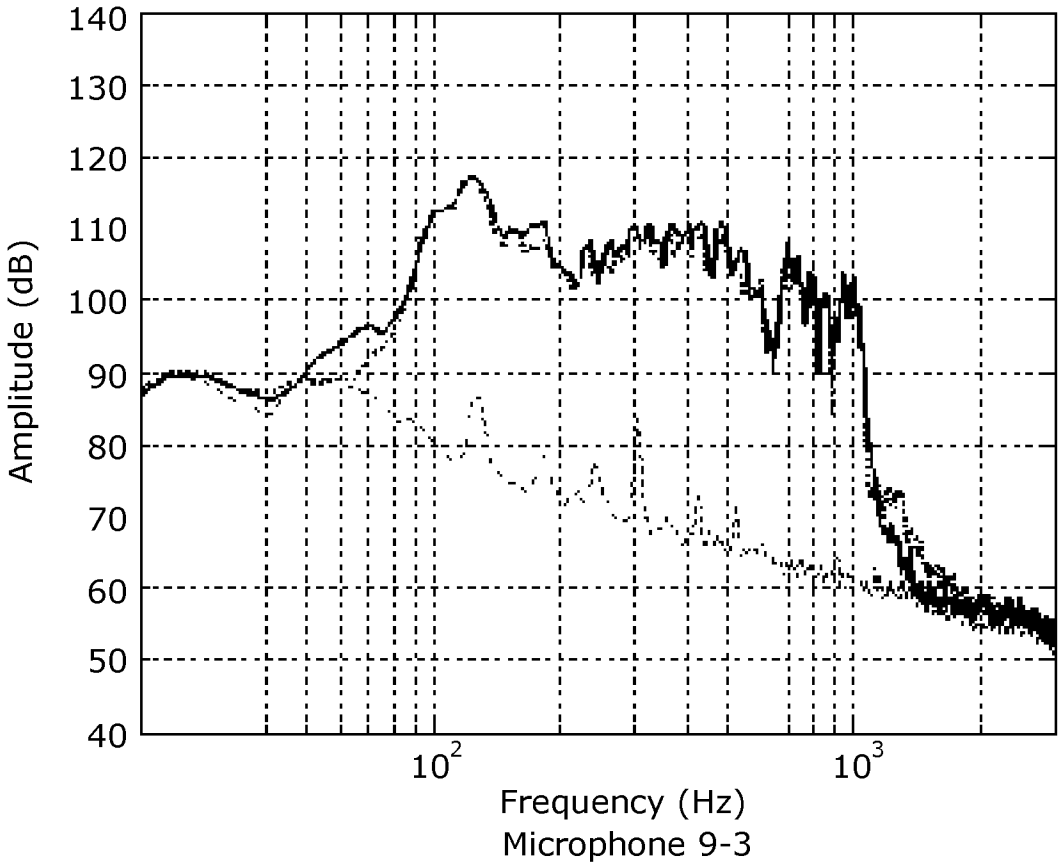
FIG. 17C is a diagram showing a control effect achieved by a microphone 9-3 for a listening point, in the laboratory of the sound field control apparatus in Embodiment 1.
Figure 17D:
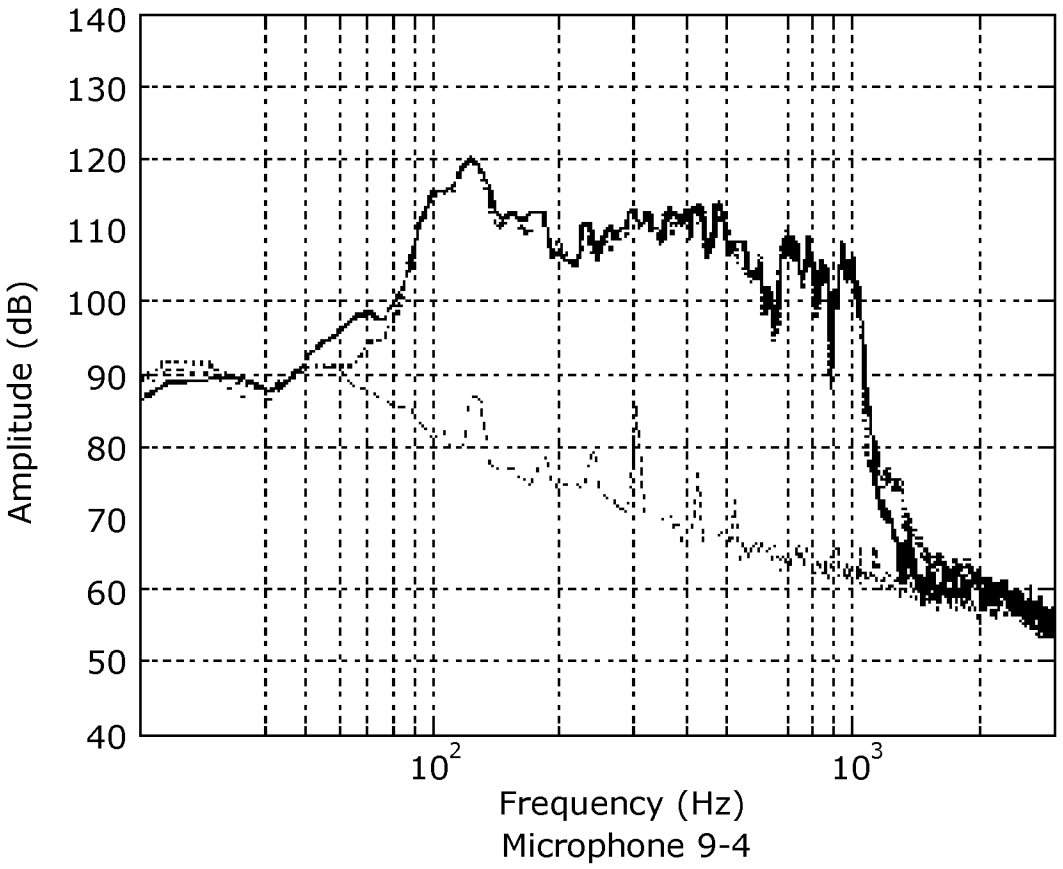
FIG. 17D is a diagram showing a control effect achieved by a microphone 9-4 for a listening point, in the laboratory of the sound field control apparatus in Embodiment 1.
Figure 17E:
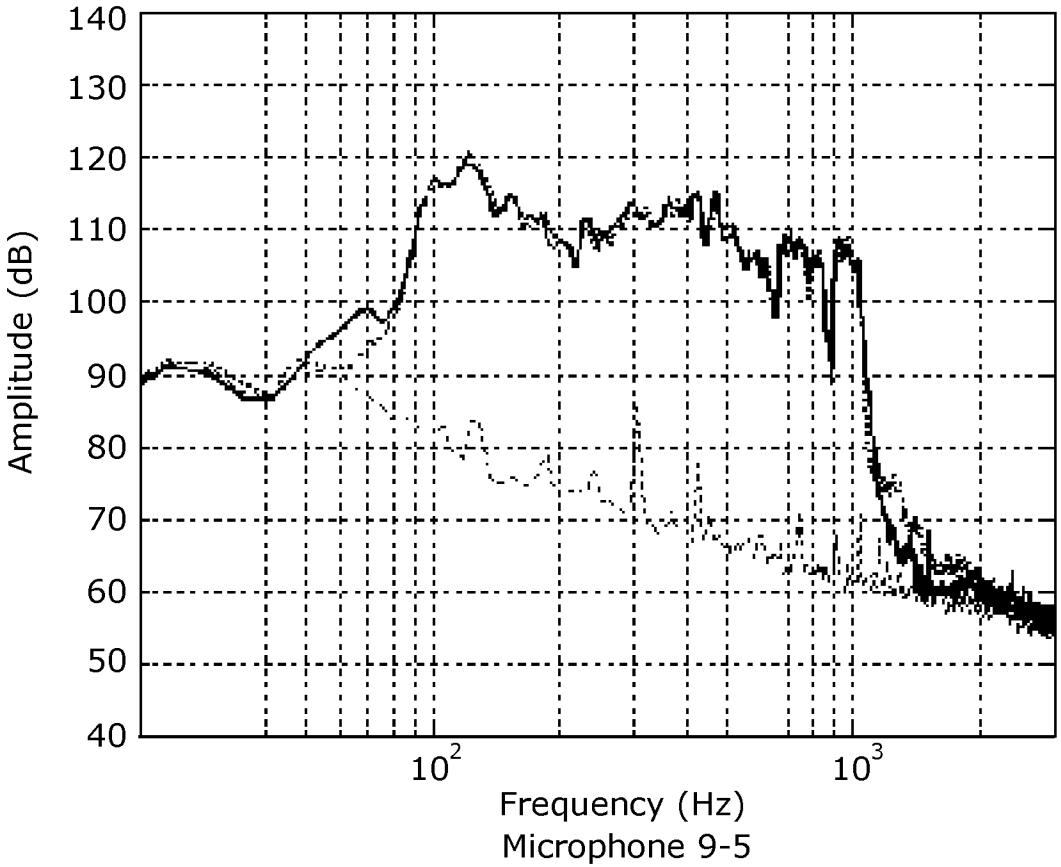
FIG. 17E is a diagram showing a control effect achieved by a microphone 9-5 for a listening point, in the laboratory of the sound field control apparatus in Embodiment 1.
Figure 17F:
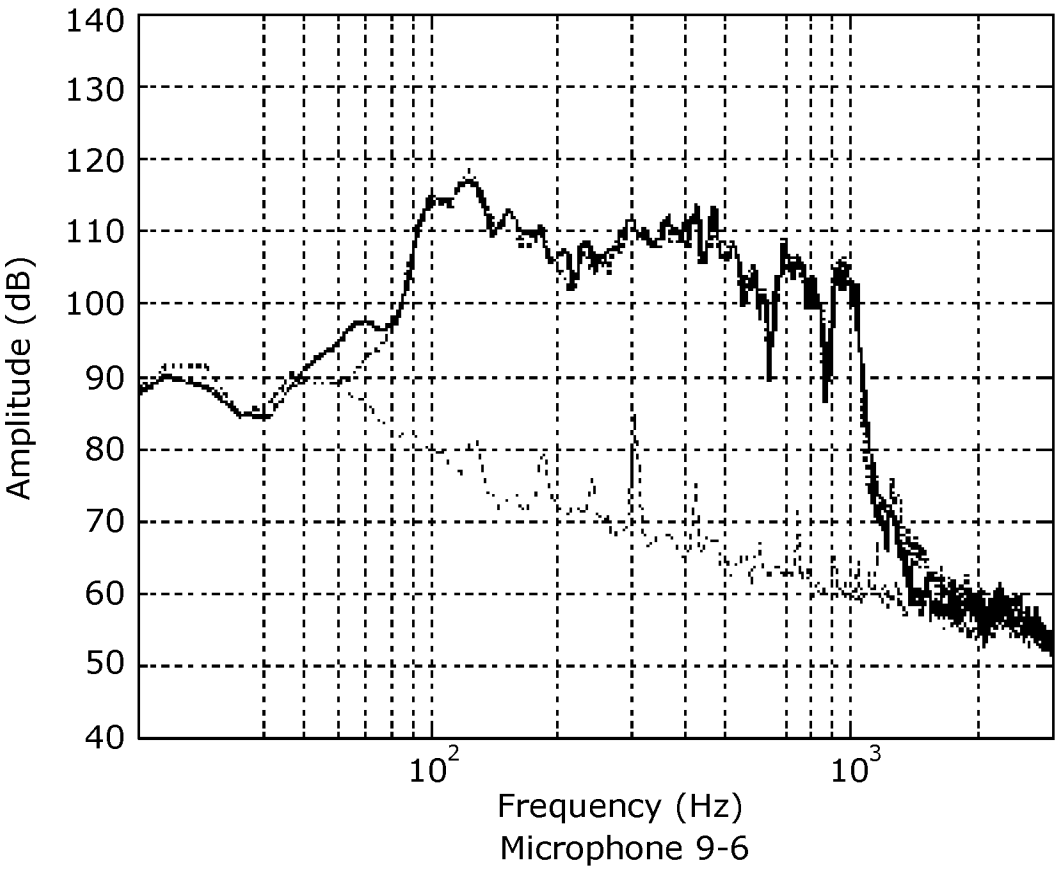
FIG. 17F is a diagram showing a control effect achieved by a microphone 9-6 for a listening point, in the laboratory of the sound field control apparatus in Embodiment 1.
Figure 17G:
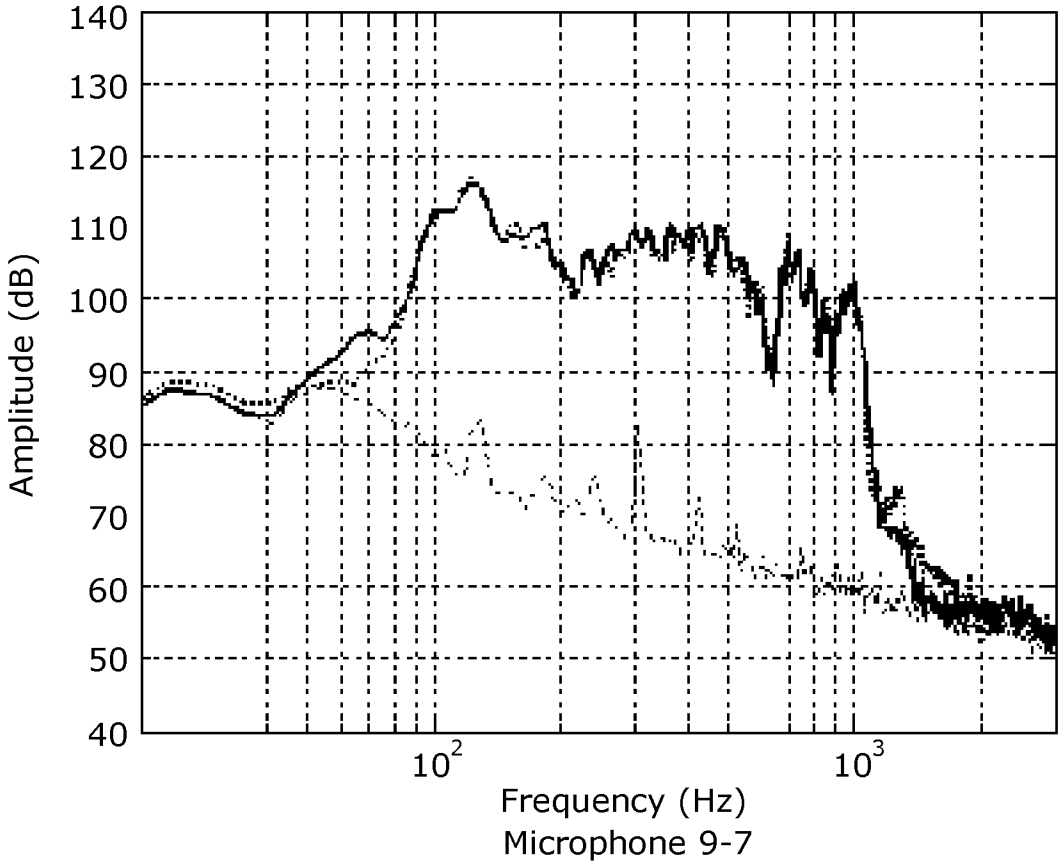
FIG. 17G is a diagram showing a control effect achieved by a microphone 9-7 for a listening point, in the laboratory of the sound field control apparatus in Embodiment 1.
Figure 17H:
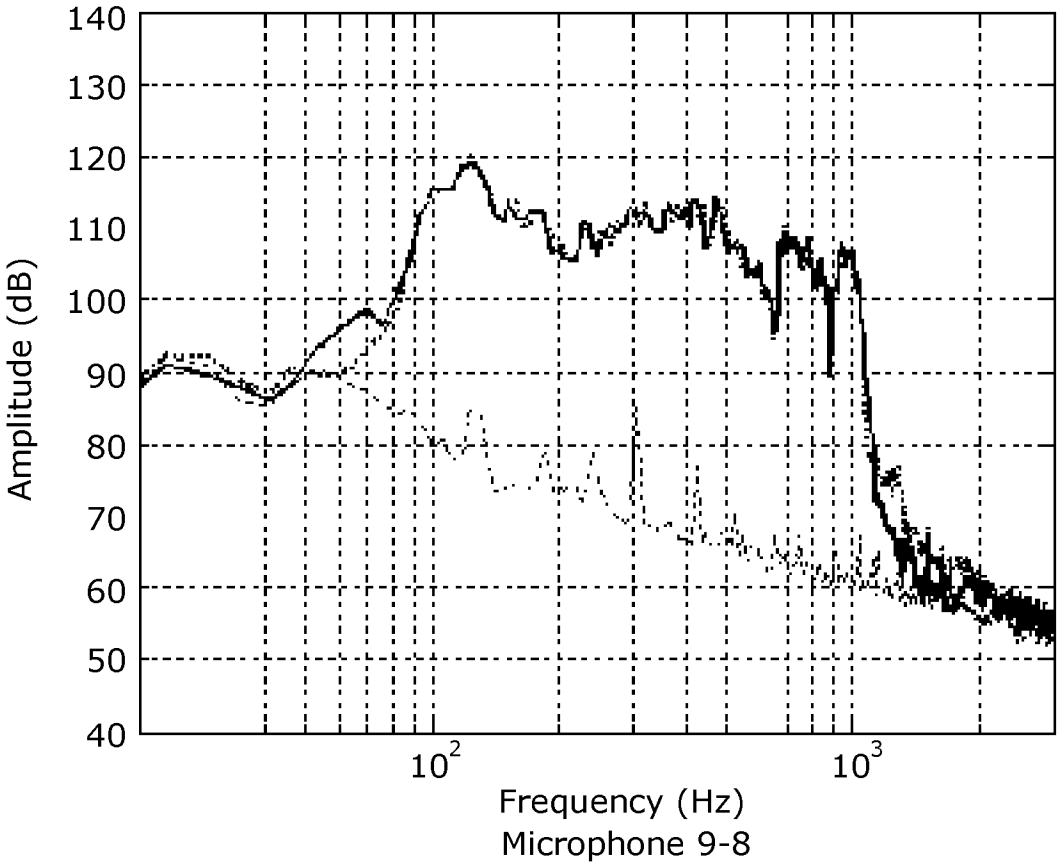
FIG. 17H is a diagram showing a control effect achieved by a microphone 9-8 for a listening point, in the laboratory of the sound field control apparatus in Embodiment 1.

Next, as shown in FIG. 16P, the reduction effect similar to that of the control point is achieved by the evaluation microphone 12 that is not positioned at the control point. To be more specific, behind the boundary surface on which the microphones 10-1 to 10-45 are positioned as in FIG. 10 and FIG. 11 (that is, the quiet area 202 shown in FIG. 9), it can be seen that the reduction effect approximately similar to that of the control point is achieved.

As described thus far, the reproduced sounds from the speakers 8-1 to 8-8 can be reduced in the quiet area 202 of the laboratory 300. This can be physically sensed in actual trial listening. Even when freely moving around in the quiet area 202, the listener can sense the same effect as described above.

FIG. 17A to FIG. 17H show the control effects for recreating the target acoustic characteristics at the listening points while control is being performed for the aforementioned control points 10-1 to 10-45. In each of the diagrams, the thick solid line indicates the characteristic of control-OFF (where the reproduced sound is outputted only by the speaker 60), and the thick dotted line indicates the characteristic of control-ON (where no reproduced sound is outputted from the speaker 60 and the reproduced sounds are outputted from the speakers 7-1 to 7-50 and the speakers 8-1 to 8-8). More specifically, the object here is to bring about agreement between the control-OFF characteristic (the thick solid line) and the control-ON characteristic (the thick dotted line). It can be clearly seen from FIG. 17A to FIG. 17H that the control-OFF characteristic and the control-ON characteristic generally agree with each other (with error being within 1 dB to 3 dB), except at 80 Hz and lower or 1200 Hz and higher where the S/N ratio decreases.

Next, FIG. 18A to FIG. 18H show the control effects achieved by the evaluation microphones 11-1 to 11-8 when the target acoustic characteristics are recreated at the listening points 9-1 to 9-8 while control is being performed for the aforementioned control points 10-1 to 10-45. Here, note that the reproduced sound is outputted only by the speaker 60 in the case of control-OFF having the characteristic indicated by the thick solid line. Note also that the thin solid line indicates the characteristic of control-ON.

Figure 18A:
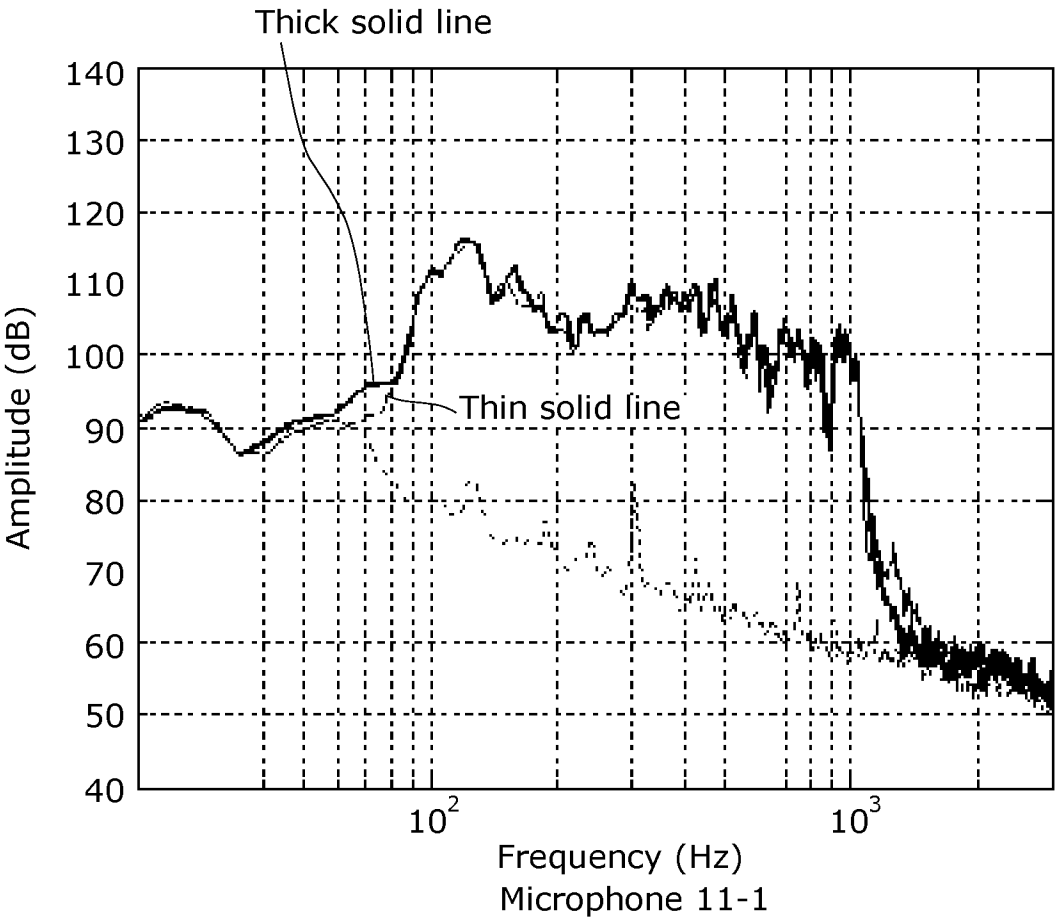
FIG. 18A is a diagram showing a control effect achieved by a microphone 11-1 used for evaluation, in the laboratory of the sound field control apparatus in Embodiment 1.
Figure 18B:
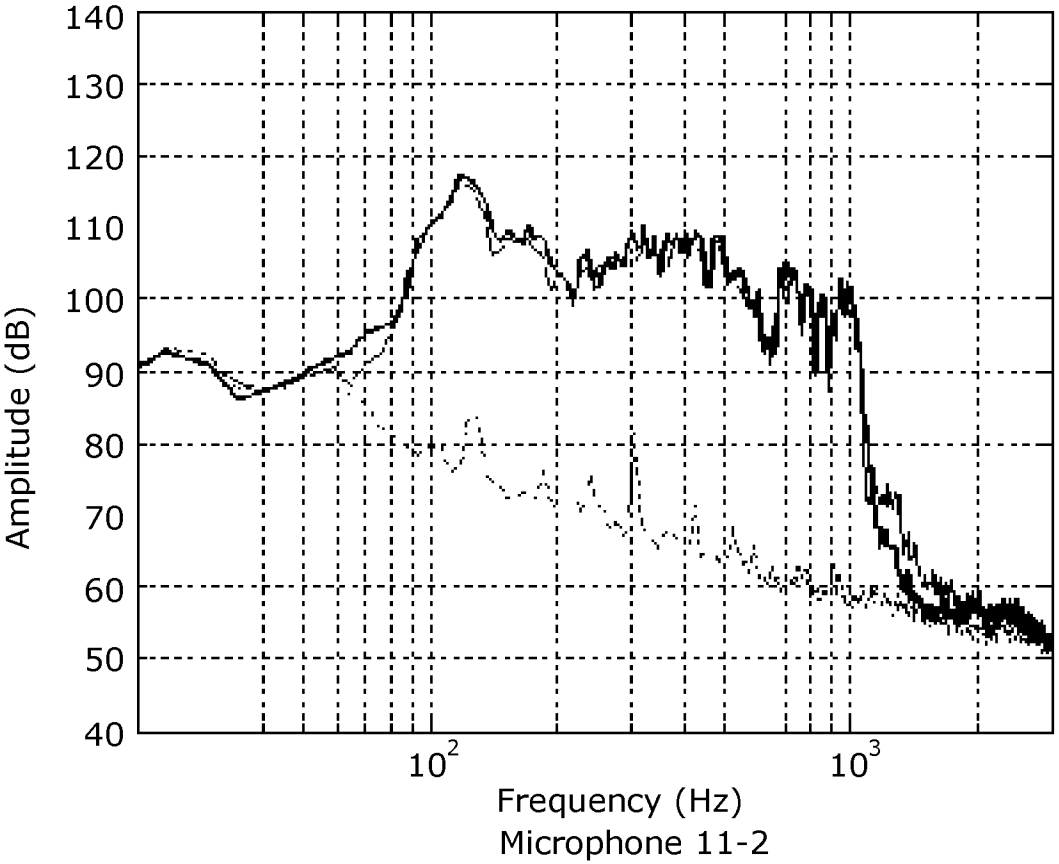
FIG. 18B is a diagram showing a control effect achieved by a microphone 11-2 used for evaluation, in the laboratory of the sound field control apparatus in Embodiment 1.
Figure 18C:
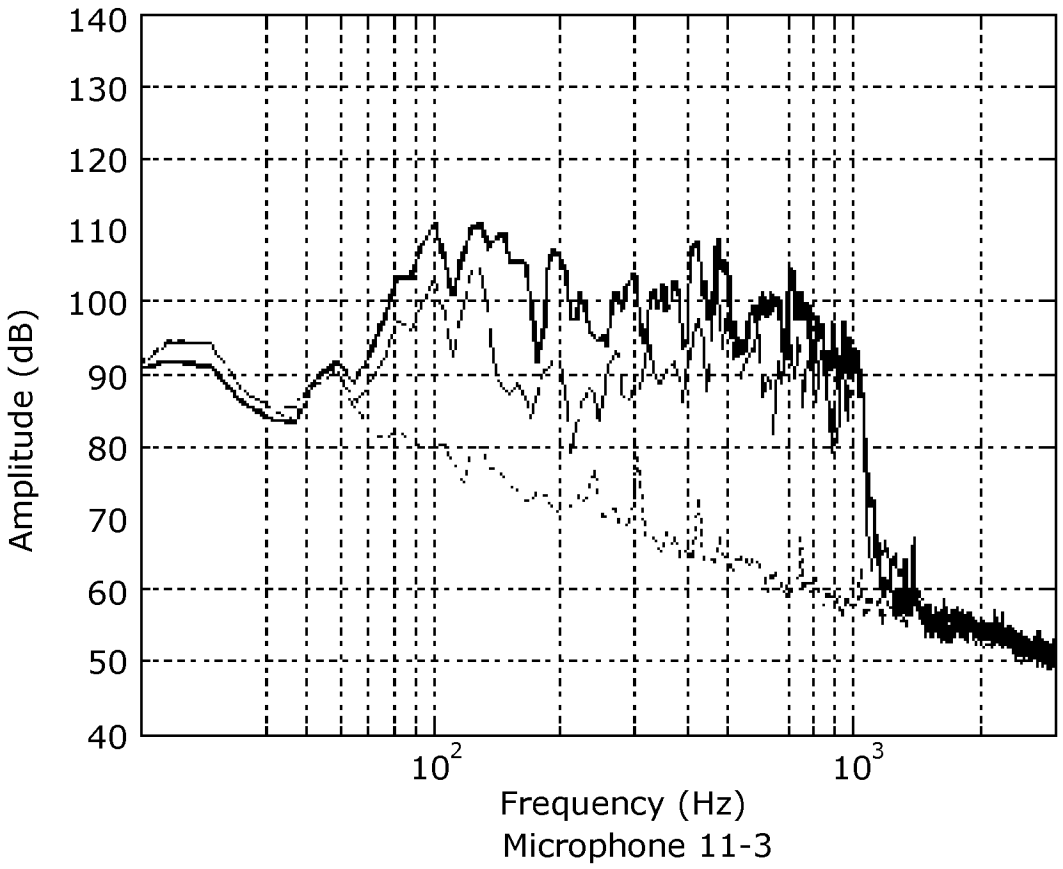
FIG. 18C is a diagram showing a control effect achieved by a microphone 11-3 used for evaluation, in the laboratory of the sound field control apparatus in Embodiment 1.
Figure 18D:
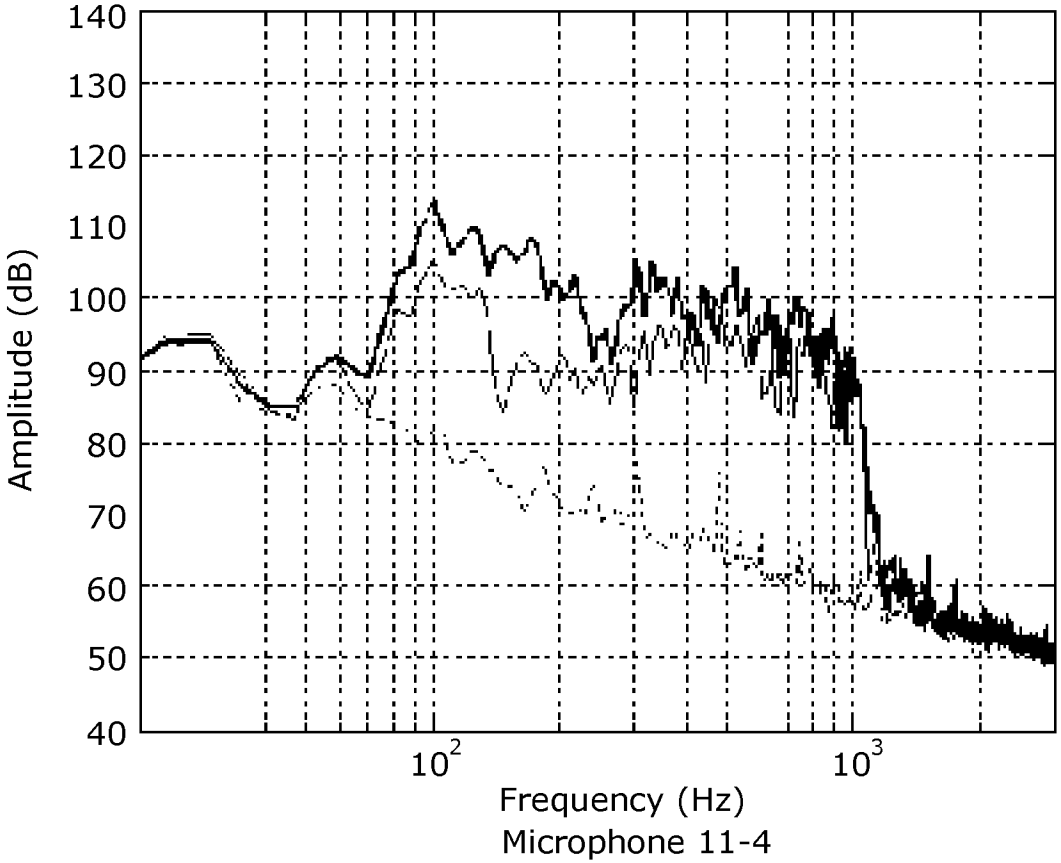
FIG. 18D is a diagram showing a control effect achieved by a microphone 11-4 used for evaluation, in the laboratory of the sound field control apparatus in Embodiment 1.
Figure 18E:
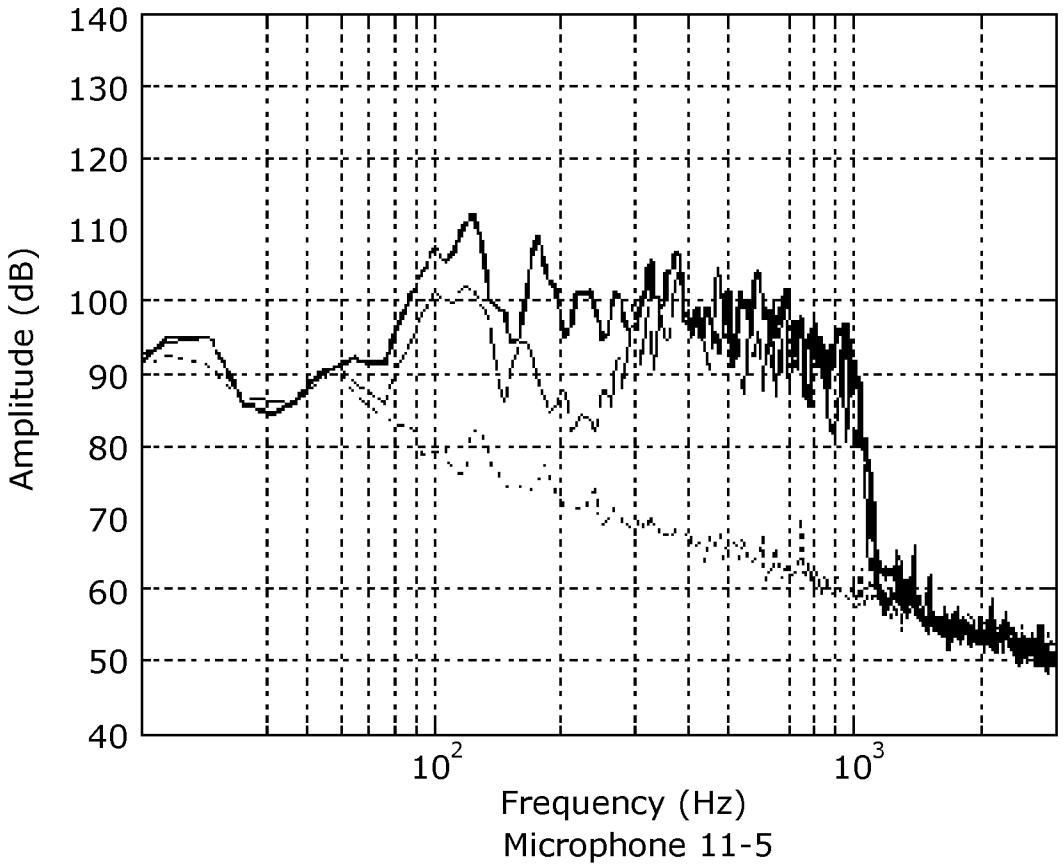
FIG. 18E is a diagram showing a control effect achieved by a microphone 11-5 used for evaluation, in the laboratory of the sound field control apparatus in Embodiment 1.
Figure 18F:
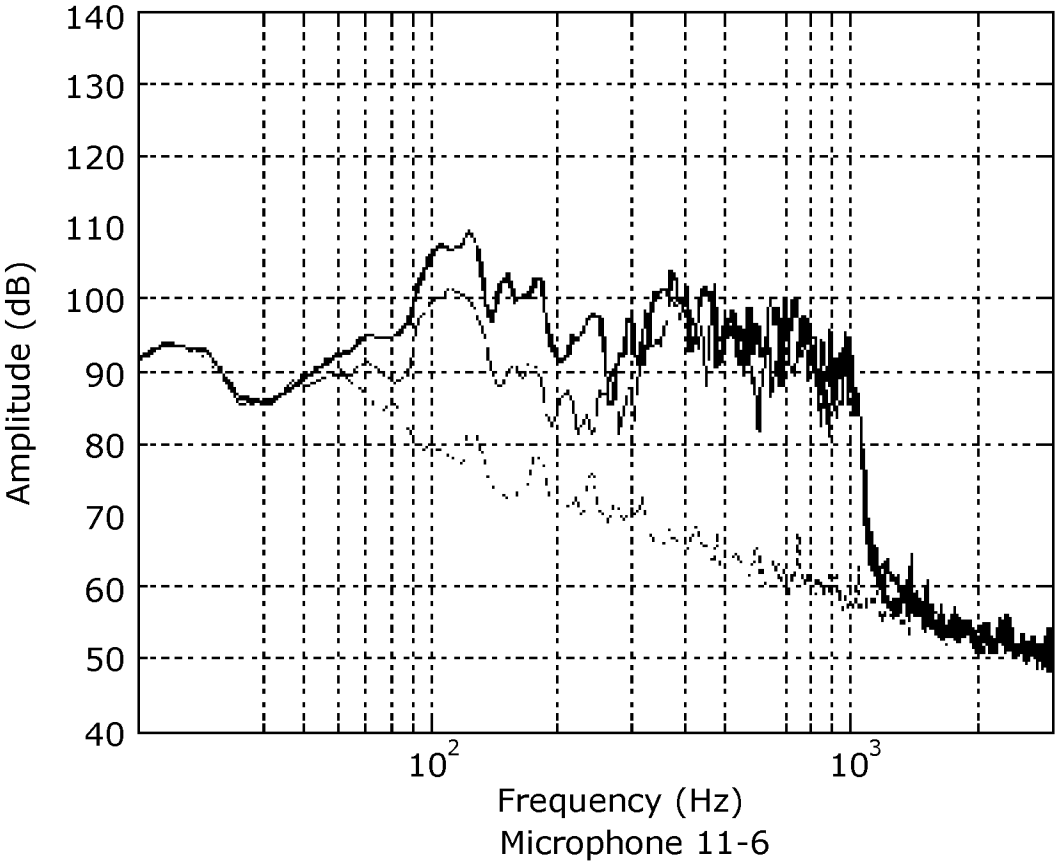
FIG. 18F is a diagram showing a control effect achieved by a microphone 11-6 used for evaluation, in the laboratory of the sound field control apparatus in Embodiment 1.
Figure 18G:
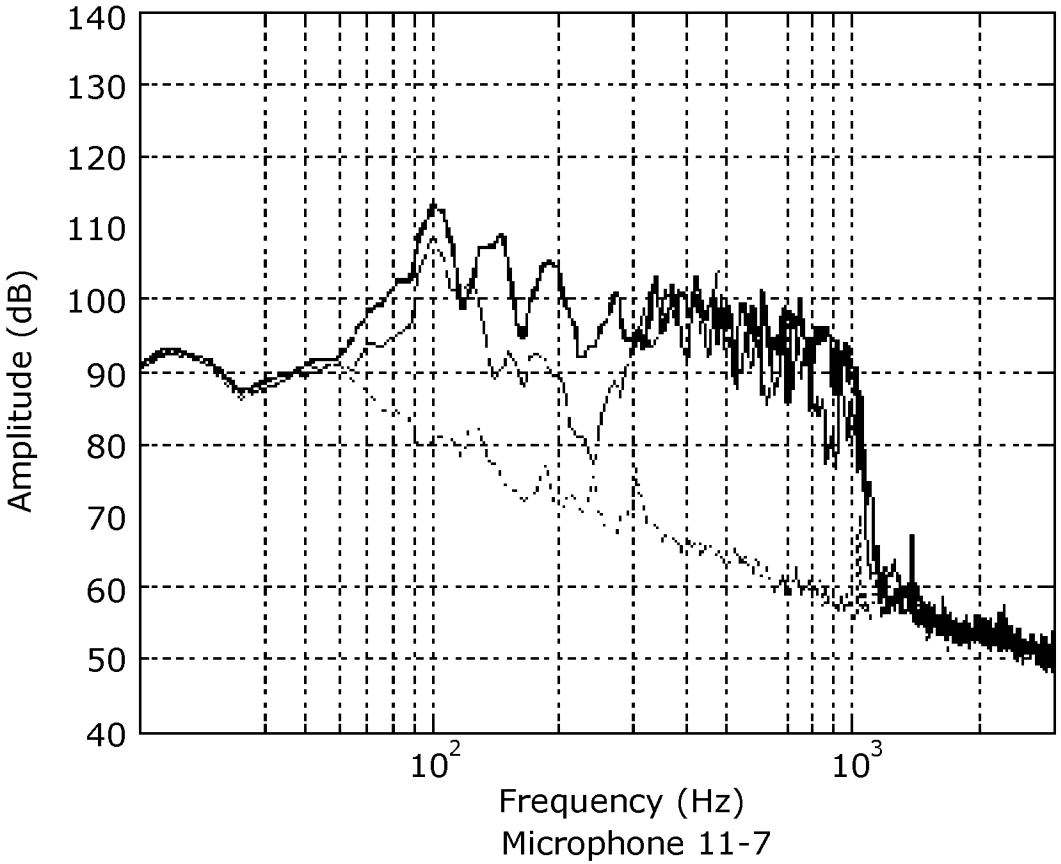
FIG. 18G is a diagram showing a control effect achieved by a microphone 11-7 used for evaluation, in the laboratory of the sound field control apparatus in Embodiment 1.
Figure 18H:
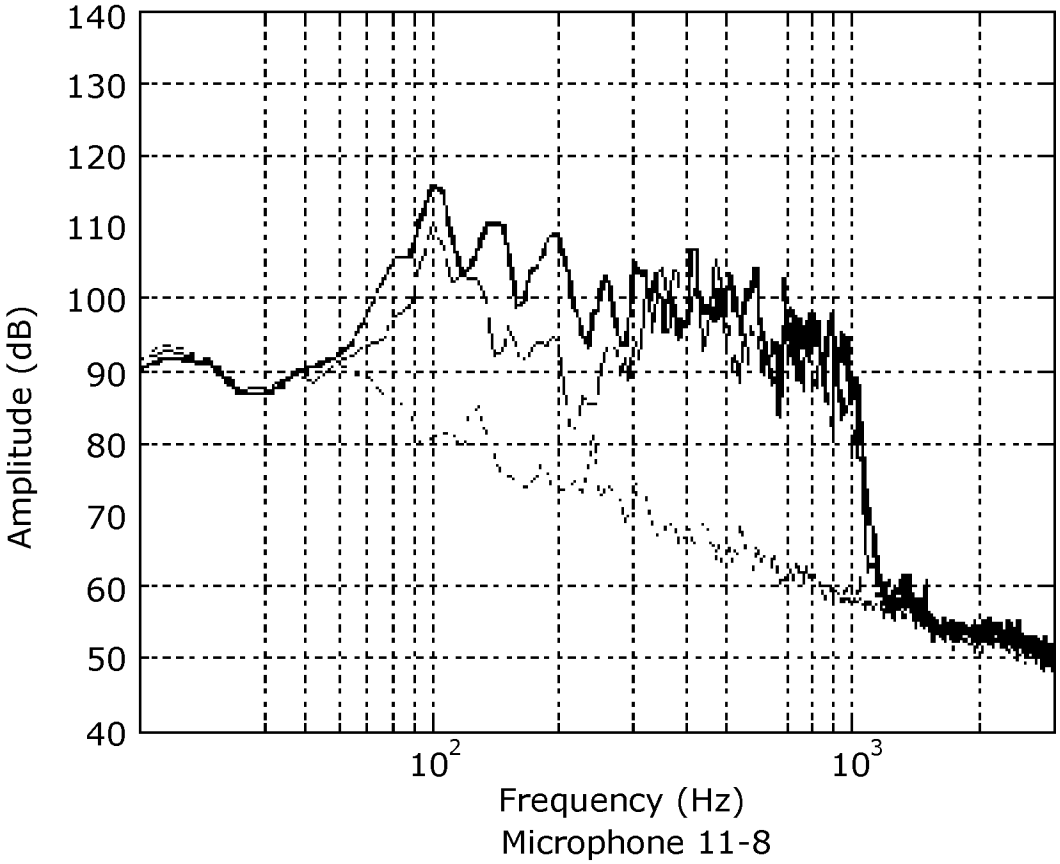
FIG. 18H is a diagram showing a control effect achieved by a microphone 11-8 used for evaluation, in the laboratory of the sound field control apparatus in Embodiment 1.

It can be seen from FIG. 18A and FIG. 18B that the control-OFF characteristic and the control-ON characteristic agree with each other at the microphones 11-1 and 11-2 and that the reproduced sound from the speaker 60 is recreated in the case of control-ON. As also shown by the results obtained in FIG. 17A to FIG. 17H, in the listening area located around the head of the viewer V surrounded by the microphones 9-1 to 9-8, the viewer V can feel as if the sound were being reproduced by the speaker 60 in the case of control-ON even when the speaker 60 does not actually exist.

On the other hand, as can be seen from FIG. 18C to FIG. 18H, the level in the case of control-ON can be reduced lower than the level in the case of control-OFF (i.e., the level of the sound reproduced only by the speaker 60). The microphone 11-3 near the control point achieves the reduction effect of 10 dB to 20 dB at around 120 Hz to 500 Hz, and the reduction effect of 5 dB to 10 dB at 120 Hz and lower and 500 Hz to 1000 Hz. Although the reduction effect decreases at 300 Hz and higher with distance from the control point, the reduction effect of at least 5 dB to 10 dB is obtained at 300 Hz and lower. The effect decreases at 300 Hz and higher because the spacings adjacent to the control point 10-* are too large to control the frequencies at 300 Hz and higher. In order to improve this, the spacings may be reduced. However, in accordance with the reduced spacings, the number of microphones and the number of speakers understandably increases. On this account, the optimum condition needs to be found in consideration of the increased arithmetic operations, the size of the quiet area, and the highest limit of the frequency band to be controlled.

In FIG. 16A to FIG. 16P, the difference between the control-OFF characteristic and the control-ON characteristic, that is, the control effect, is large. The reason for this is that since the sounds are outputted from the eight speakers 8-1 to 8-8 in the case of control-OFF in FIG. 16A to FIG. 16P and the sound is outputted only from the speaker 60 in the case of control-OFF in FIG. 18A to FIG. 18H, the level in the case of control-OFF appears to be reduced. This can be clearly seen from the comparison between FIG. 16H and FIG. 18C.

Incidentally, this experiment resulted in that, while the control is being performed, the viewer U present in the quiet area sensed the sound lower by 10 dB to 20 dB at 100 Hz to 1000 Hz than the sound sensed by the viewer V present in the listening area.

Here, an experiment was carried out using the sound field control apparatus 3000 shown in FIG. 3 that had the same configuration as shown in FIG. 10 to FIG. 12. As a result, the coefficient design unit 3002 could not properly calculate the coefficient of the control filter 3001. More specifically, the calculation performed by the coefficient design unit 3002 did not converge. It is believed that this is because listening compensation and quiet sound which have the different characteristics are tried to be implemented at the same time using only the control filter 3001.

Figure 19:
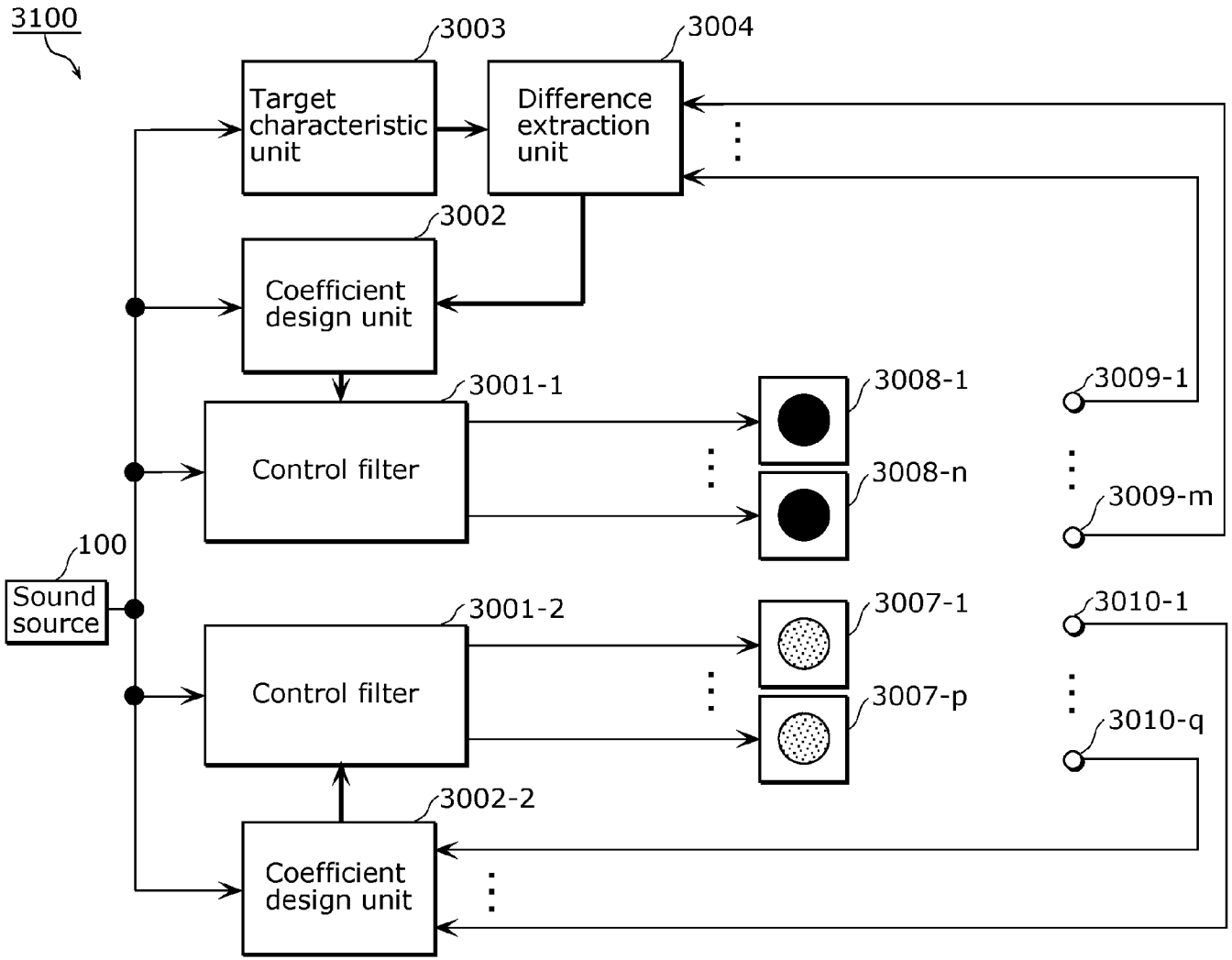
FIG. 19 is a diagram showing a configuration of a sound field control apparatus assumed to be a target for comparison with the sound field control apparatus in Embodiment 1.
Figure 20A:
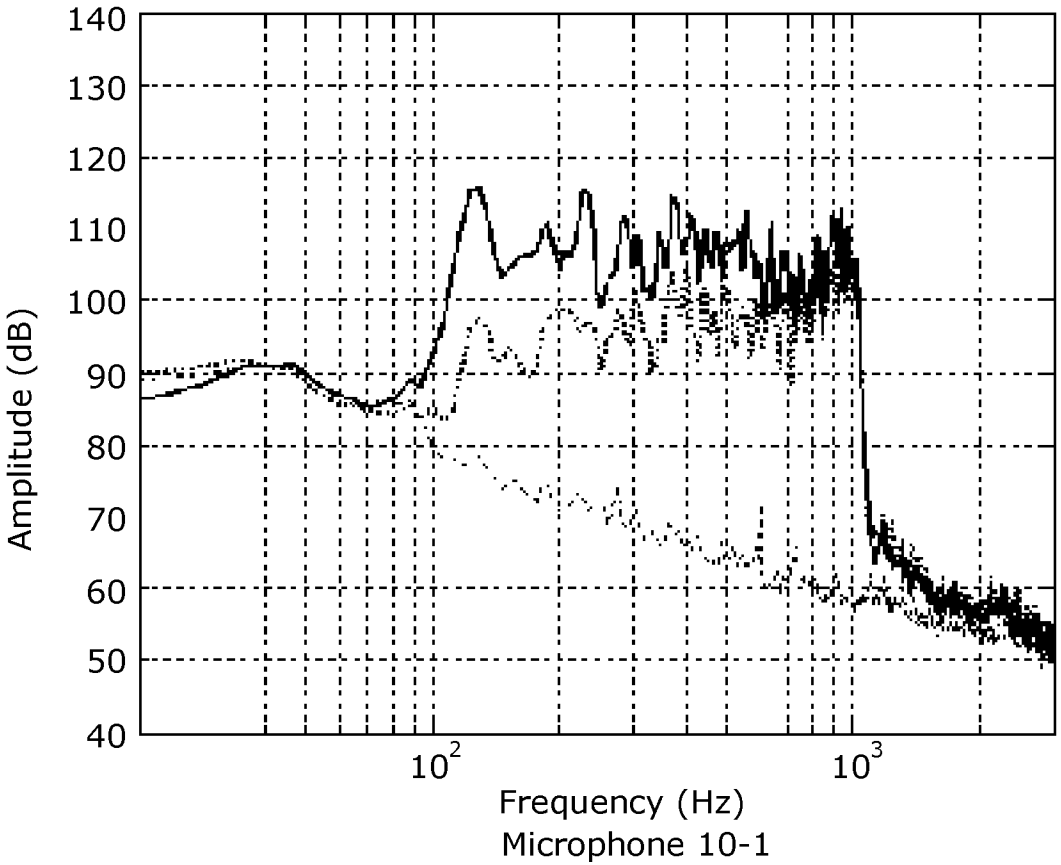
FIG. 20A is a diagram showing a control effect achieved by a microphone 10-1 for a control point, in a laboratory of the comparison-target sound field control apparatus.
Figure 20B:
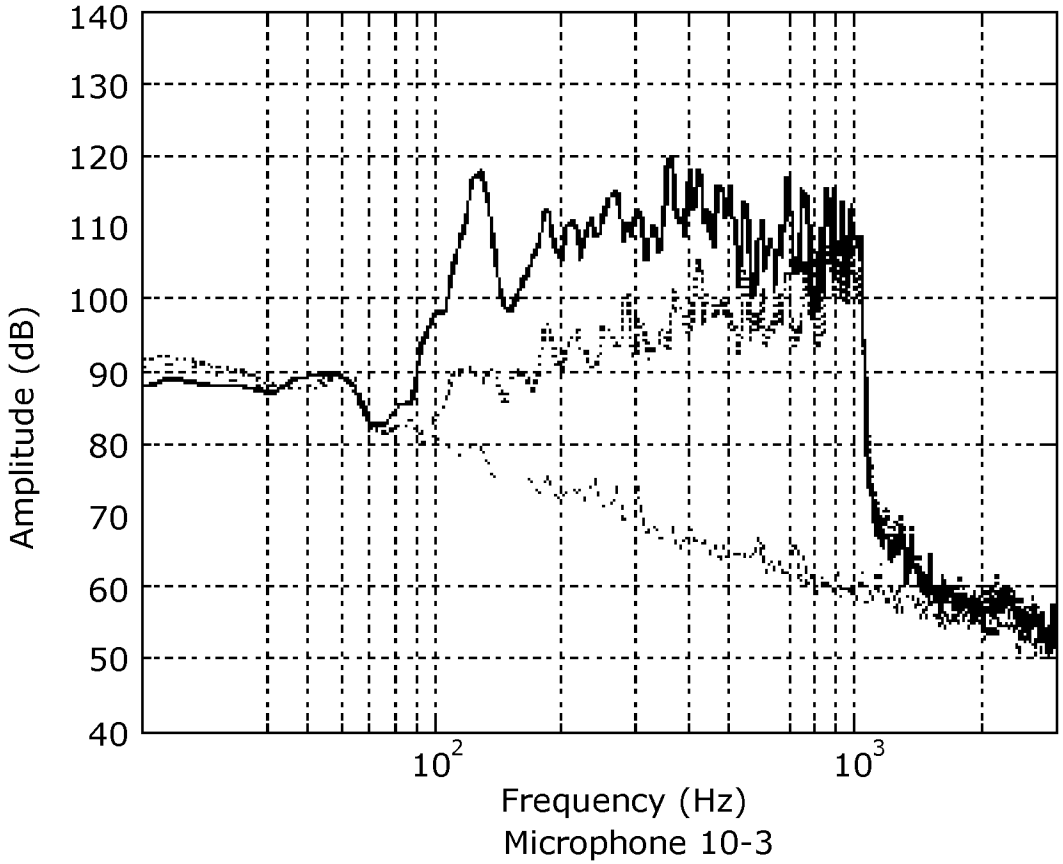
FIG. 20B is a diagram showing a control effect achieved by a microphone 10-3 for a control point, in a laboratory of the comparison-target sound field control apparatus.
Figure 20C:
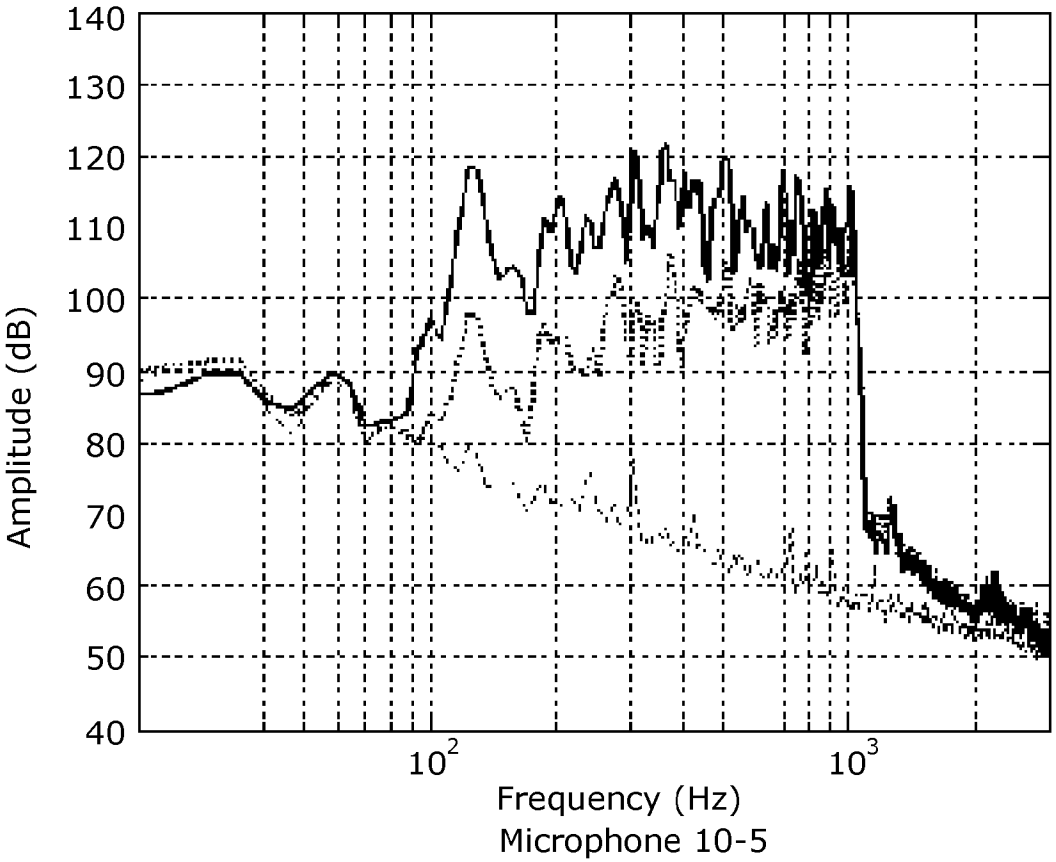
FIG. 20C is a diagram showing a control effect achieved by a microphone 10-5 for a control point, in a laboratory of the comparison-target sound field control apparatus.
Figure 20D:
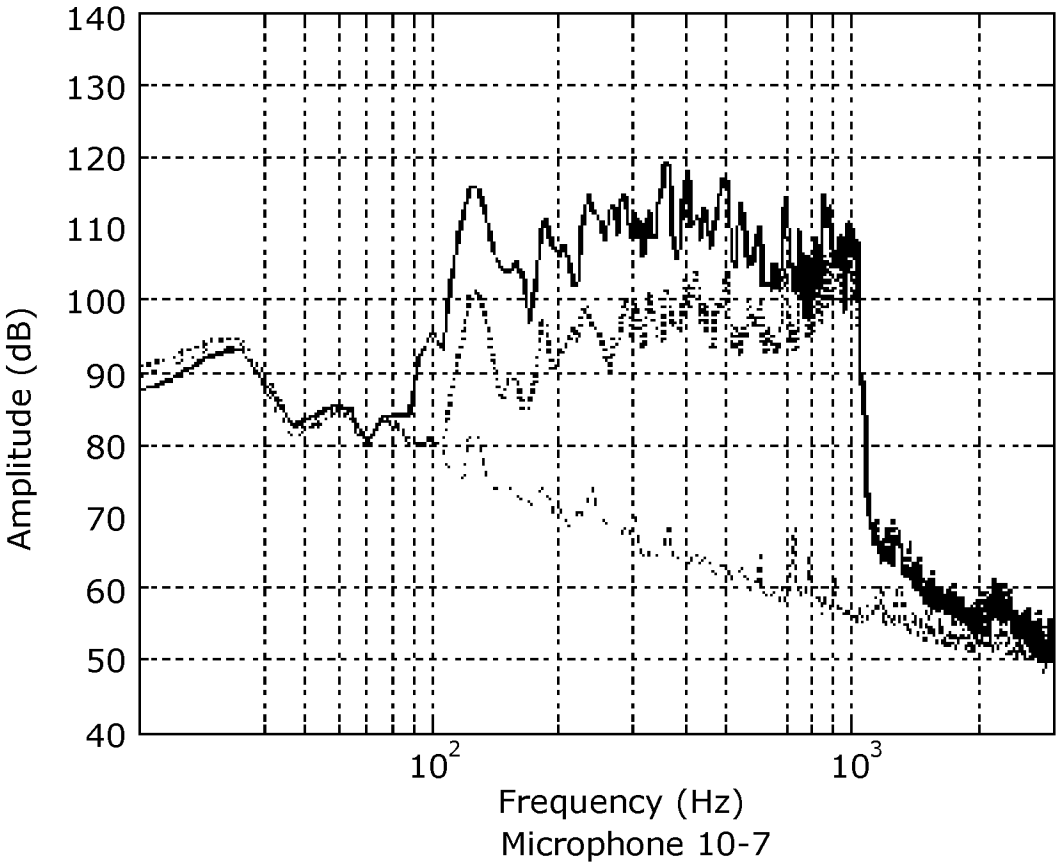
FIG. 20D is a diagram showing a control effect achieved by a microphone 10-7 for a control point, in a laboratory of the comparison-target sound field control apparatus.
Figure 20E:
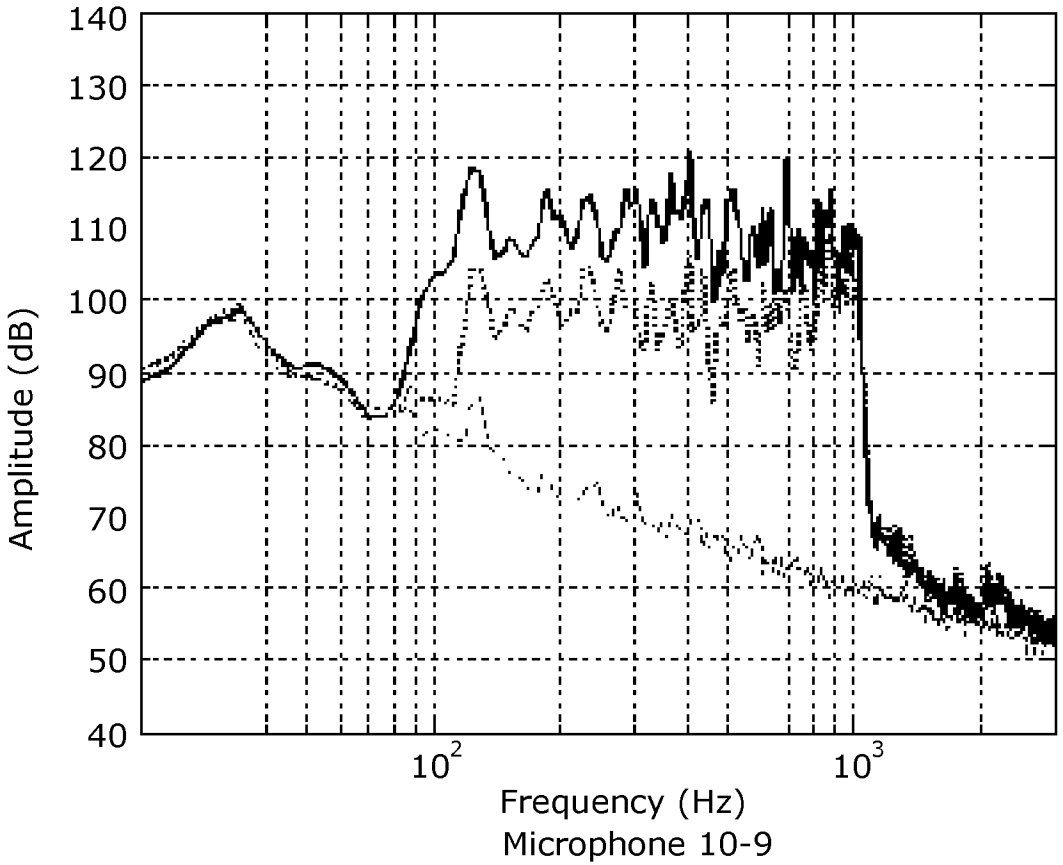
FIG. 20E is a diagram showing a control effect achieved by a microphone 10-9 for a control point, in a laboratory of the comparison-target sound field control apparatus.
Figure 20F:
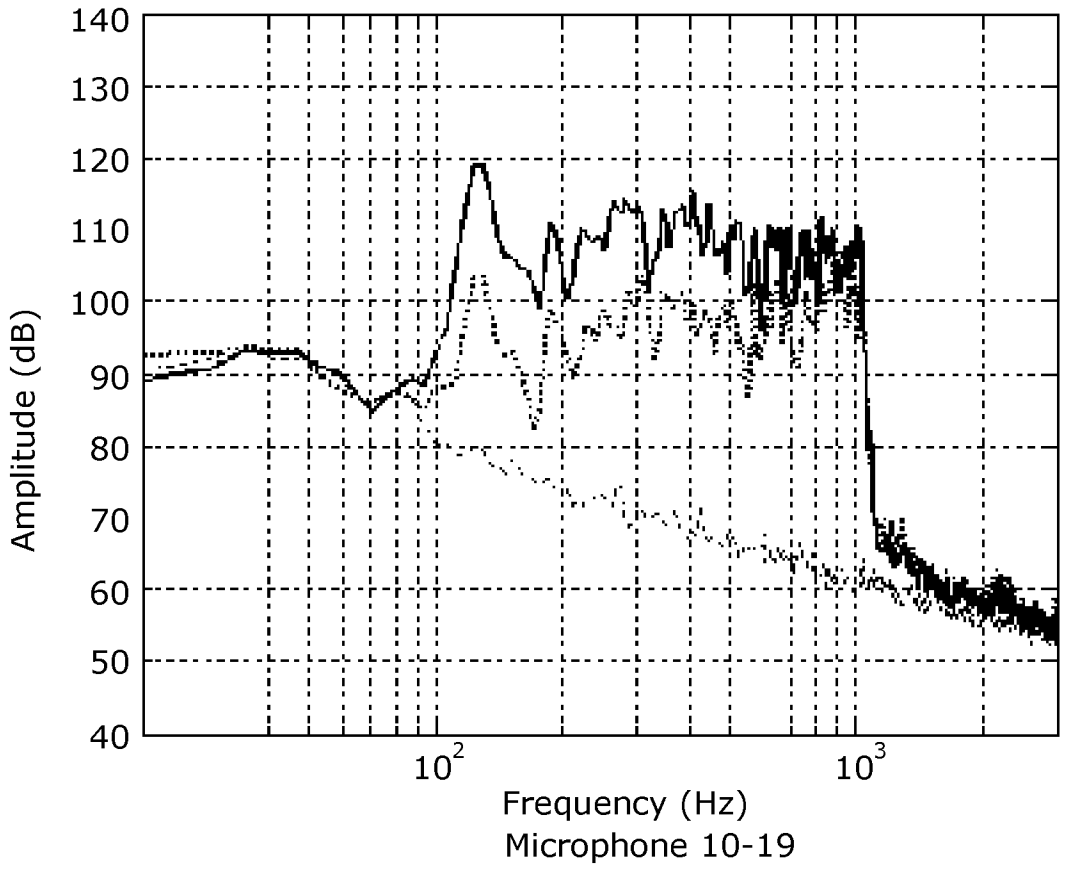
FIG. 20F is a diagram showing a control effect achieved by a microphone 10-19 for a control point, in a laboratory of the comparison-target sound field control apparatus.
Figure 20G:
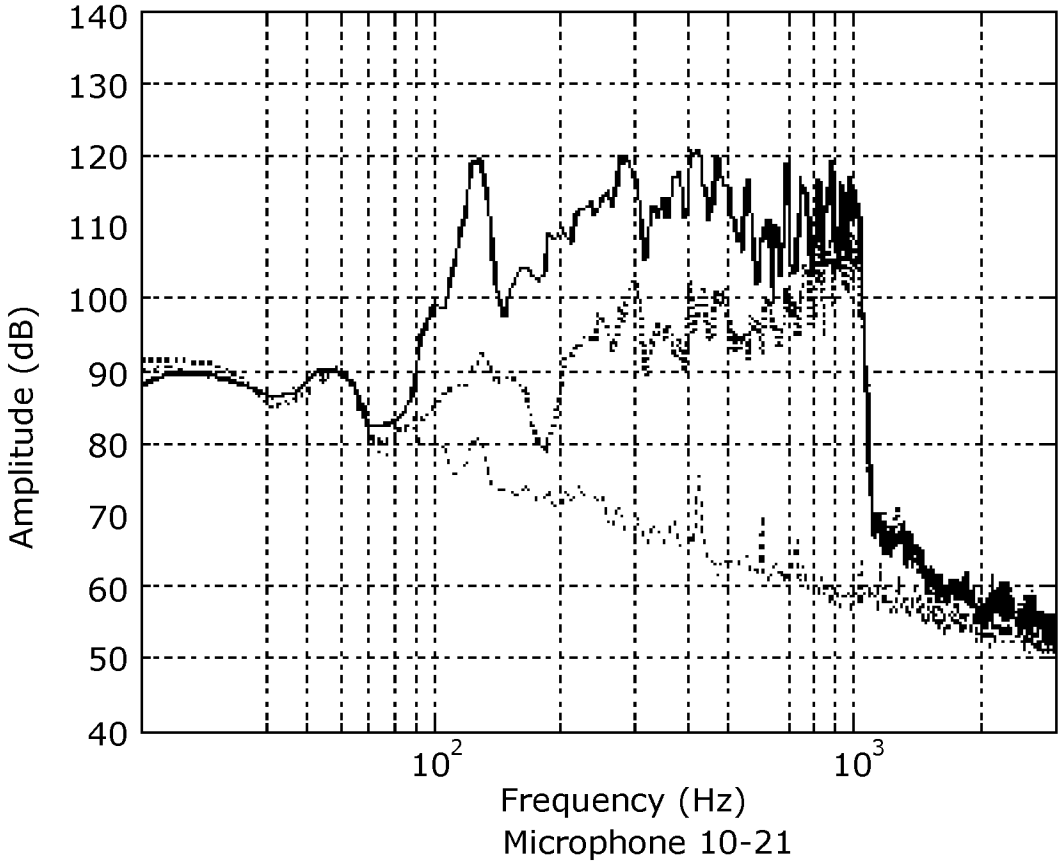
FIG. 20G is a diagram showing a control effect achieved by a microphone 10-21 for a control point, in a laboratory of the comparison-target sound field control apparatus.
Figure 20H:
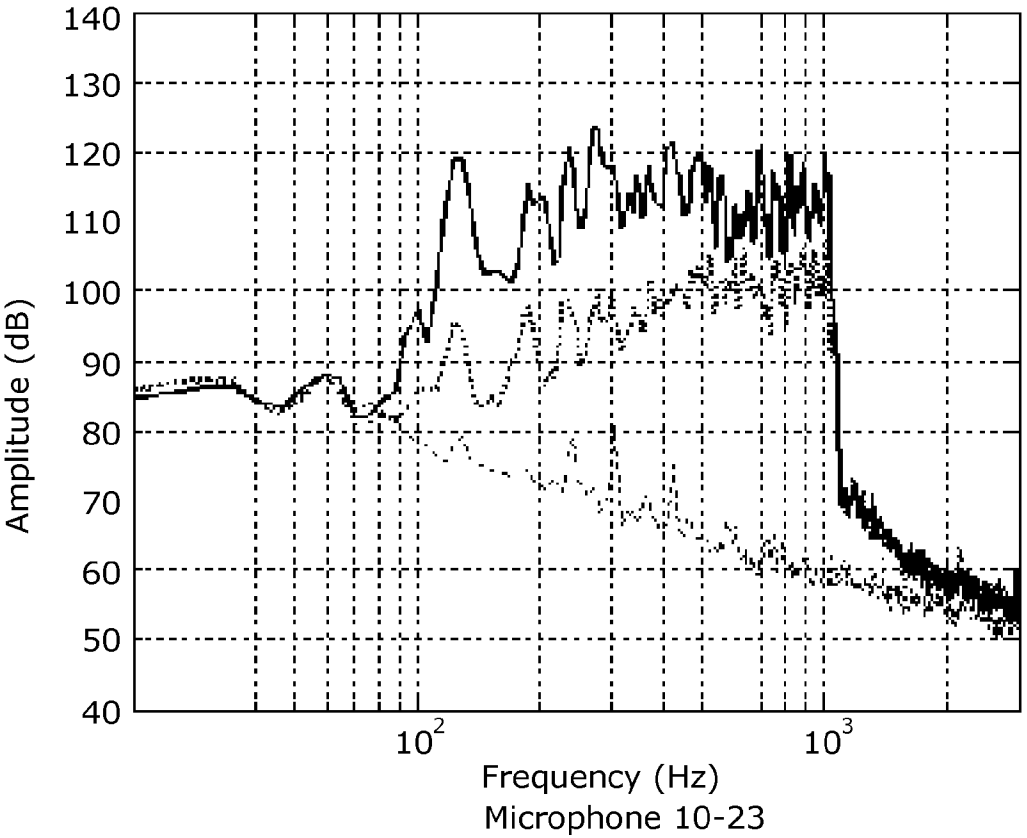
FIG. 20H is a diagram showing a control effect achieved by a microphone 10-23 for a control point, in a laboratory of the comparison-target sound field control apparatus.
Figure 20I:
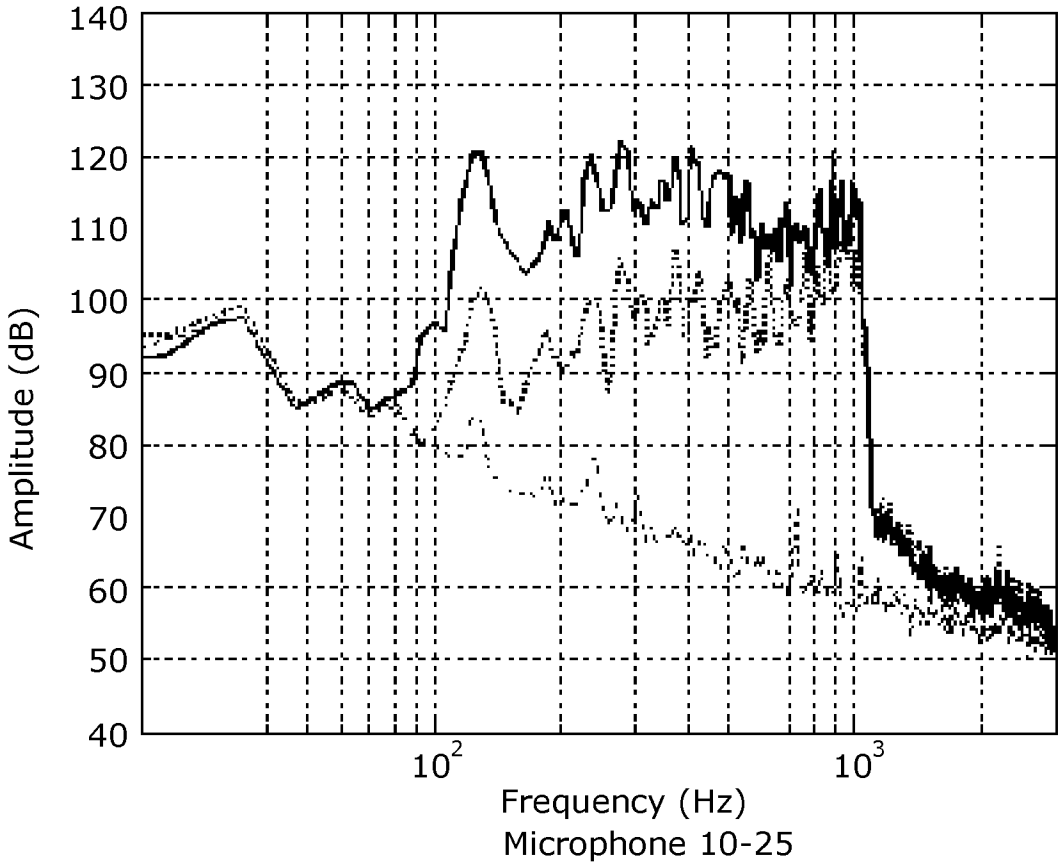
FIG. 20I is a diagram showing a control effect achieved by a microphone 10-25 for a control point, in a laboratory of the comparison-target sound field control apparatus.
Figure 20J:
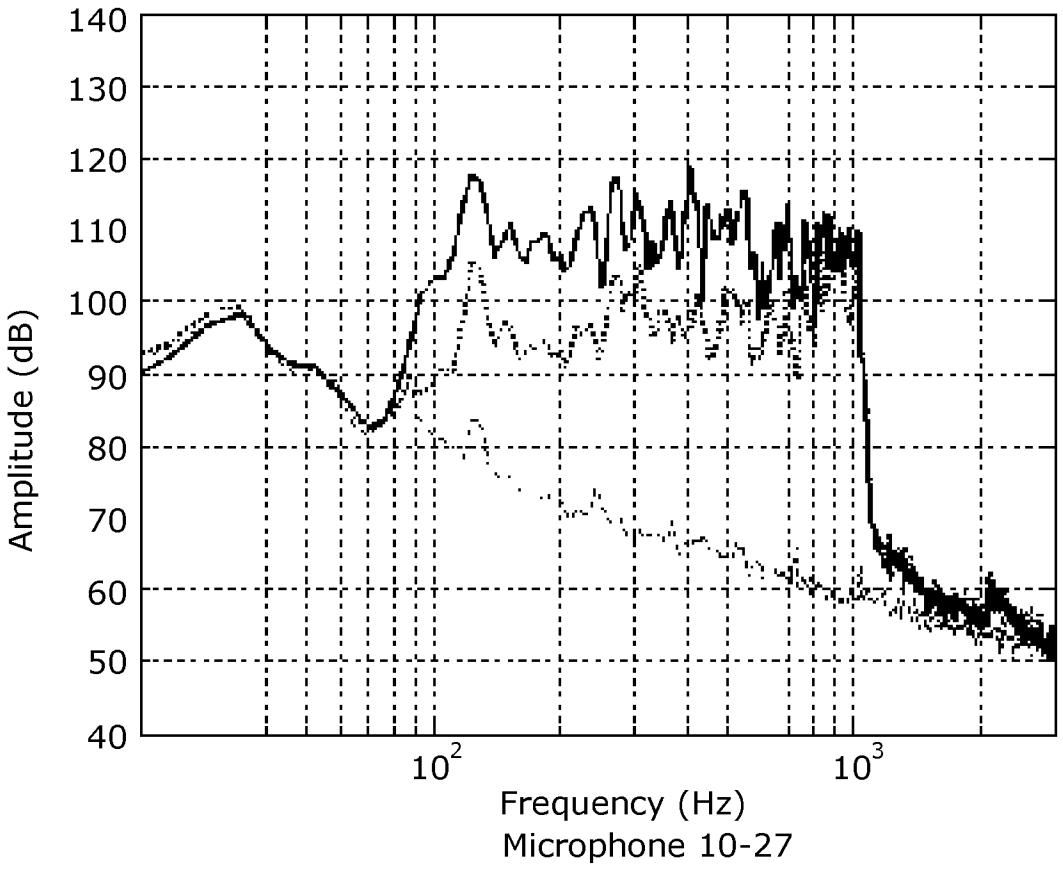
FIG. 20J is a diagram showing a control effect achieved by a microphone 10-27 for a control point, in a laboratory of the comparison-target sound field control apparatus.
Figure 20K:
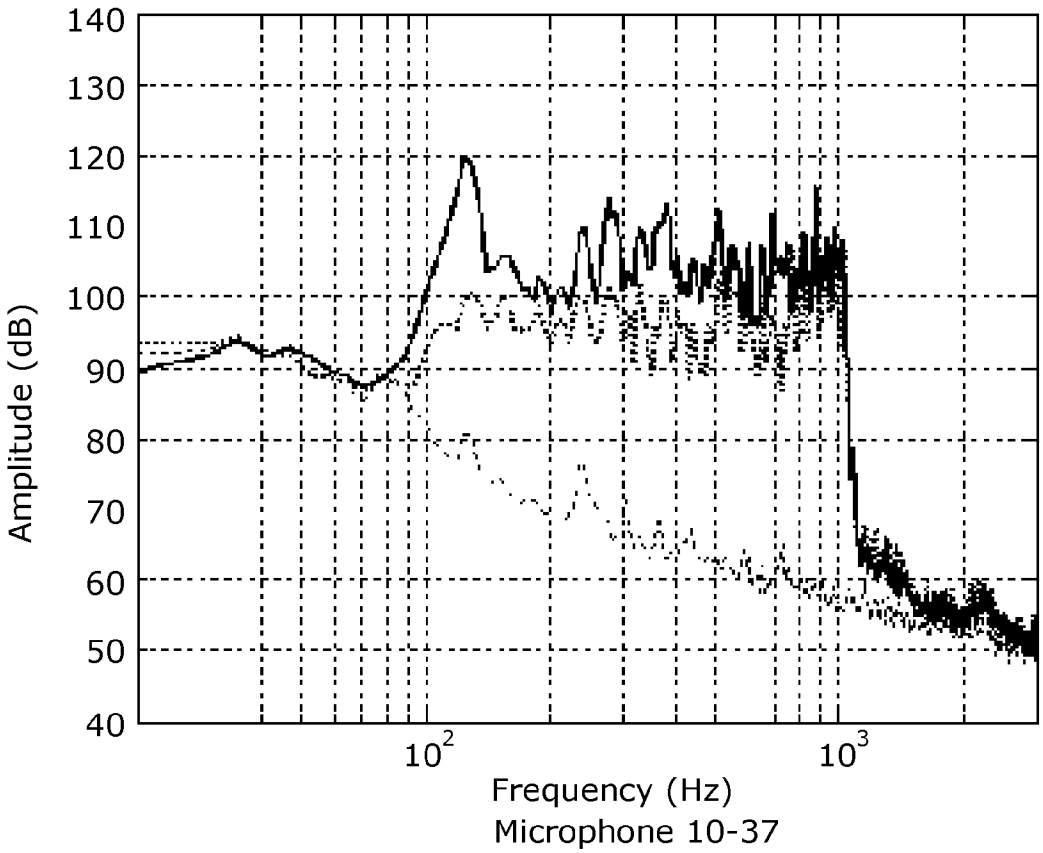
FIG. 20K is a diagram showing a control effect achieved by a microphone 10-37 for a control point, in a laboratory of the comparison-target sound field control apparatus.
Figure 20L:
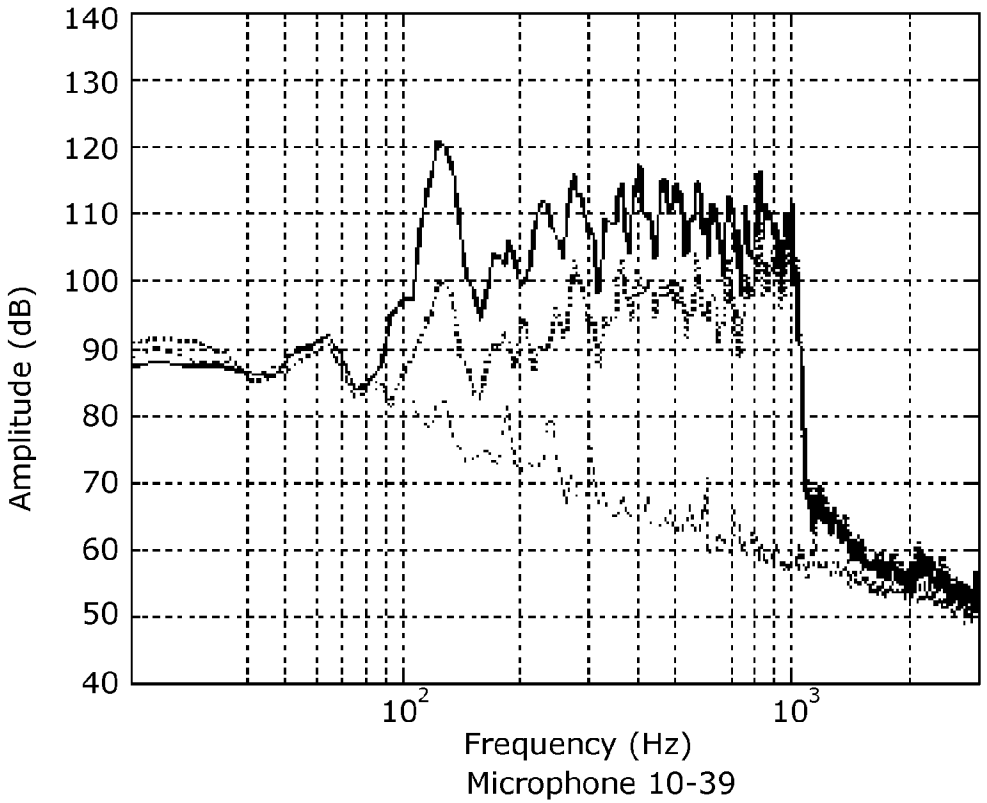
FIG. 20L is a diagram showing a control effect achieved by a microphone 10-39 for a control point, in a laboratory of the comparison-target sound field control apparatus.
Figure 20M:
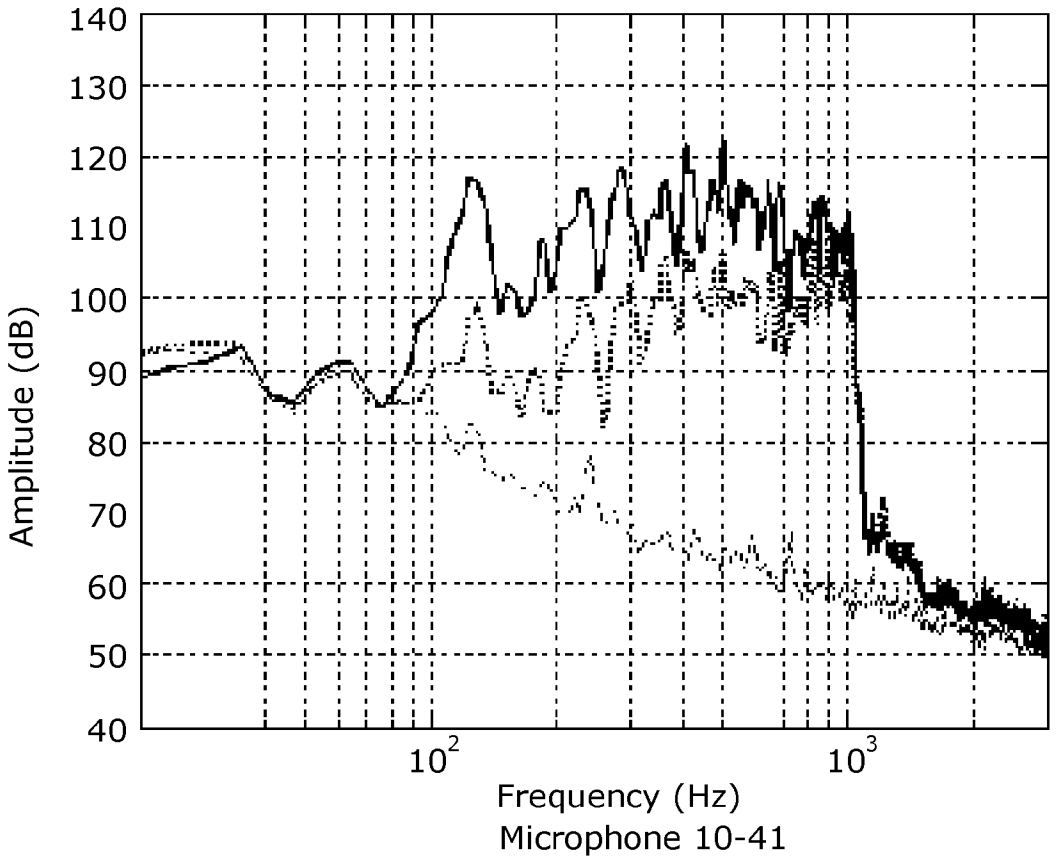
FIG. 20M is a diagram showing a control effect achieved by a microphone 10-41 for a control point, in a laboratory of the comparison-target sound field control apparatus.
Figure 20N:
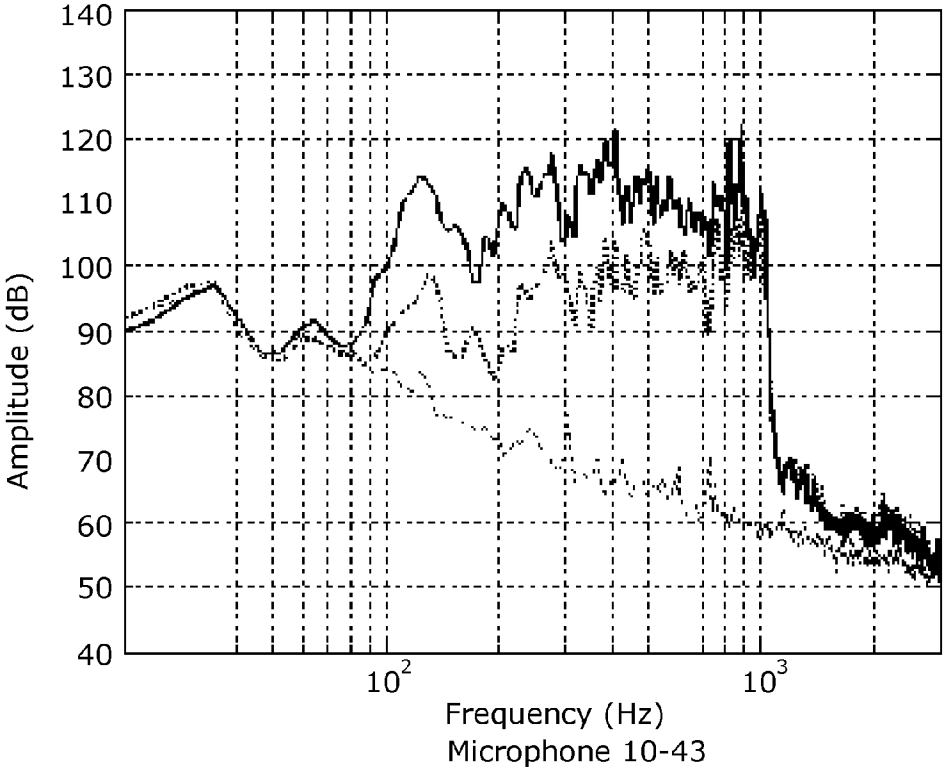
FIG. 20N is a diagram showing a control effect achieved by a microphone 10-43 for a control point, in a laboratory of the comparison-target sound field control apparatus.
Figure 20O:
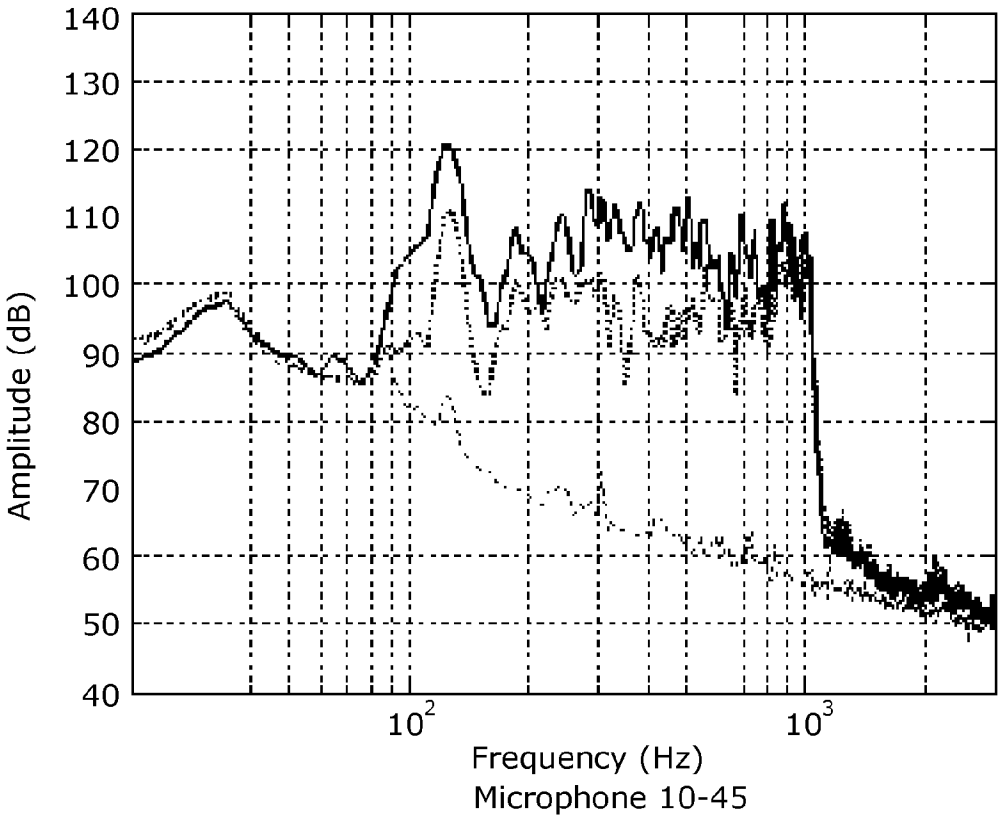
FIG. 20O is a diagram showing a control effect achieved by a microphone 10-45 for a control point, in a laboratory of the comparison-target sound field control apparatus.
Figure 20P:
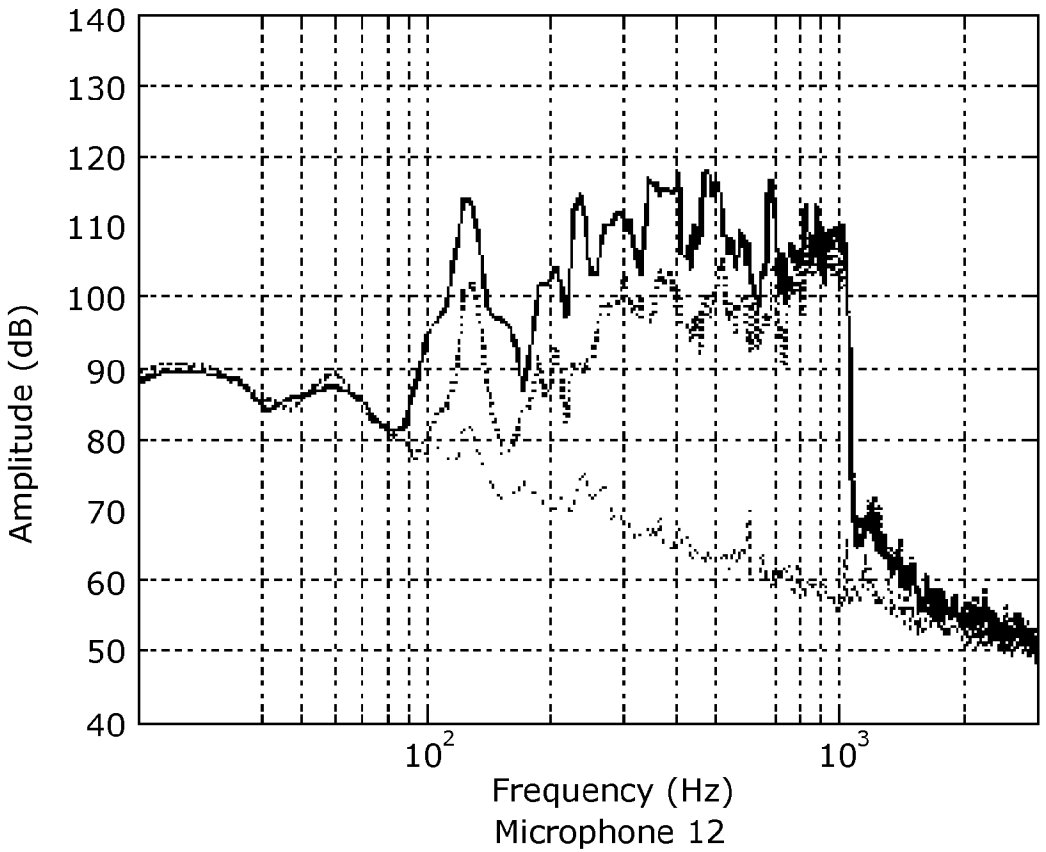
FIG. 20P is a diagram showing a control effect achieved by a microphone 12 used for evaluation, in the laboratory of the comparison-target sound field control apparatus.
Figure 21A:
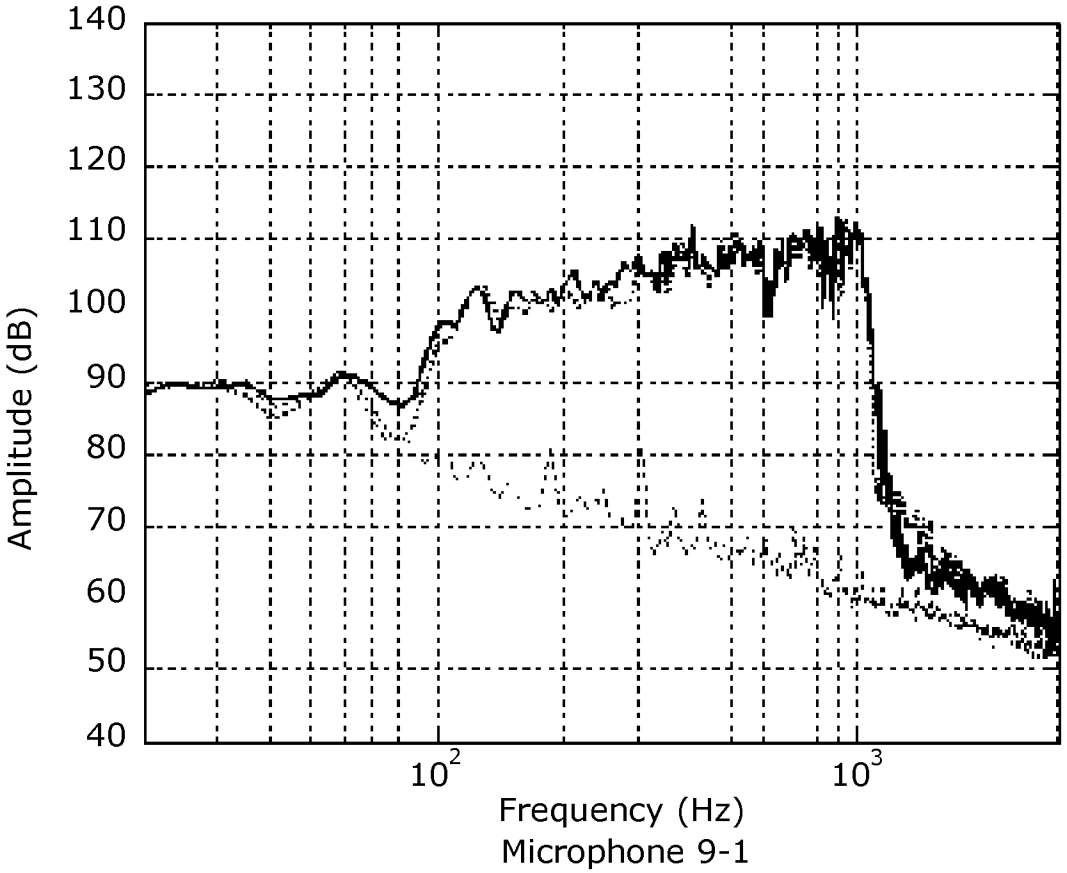
FIG. 21A is a diagram showing a control effect achieved by a microphone 9-1 for a listening point, in the laboratory of the comparison-target sound field control apparatus.
Figure 21B:
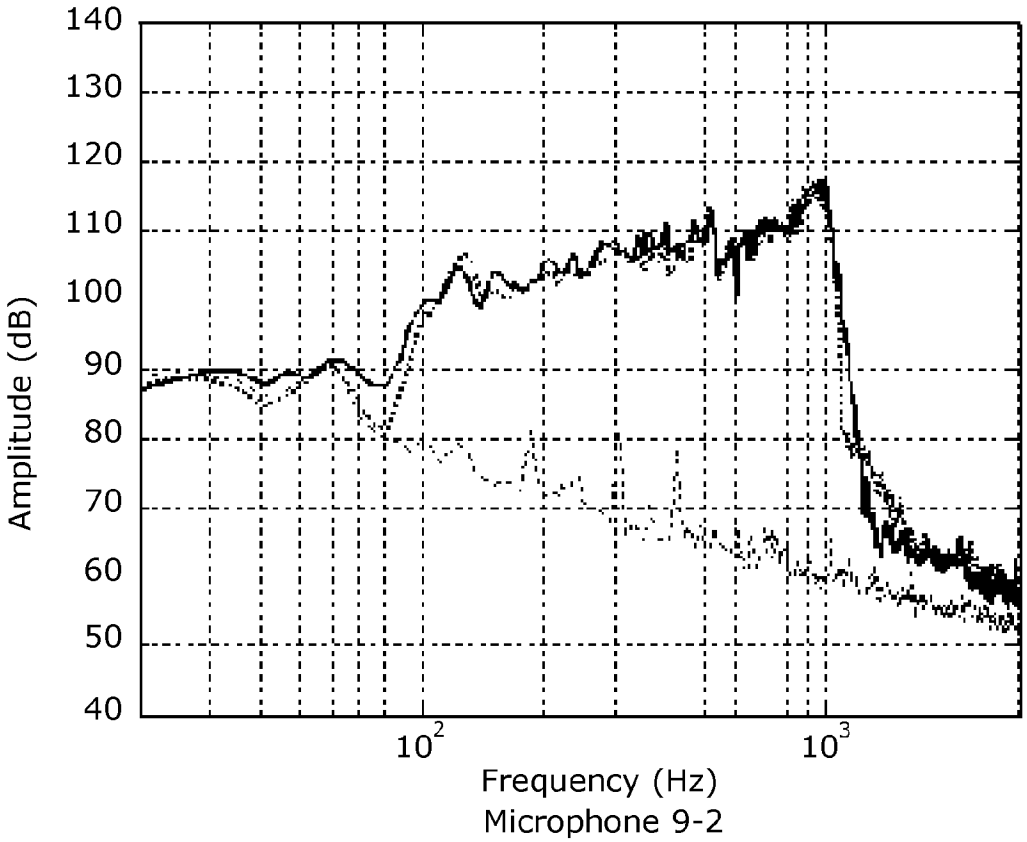
FIG. 21B is a diagram showing a control effect achieved by a microphone 9-2 for a listening point, in the laboratory of the comparison-target sound field control apparatus.
Figure 21C:
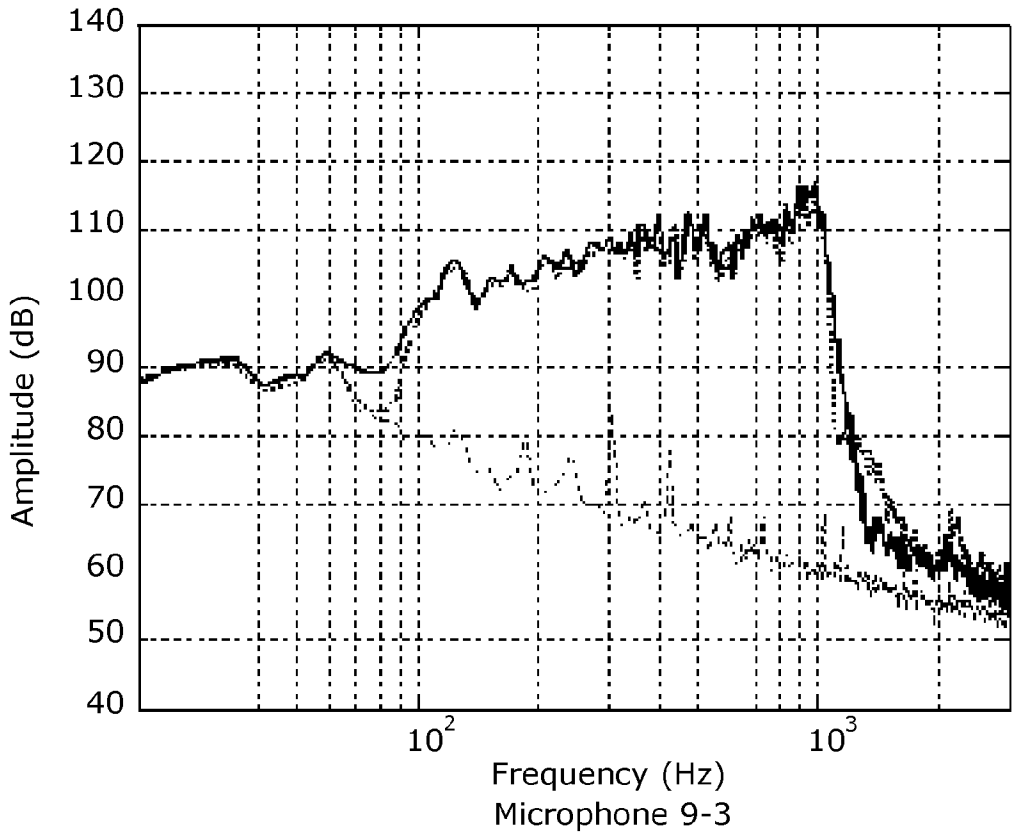
FIG. 21C is a diagram showing a control effect achieved by a microphone 9-3 for a listening point, in the laboratory of the comparison-target sound field control apparatus.
Figure 21D:
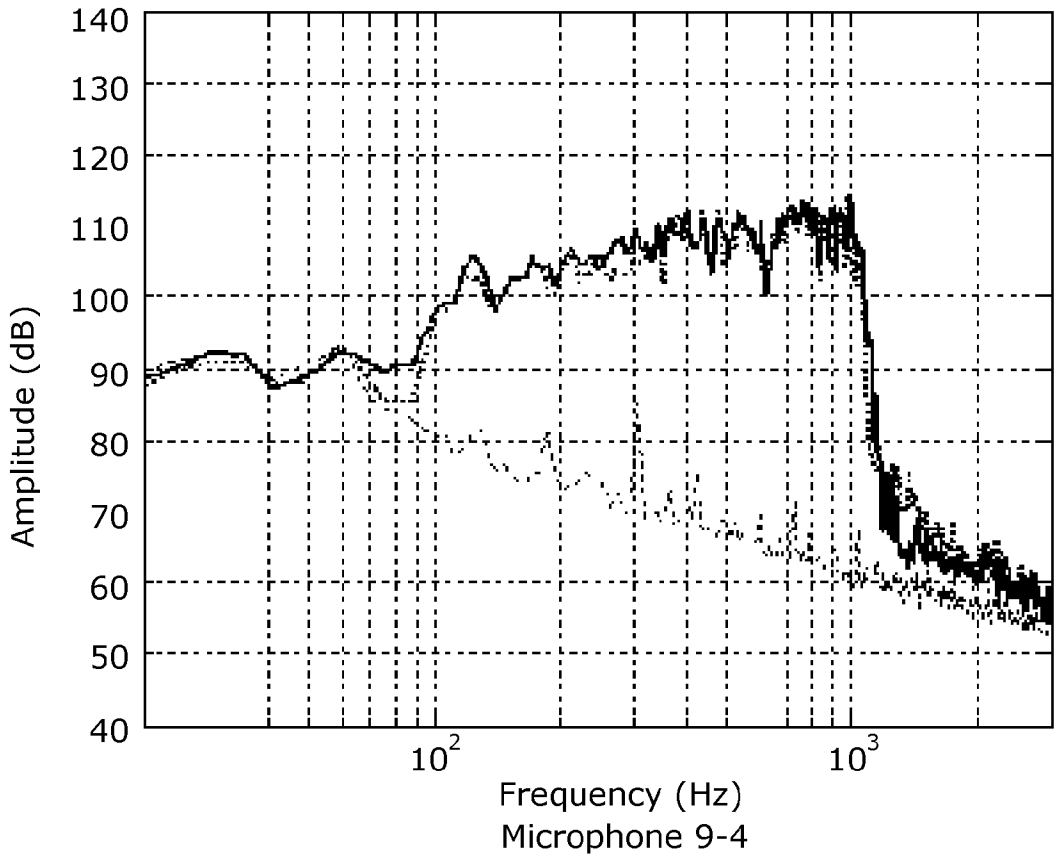
FIG. 21D is a diagram showing a control effect achieved by a microphone 9-4 for a listening point, in the laboratory of the comparison-target sound field control apparatus.
Figure 21E:
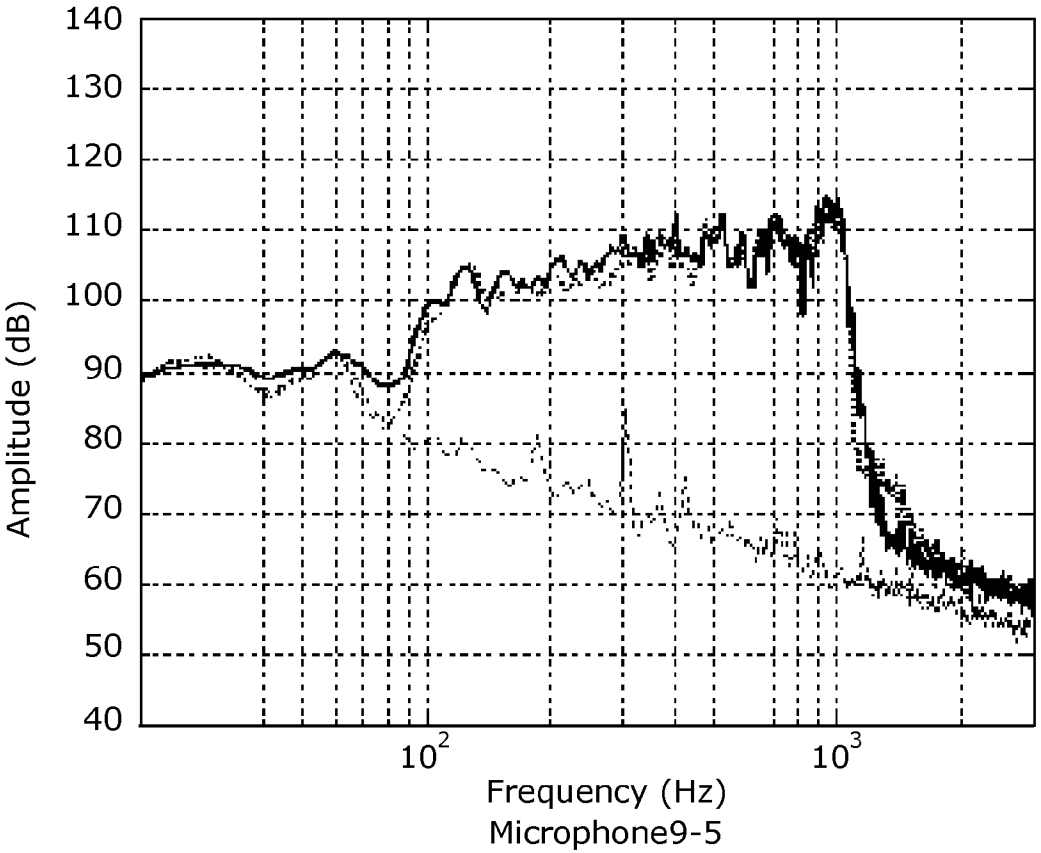
FIG. 21E is a diagram showing a control effect achieved by a microphone 9-5 for a listening point, in the laboratory of the comparison-target sound field control apparatus.
Figure 21F:
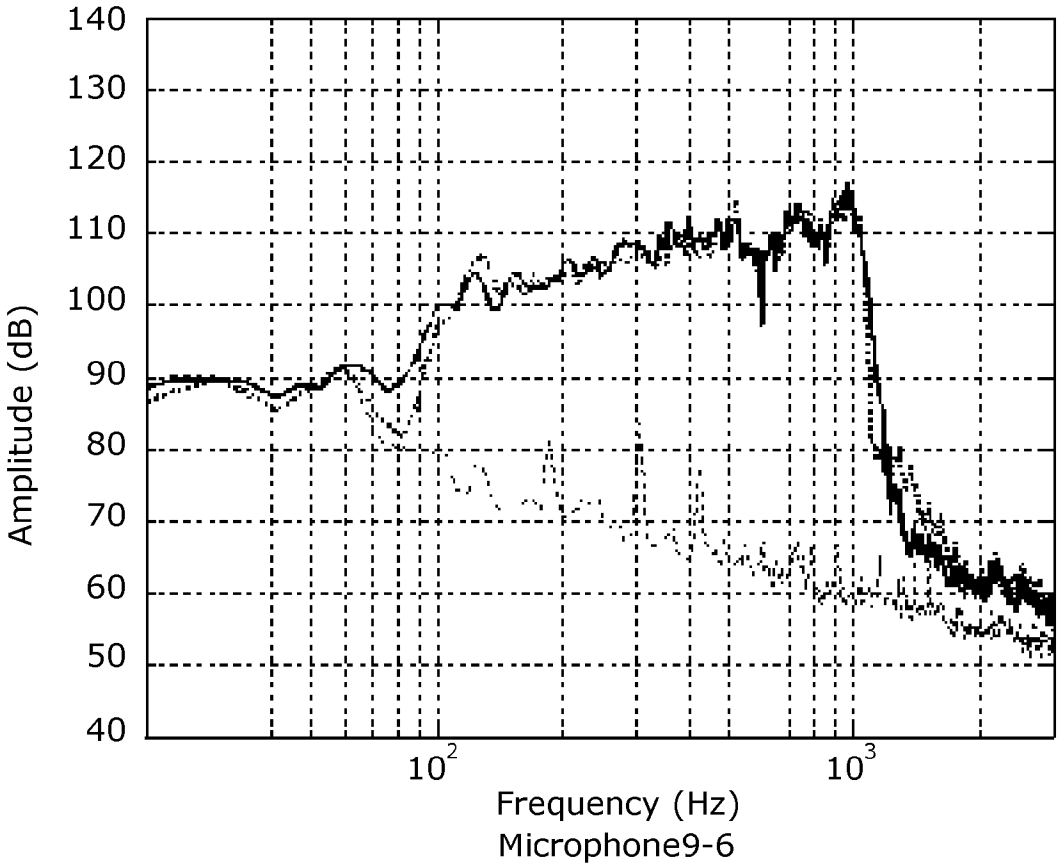
FIG. 21F is a diagram showing a control effect achieved by a microphone 9-6 for a listening point, in the laboratory of the comparison-target sound field control apparatus.
Figure 21G:
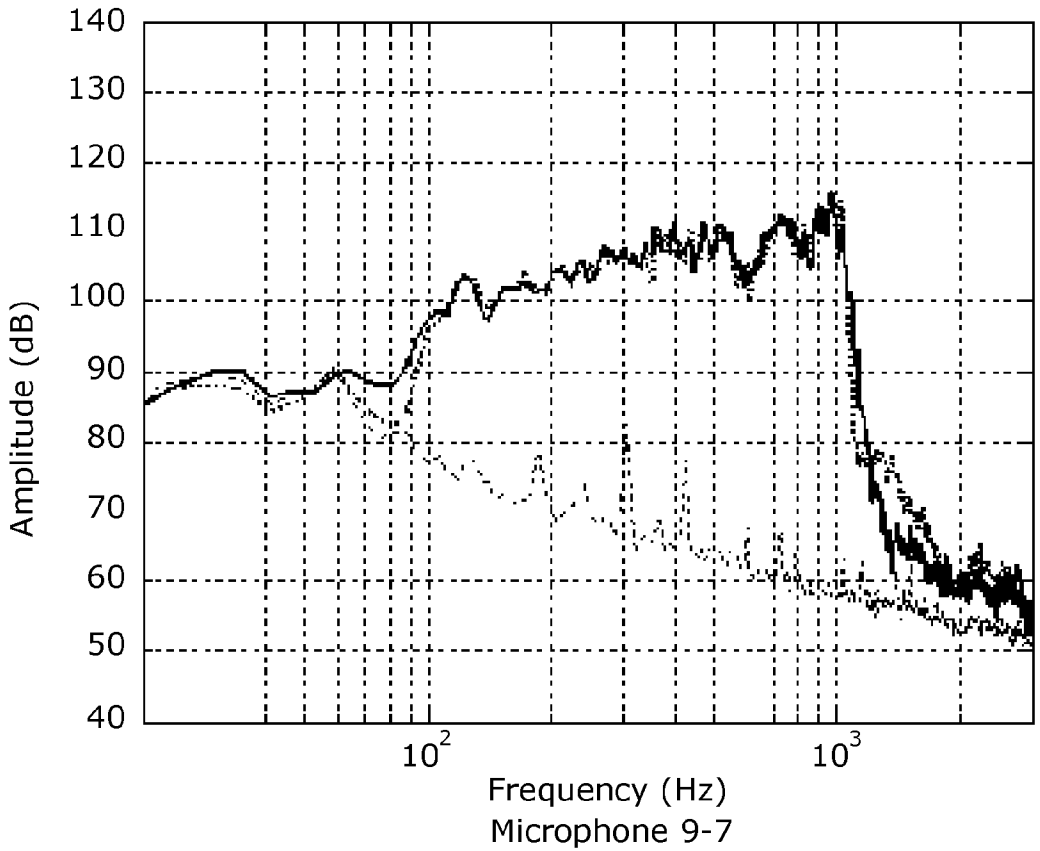
FIG. 21G is a diagram showing a control effect achieved by a microphone 9-7 for a listening point, in the laboratory of the comparison-target sound field control apparatus.
Figure 21H:
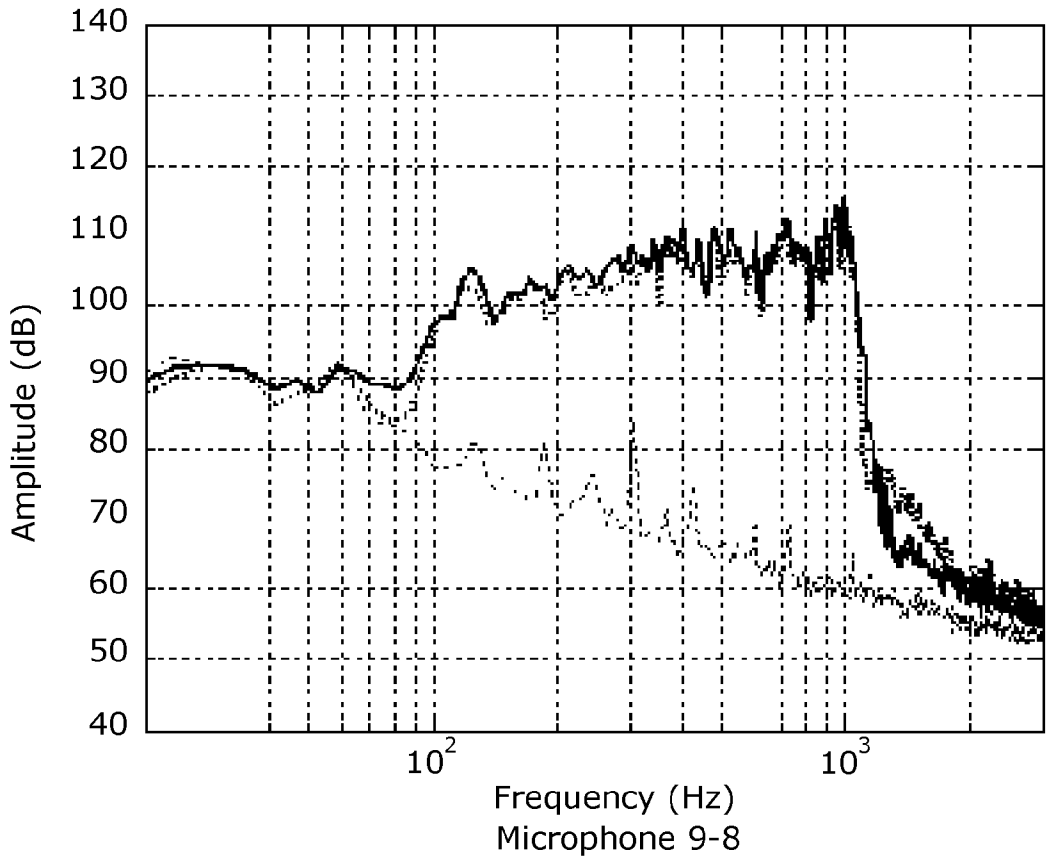
FIG. 21H is a diagram showing a control effect achieved by a microphone 9-8 for a listening point, in the laboratory of the comparison-target sound field control apparatus.
Figure 22A:
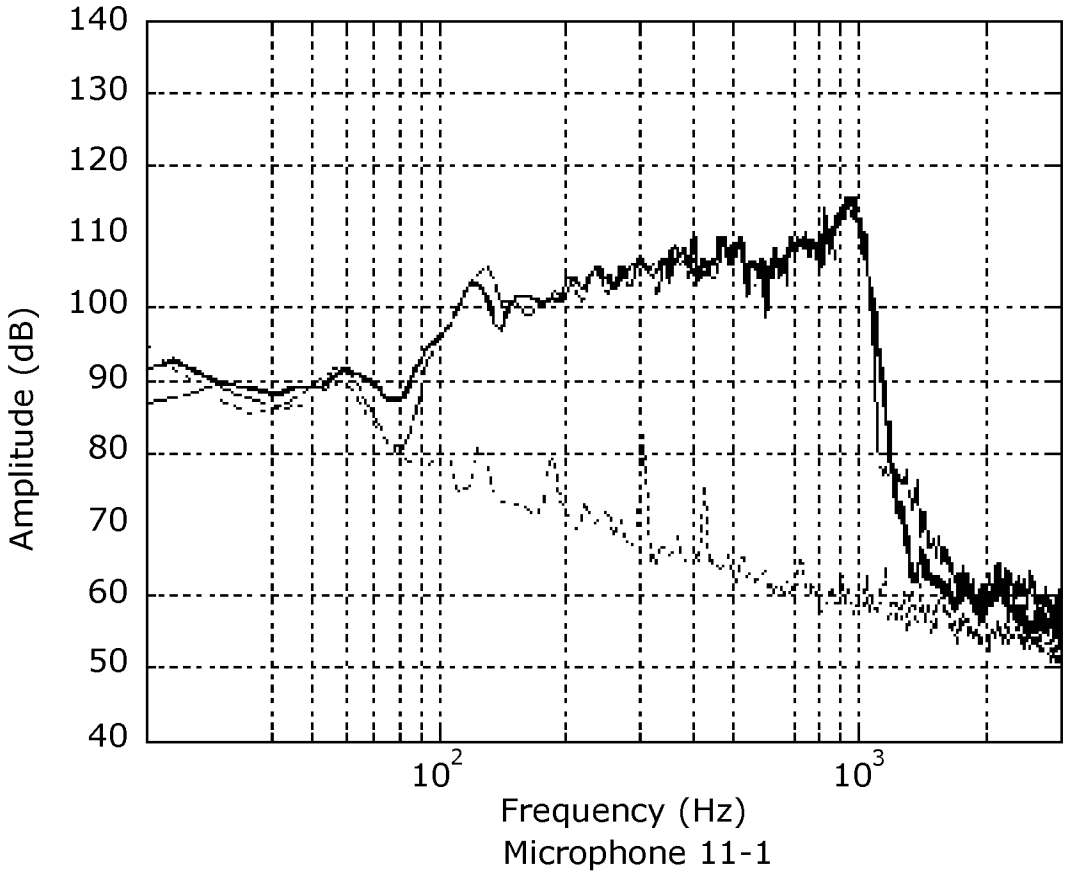
FIG. 22A is a diagram showing a control effect achieved by a microphone 11-1 used for evaluation, in the laboratory of the comparison-target sound field control apparatus.
Figure 22B:
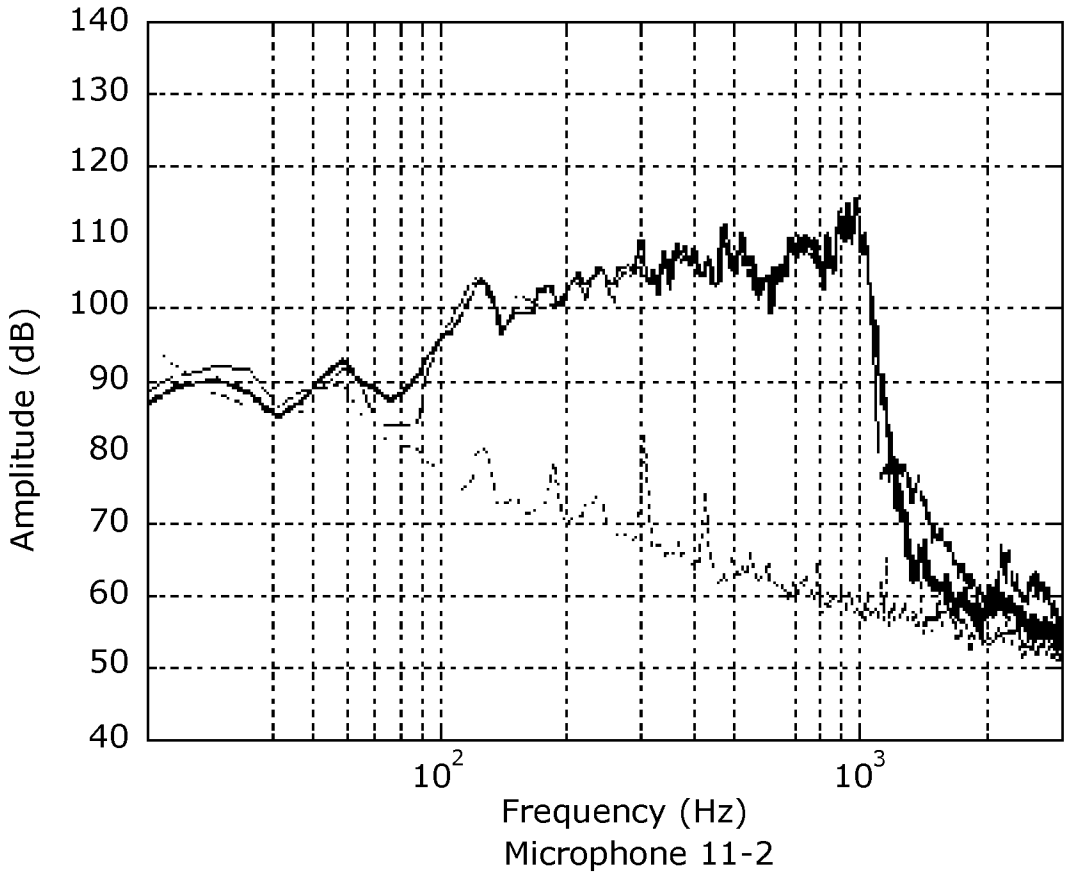
FIG. 22B is a diagram showing a control effect achieved by a microphone 11-2 used for evaluation, in the laboratory of the comparison-target sound field control apparatus.
Figure 22C:
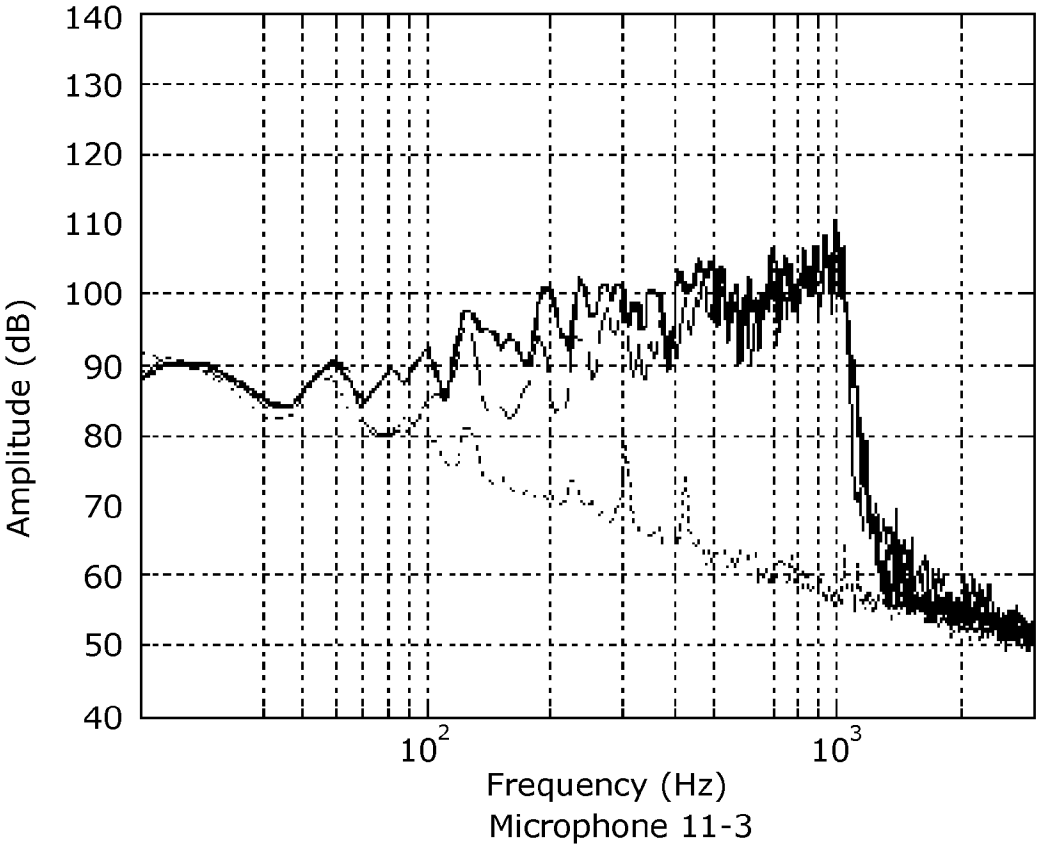
FIG. 22C is a diagram showing a control effect achieved by a microphone 11-3 used for evaluation, in the laboratory of the comparison-target sound field control apparatus.
Figure 22D:
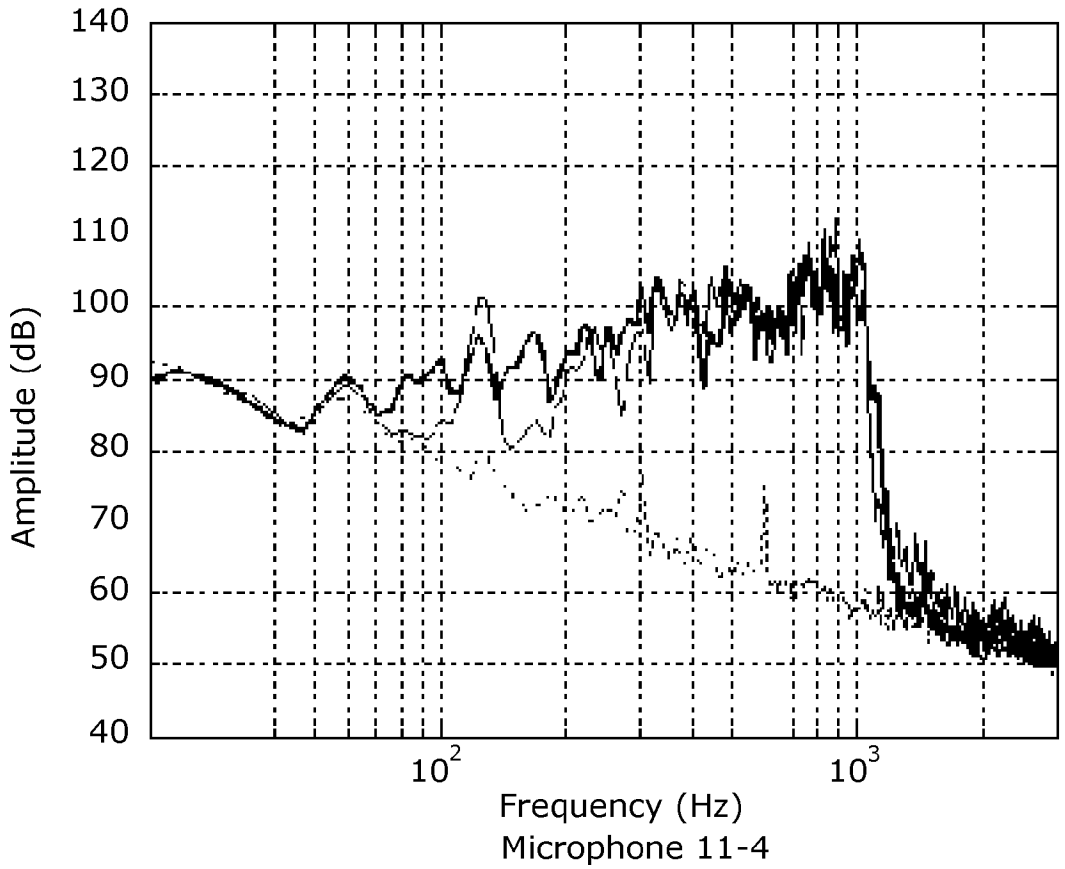
FIG. 22D is a diagram showing a control effect achieved by a microphone 11-4 used for evaluation, in the laboratory of the comparison-target sound field control apparatus.
Figure 22E:
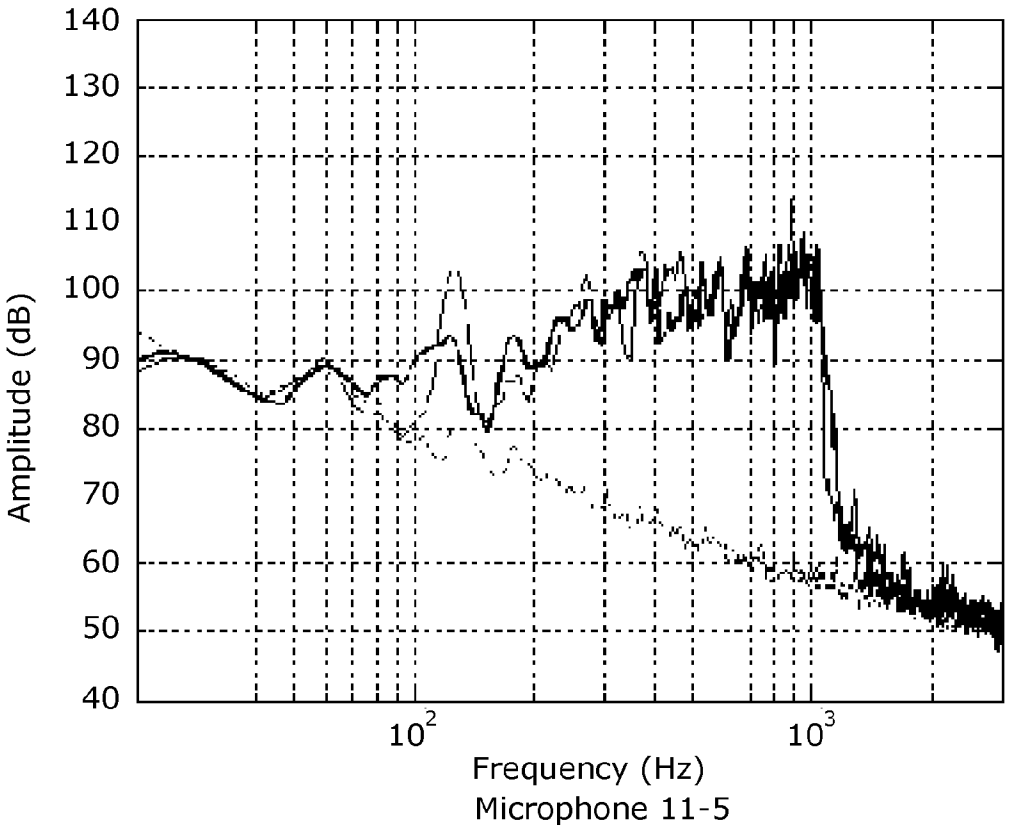
FIG. 22E is a diagram showing a control effect achieved by a microphone 11-5 used for evaluation, in the laboratory of the comparison-target sound field control apparatus.
Figure 22F:
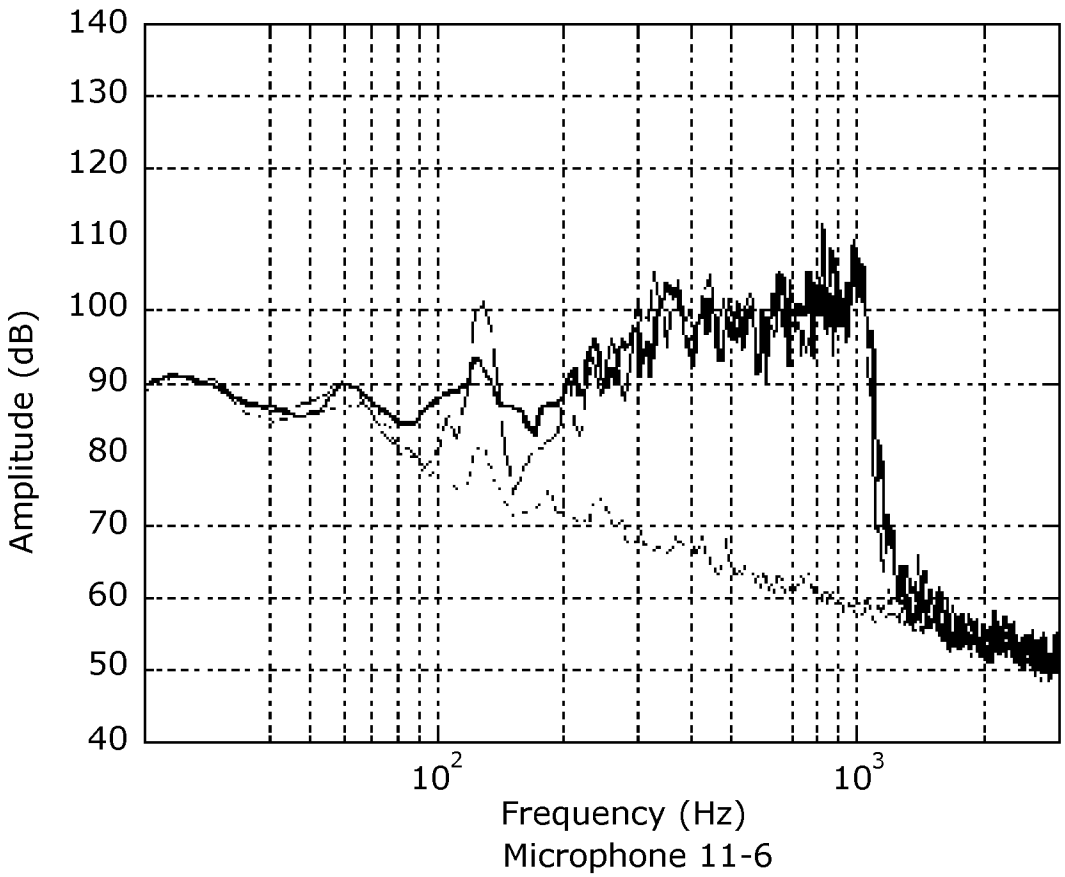
FIG. 22F is a diagram showing a control effect achieved by a microphone 11-6 used for evaluation, in the laboratory of the comparison-target sound field control apparatus.
Figure 22G:
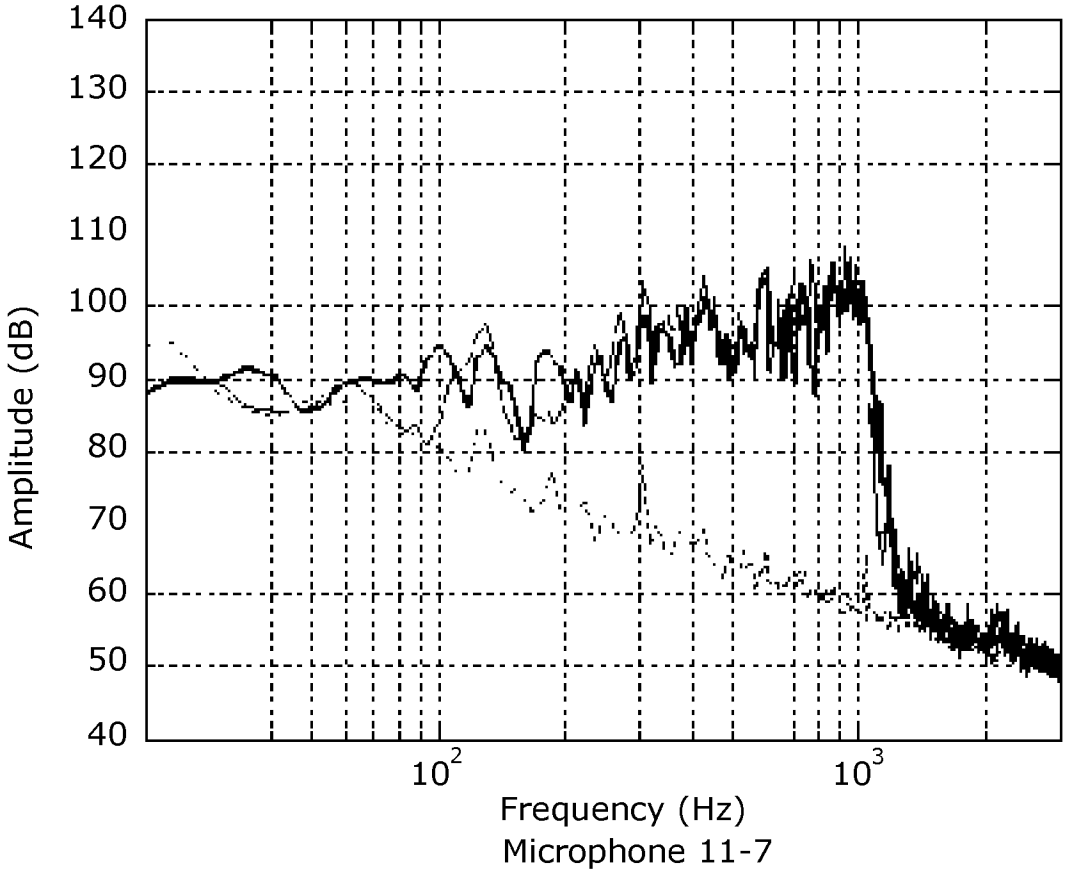
FIG. 22G is a diagram showing a control effect achieved by a microphone 11-7 used for evaluation, in the laboratory of the comparison-target sound field control apparatus.
Figure 22H:
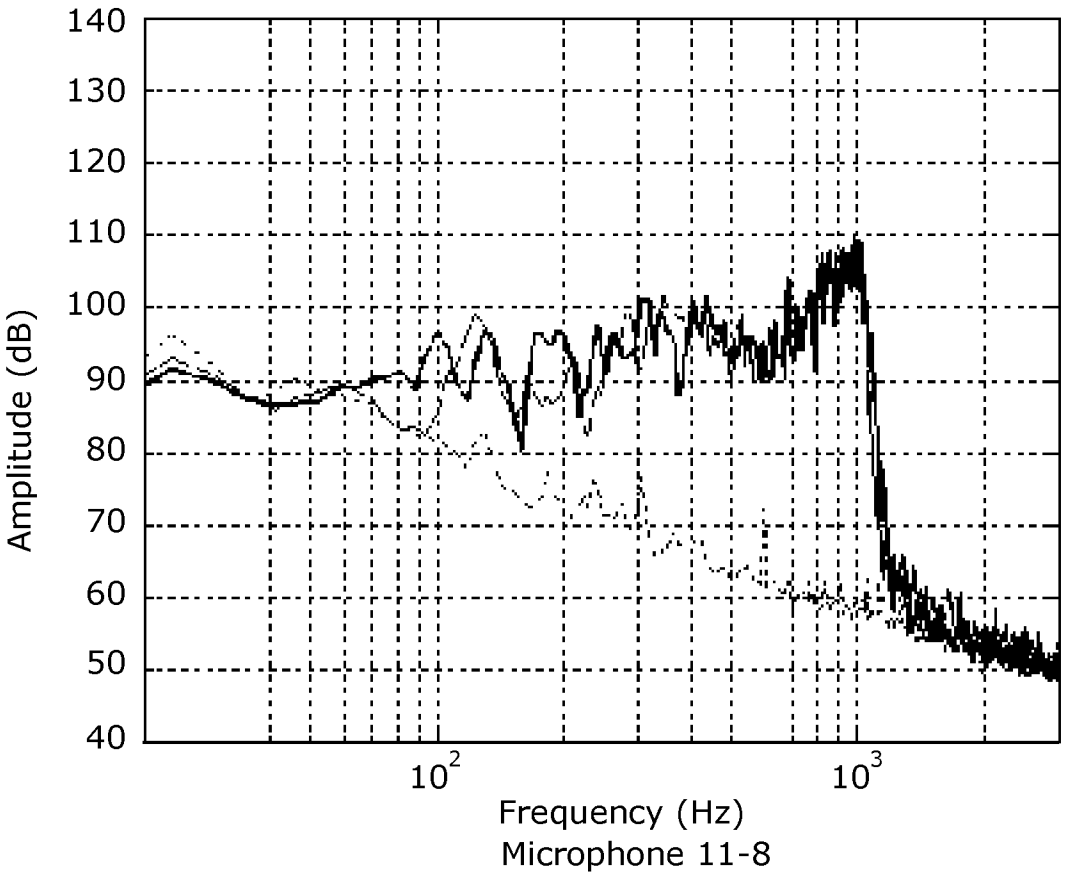
FIG. 22H is a diagram showing a control effect achieved by a microphone 11-8 used for evaluation, in the laboratory of the comparison-target sound field control apparatus.

With this being the situation, the control filter 3001 is divided into a control filter 3001-1 in charge of listening compensation and a control filter 3001-2 in charge of quiet sound as shown in a sound field control apparatus 3100 in FIG. 19. Then, the same experiment was carried out. The results are shown in FIG. 20A to FIG. 22H. Here, since the experiment was carried out using the same configuration as shown in FIG. 10 to FIG. 12, the microphones shown in FIG. 20A and FIG. 22H and described in the following are assigned the same reference signs as used in FIG. 16A to FIG. 18H.

In FIG. 20A to FIG. 21H, the resulting effects obtained at the listening points and the control points, that is, the microphones 9-1 to 9-8 and 10-1 to 10-45, were close to the control effects according to the present invention that are shown in FIG. 16A to FIG. 17H. However, the effects obtained by the microphones 11-3 to 11-8 shown in FIG. 22C to FIG. 22H are different from the effects shown in FIG. 18C to FIG. 18H, and the difference between the control-OFF characteristic and the control-ON characteristic was hardly obtained. On the contrary, the level in the case of control-ON is higher than the level in the case of control-OFF in some frequency bands such as around 120 Hz. This means that the original object is not implemented. To be more specific, assuming that a certain target sound source is reproduced, the original object is to have this sound reproduced only in the listening area, and not heard in other areas or reproduced in other areas at a level lower than the level of the original target sound source. Here, the control coefficients were to be calculated with no consideration for mutual influences (crosstalk) between the control filter 3001-1 and the control filter 3001-2. It is believed that this adverse influences remarkably occurred to the quiet area side in the experiment. Even though the adverse influences did occur in this experiment, the control coefficients of the control filter 3001-1 and the control filter 3001-2 could converge and thus could be obtained. However, depending on the circumstances, it is perfectly possible the coefficients could not converge properly such as the case where the coefficients diverge in the coefficient design units 3002-1 and 3002-2.

It is clear from the result of the experiment that the sound field control apparatus 3000 cannot obtain the aforementioned effect achieved by the sound field control apparatus 101 in Embodiment 1. Moreover, it is also clear that the sound field control apparatus 3100 having the configuration obtained by simply changing the configuration of the sound field control apparatus 3000 cannot produce the effect achieved by the sound field control apparatus 101 in Embodiment 1. Hence, the effectiveness of the sound field control apparatus 101 shown in FIG. 4 and FIG. 5 to FIG. 7 could be verified.

As described thus far, the sound field control apparatus 101 in Embodiment 1 can reproduce the target sound (sound field) in the listening area of the laboratory 300. Thus, the audio of the TV 301, for example, can be properly previewed. Moreover, since this reproduced sound can be reduced in the quiet area, conversation can be carried out without interruption by, for example, the audio of the TV 301. At the same time, the audio of the TV 301 can be enjoyed in the listening area at high volume levels without concern for someone else present in the quiet area.

Alternatively, when two persons side by side would like to listen to different contents (such as classic music and popular music, or a movie program on TV and a baseball game live on TV), one person can listen to the desired content while reducing the reproduced content of the other person. Accordingly, the persons can enjoy the desired contents without the mutual adverse influences, that is, crosstalk. In addition, these desired contents can also be controlled to be reproduced virtually at any sound fields. Therefore, the presence can also be recreated as if the persons were in, for example, a concert hall and a baseball stadium.

Moreover, especially in the case where the speakers used for control are arranged, for example, in the same plane in front of the viewer without limiting the condition to arrange the acoustic devices such as the speakers and microphones used for control, the effect can be obtained for the entire frequency band to be controlled. On this account, the apparatus can be broadly applicable to not only a room in a home where a TV and audio devices are installed, but also shops such as a barber shop and a beauty salon, facilities such as a gallery and a museum, and transportation means such as a car and a train.

Furthermore, in the experiment shown in FIG. 10 to FIG. 12, the speakers were simply placed around the TV based on the assumption of the audio of the TV and, therefore, the arrangement and number of speakers were not optimized. Nevertheless, the effects shown in FIG. 16A to FIG. 18H were obtained. This means that the control was performed without any special condition for the speakers. To be more specific, the speakers can be freely installed. For example, in the case where the apparatus is applied to a flat-screen TV, the speakers may be arranged on the wall where the TV is installed. With this, neat arrangement can be implemented together with the TV. Even with such an arrangement of the speakers, the sound field can be controlled in a wide frequency band.

Figure 23:
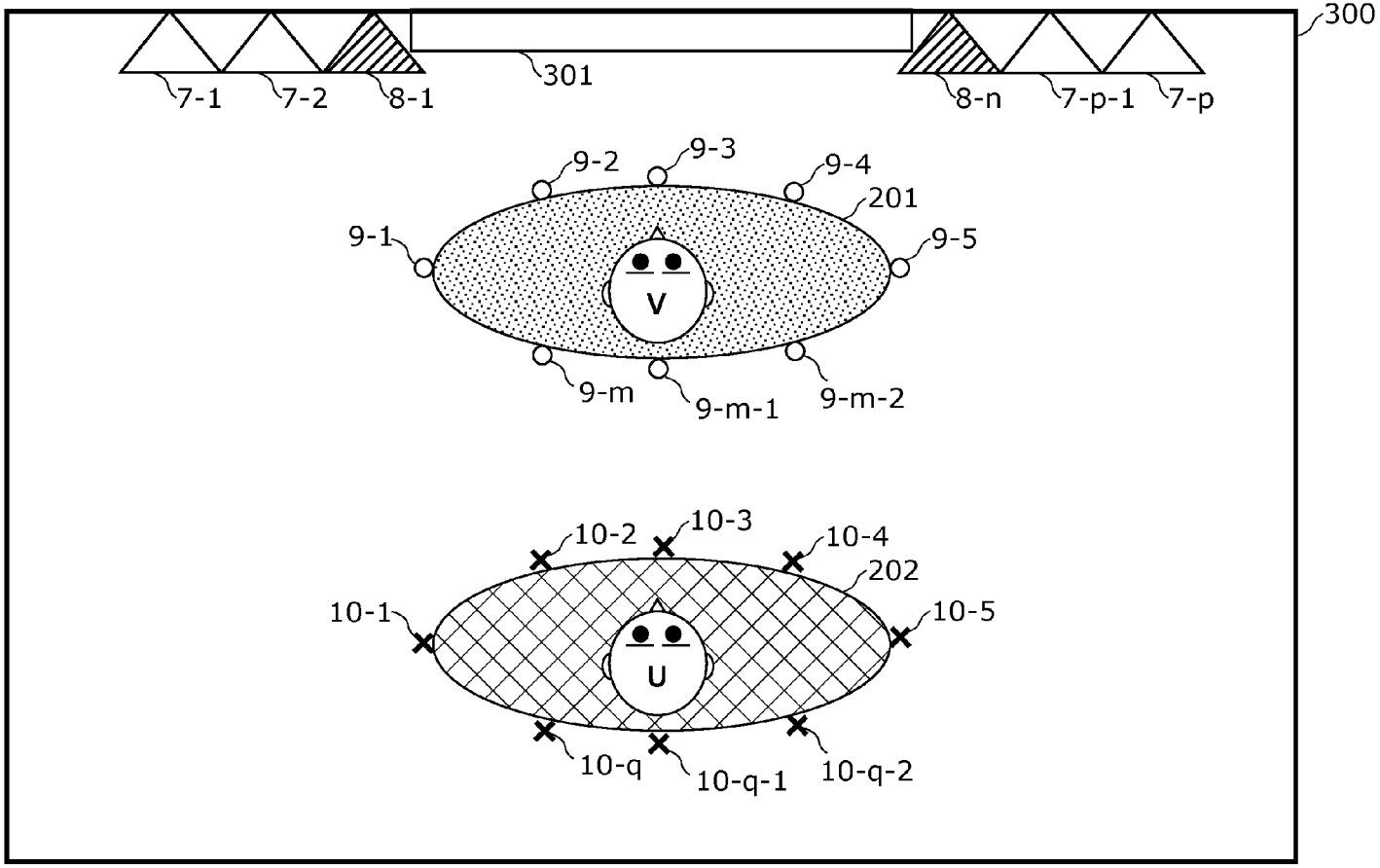
FIG. 23 is a diagram explaining another listening area and another quiet area of the sound field control apparatus in Embodiment 1.
Figure 24:
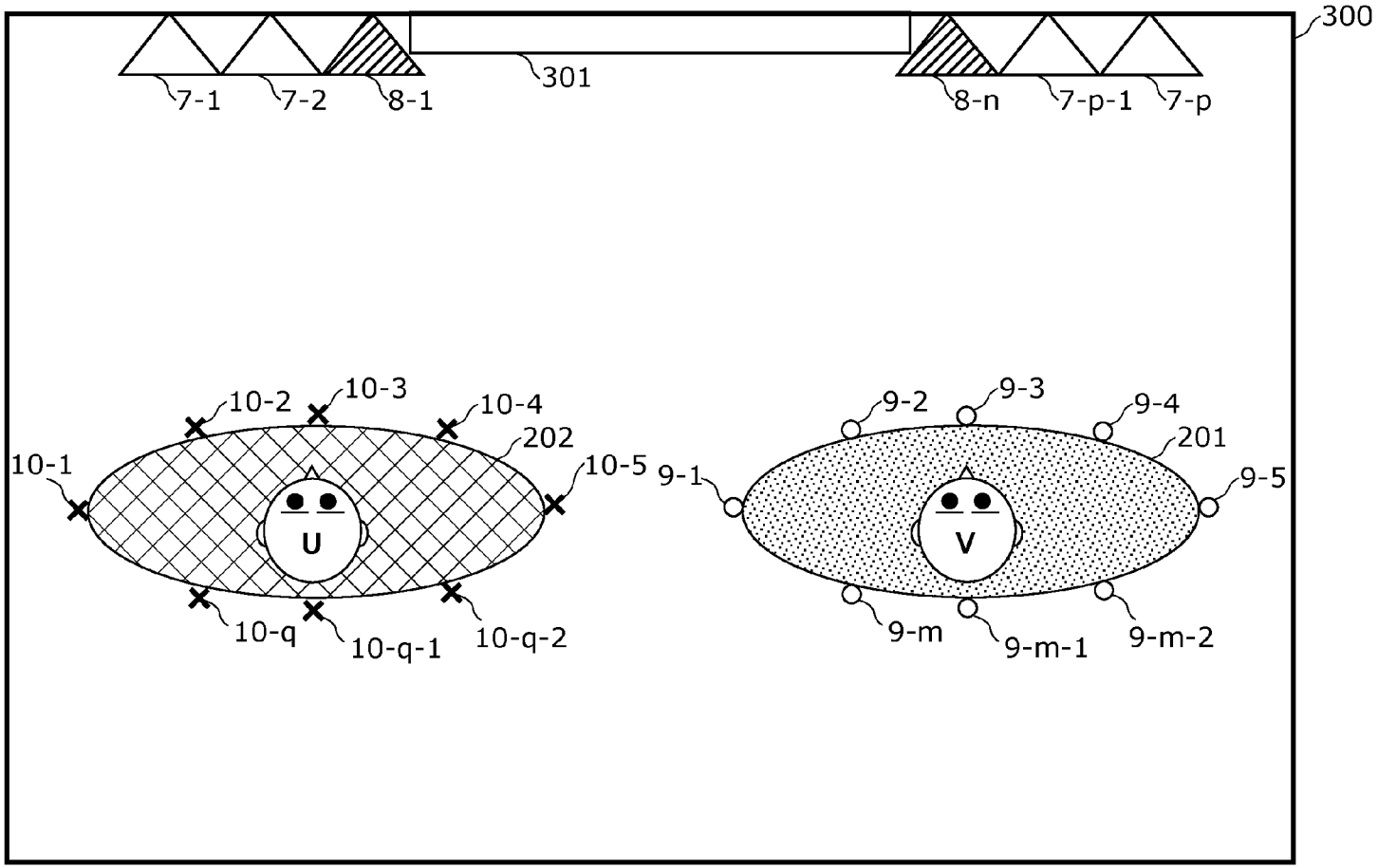
FIG. 24 is a diagram explaining another listening area and another quiet area of the sound field control apparatus in Embodiment 1.

In Embodiment 1, the control is performed to implement the quiet area 202 over a large area behind the listening area 201 as shown in FIG. 9. Besides this, the quiet area 202 may also be an area surrounding the viewer U as shown in FIG. 23. In this case, the quiet area and the listening area can be switched to set the quiet area as an area 201 surrounding the viewer V and set the listening area as an area 202 surrounding the viewer U. Moreover, the listening area 201 and the quiet area 202 may be implemented adjacent to each other as shown in FIG. 24.

Figure 25:
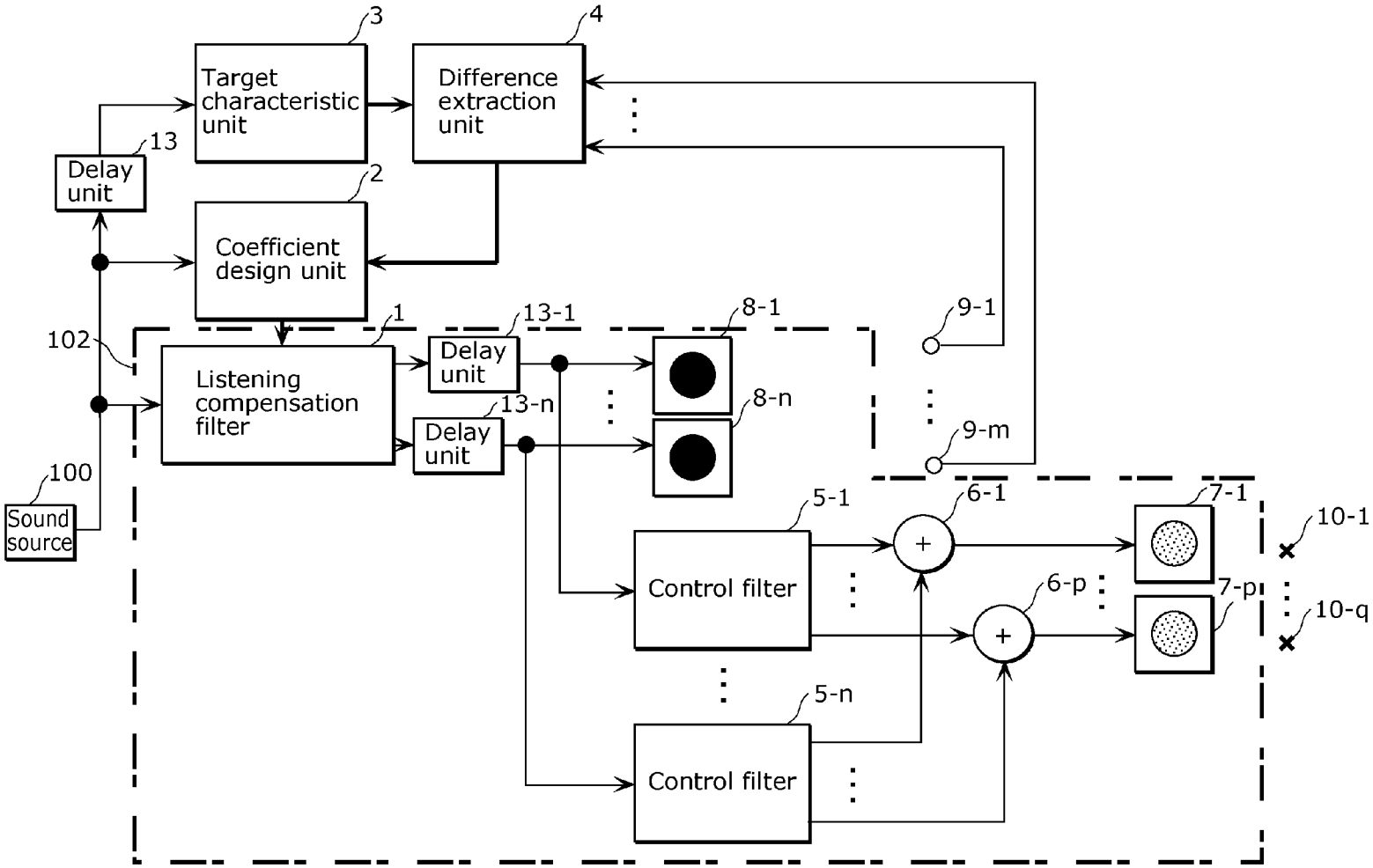
FIG. 25 is a diagram showing a configuration of another sound field control apparatus in Embodiment 1.

As an example of the basic control configuration of the sound field control apparatus in Embodiment 1, the sound field control apparatus 101 is shown in FIG. 4 and FIG. 5 to FIG. 7. However, the configuration may be as shown by a sound field control apparatus 102 in FIG. 25. In addition to the structural elements included in the sound field control apparatus 101, the sound field control apparatus 102 further includes delay units 13-1 to **13-*n*. Moreover, a system for setting the coefficient of the listening compensation filter 1 of the sound field control apparatus 102 includes a delay unit 13**.

In order for the control filters and the listening compensation filter to converge properly, the principle of cause and effect in the digital signal processing needs to be satisfied. Thus, as a technique for designing a coefficient, the delay units 13 and 13-1 to **13-*n* may be inserted as appropriate, as shown by the sound field control apparatus 102 and a system including the sound field control apparatus 102. The delay unit 13 may be included in the target characteristic unit 3. The delay unit 13 delays the transfer of the input signal from the sound source 100 to the target characteristic unit 3, and the delay units 13-1 to 13-*n* delay the transfer of the output signal from the listening compensation filter 1 to the speakers 8-1 to 8-*n***.

It should be noted that each of the systems shown in FIG. 5 to FIG. 7 includes, for example, the coefficient design unit as a structural element which calculates the coefficients of the listening compensation filter 1 and the control filters 5-1 to **5-*n*. Once the coefficients are obtained, the coefficients do not need to be redesigned as long as the application environment (such as a room where the apparatus and the speakers are installed) of a sound field control apparatus in an aspect according to the present invention is not changed. More specifically, the coefficients do not need to be redesigned in the case, for example, where the TV and the speakers used for adjusting the control points are installed on the wall or where the TV and the speakers are implemented previously in such a storage rack at the factory prior to shipment. Therefore, the structural element related to the coefficient design is not necessary in the sound field control apparatus, as shown in FIG. 4. In the case where the coefficients need to be redesigned, any one of the systems shown in FIG. 5 to FIG. 7** may be used as the sound field control apparatus.

As described, the sound field control apparatus in Embodiment 1 can appropriately implement any sound field characteristics at different areas in one space without any constraint on an arrangement of a configuration. For example, when the audio from audio-video (AV) equipment such as a TV or an audio device is listened to, the reproduced sound from the AV equipment can be precisely heard only in a specific listening area and the reproduced sound can be reduced in other areas.

Embodiment 2

A configuration of a sound field control apparatus in Embodiment 2 is described.

Figure 26:
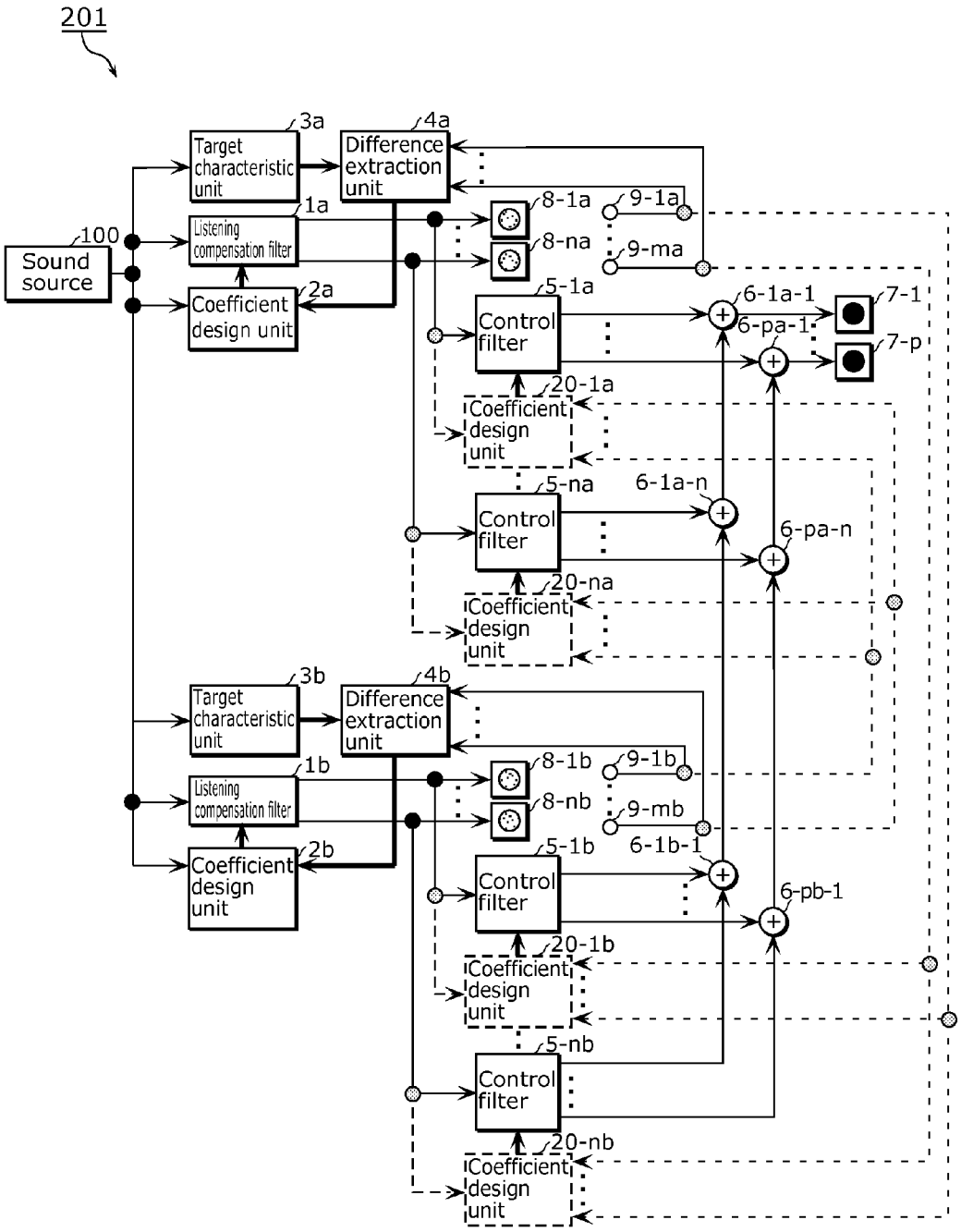
FIG. 26 is a diagram showing a configuration of a system including a sound field control apparatus in Embodiment 2.

FIG. 26 shows a configuration of a system 201 including the sound field control apparatus in Embodiment 2. FIG. 26 shows the configuration of the system 201 including the sound field control apparatus that is at a stage where coefficients of listening compensation filters **1*a* and 1*b* and coefficients of control filters 5-1*a* to 5-*na* and 5-1*b* to 5-*nb* are to be set. The sound field control apparatus of the system 201 in Embodiment 2 does not include a structural element necessary to set the coefficients. Moreover, the system 201 shown in FIG. 26 includes two systems 101C arranged in parallel. Here, the system 101C is shown in FIG. 7**.

To be more specific, the system 201 in Embodiment 2 includes the listening compensation filter 1*a*, the listening compensation filter 1*b*, a coefficient design unit 2*a*, a coefficient design unit 2*b*, coefficient design units 20-1*a* to 20-*na*, coefficient design units 20-1*b* to 20-*nb*, a target characteristic unit 3*a*, a target characteristic unit 3*b*, a difference extraction unit 4*a*, a difference extraction unit 4*b*, the control filters 5-1*a* to 5-*na*, the control filters 5-1*b* to 5-*nb*, adders 6-1*a*-1 to 6-1*a*-*n*, adders 6-*pa*-1 to 6-*pa*-*n*, an adder 6-1*b*-1, an adder 6-*pb*-1, speakers 7-1 to 7-*p*, speakers 8-1*a* to 8-*na*, and speakers 8-1*b* to 8-*nb*. The sound field control apparatus in Embodiment 2 includes the listening compensation filter 1*a*, the listening compensation filter 1*b*, the control filters 5-1*a* to 5-*na*, the control filters 5-1*b* to 5-*nb*, the adders 6-1*a*-1 to 6-1*a*-*n*, the adders 6-*pa*-1 to 6-*pa*-*n*, the adder 6-1*b*-1, the adder 6-*pb*-1, the speakers 7-1 to 7-*p*, the speakers 8-1*a* to 8-*na*, and the speakers 8-1*b* to 8-*nb*. It should be noted that the sound field control apparatus in Embodiment 2 may not include the speakers 7-1 to 7-*p*, 8-1*a* to 8-*na*, and 8-1*b* to 8-*nb*.

The structural elements of the system 201 are identical to those of the system 101C in Embodiment 1. Therefore, the explanations of these structural elements are omitted, and only the operations are described as follows.

Figure 27:
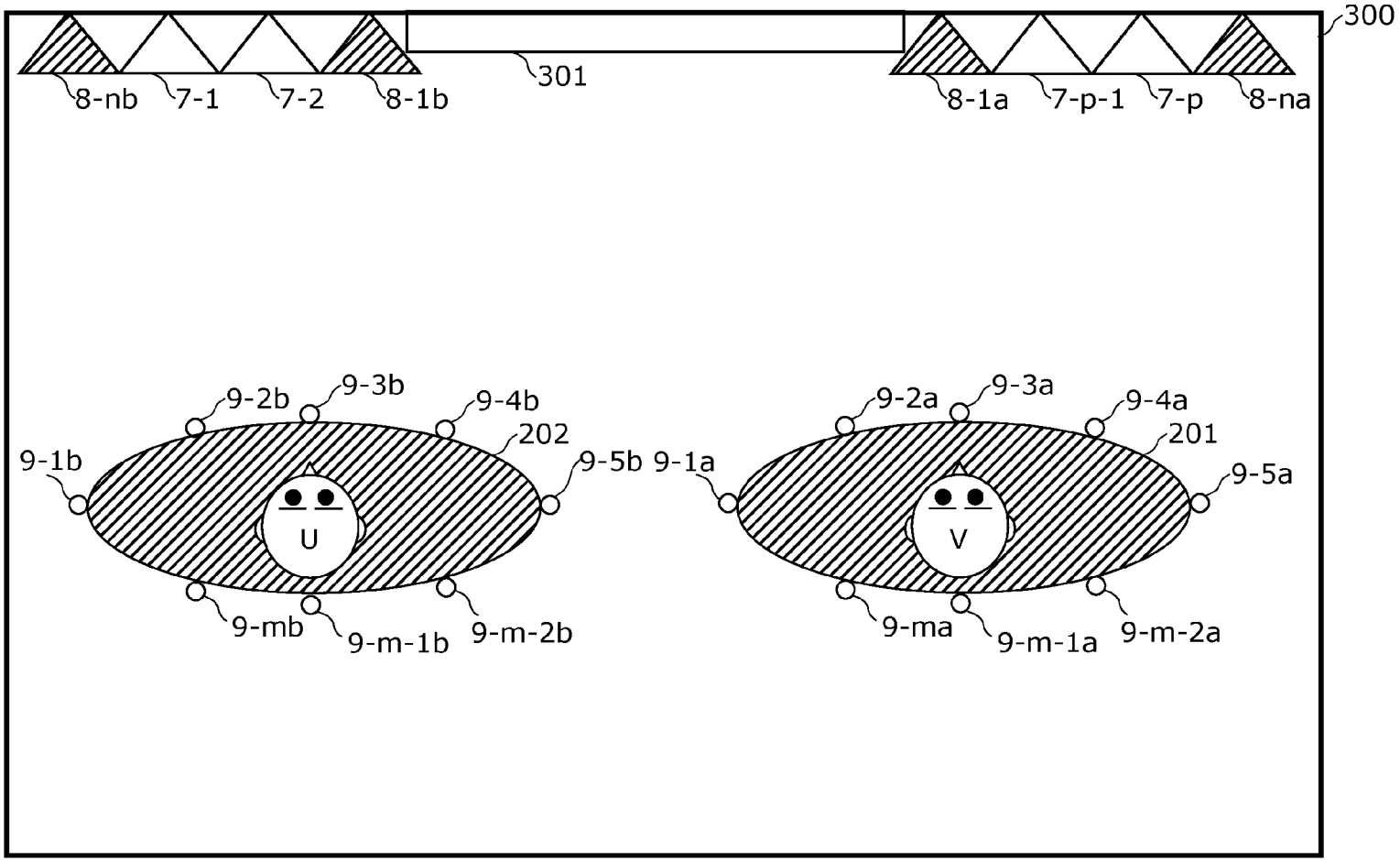
FIG. 27 is a diagram explaining a listening area and a quiet area of the sound field control apparatus in Embodiment 2.

A sound field to be controlled by the sound field control apparatus of the system 201 recreates a different acoustic characteristic for each of viewers V and U as shown in FIG. 27. The control filters 5-1*a* to 5-*na* shown in FIG. 26 have control characteristics to reduce, at microphones 9-1*b* to 9-*mb*, the reproduced sounds from the speakers 8-1*a* to 8-*na* by the reproduced sounds from the speakers 7-1 to 7-*p*. The control filters 5-1*b* to 5-*nb* have control characteristics to reduce, at microphones 9-1*a* to 9-*ma*, the reproduced sounds from the speakers 8-1*b* to 8-*nb* by the reproduced sounds from the speakers 7-1 to 7-*p*. Then, the listening compensation filter 1*a* performs control to implement target acoustic characteristics set by the target characteristic unit 3*a* at the microphones 9-1*a* to 9-*ma*. Similarly, the listening compensation filter 1*b* performs control to implement target acoustic characteristics set by the target characteristic unit 3*b* at the microphones 9-1*b* to 9-*mb*. As a result, in FIG. 27, the acoustic characteristic set by the target characteristic unit 3*a* is recreated in an area 201 surrounding the viewer V, and the acoustic characteristic set by the target characteristic unit 3*b* is recreated in an area 202 surrounding the viewer U. Here, in order to prevent mutual adverse influence from occurring due to the controls, the control filters 5-1*a* to 5-*na* reduce the reproduced sounds from the speakers 8-1*a* to 8-*na* not to cause the reproduced sounds to propagate into the area 202, and the control filter 5-1*b* to 5-*nb* reduce the reproduced sounds from the speakers 8-1*b* to 8-*nb* not to cause the reproduced sounds to propagate into the area 201. Here, the target characteristic units 3*a* and 3*b* may set any target acoustic characteristics. Thus, the set target acoustic characteristics may be different or the same.

In this way, Embodiment 2 can recreate, in one space, the two sound fields having the individual acoustic characteristics. In Embodiment 2, the two areas to be controlled are adjacent to each other side by side as shown in FIG. 27. However, these two areas may be set adjacent in the front-back direction, or may be arbitrarily set. Moreover, although the number of areas to be controlled in the present configuration is two, the number of areas may be any number such as three or four. In accordance with the number of areas, the configuration shown in FIG. 26 may be increased.

Figure 28:
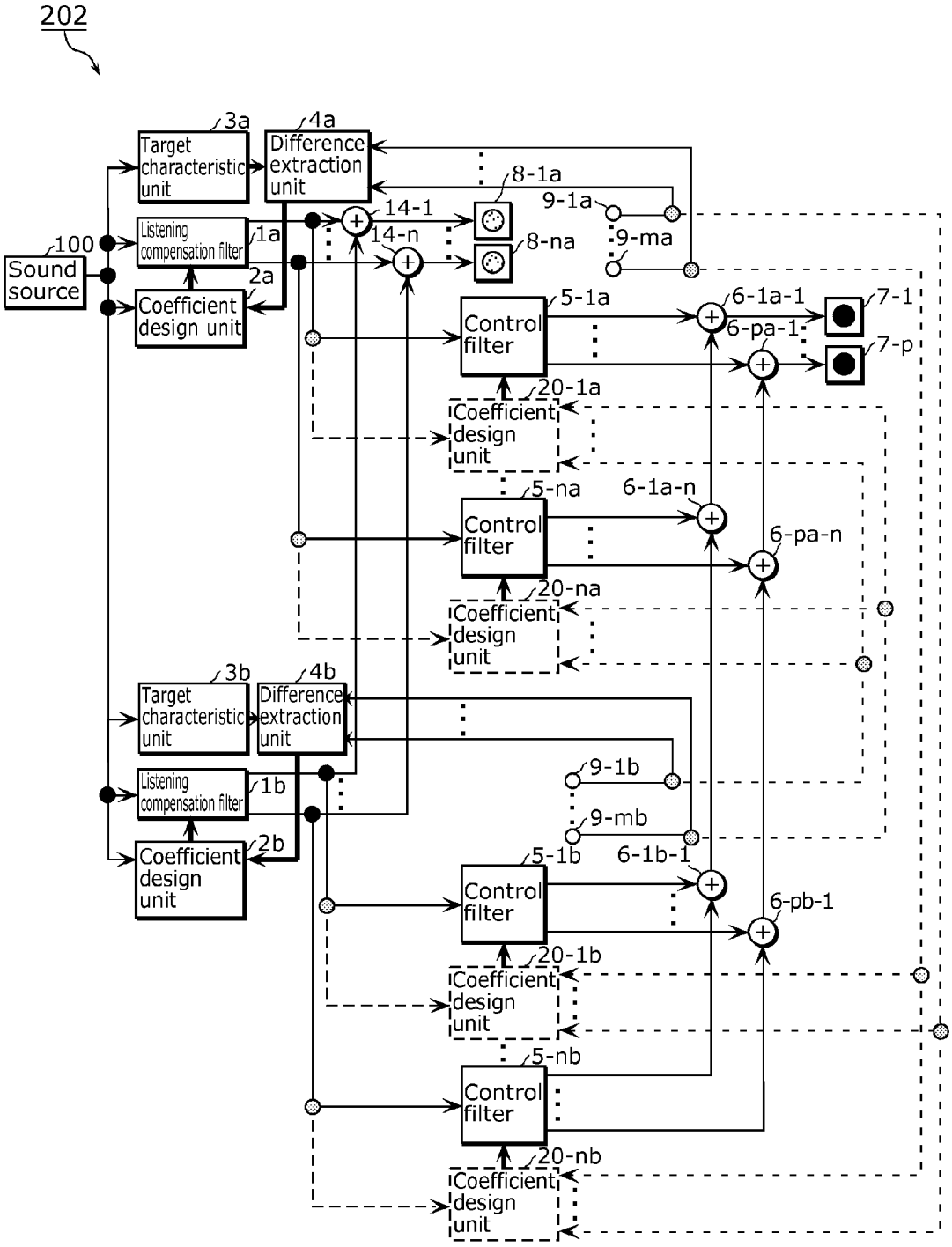
FIG. 28 is a diagram showing a configuration of a system including another sound field control apparatus in Embodiment 2.

Furthermore, the sound field control apparatus in Embodiment 2 may include adders 14-1 to 14-*n* as shown by a sound field control apparatus of a system 202 shown in FIG. 28. With this, the output from the listening compensation filter 1*b* can be reproduced by the speakers 8-1*a* to 8-*na*. Therefore, the speakers 8-1*b* to 8-*nb* (and an amplifier that is not illustrated and used for driving these speakers) can be omitted, thereby reducing the cost and simplifying the speaker arrangement.

Figure 29:
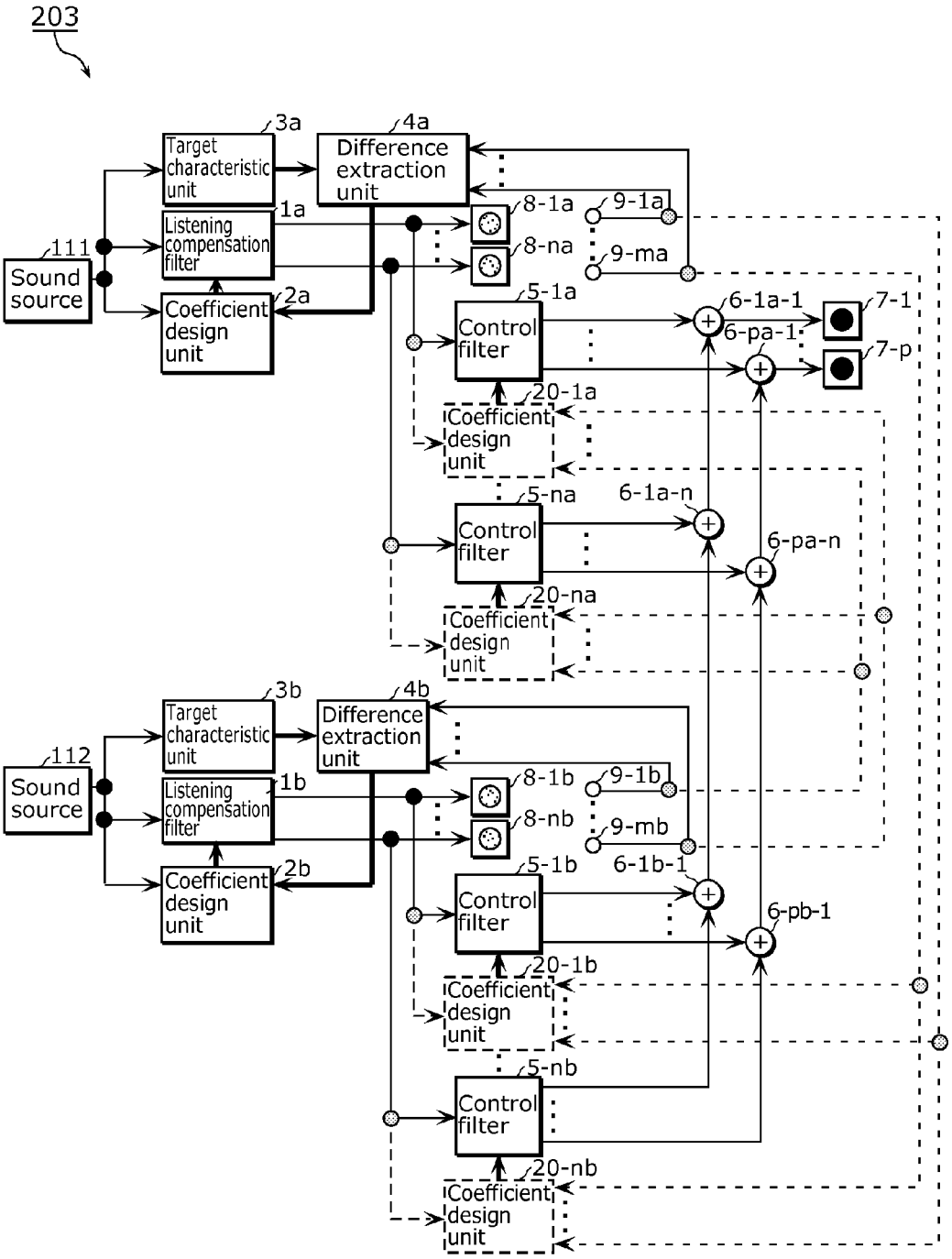
FIG. 29 is a diagram showing a configuration of a system including another sound field control apparatus in Embodiment 2.
Figure 30:
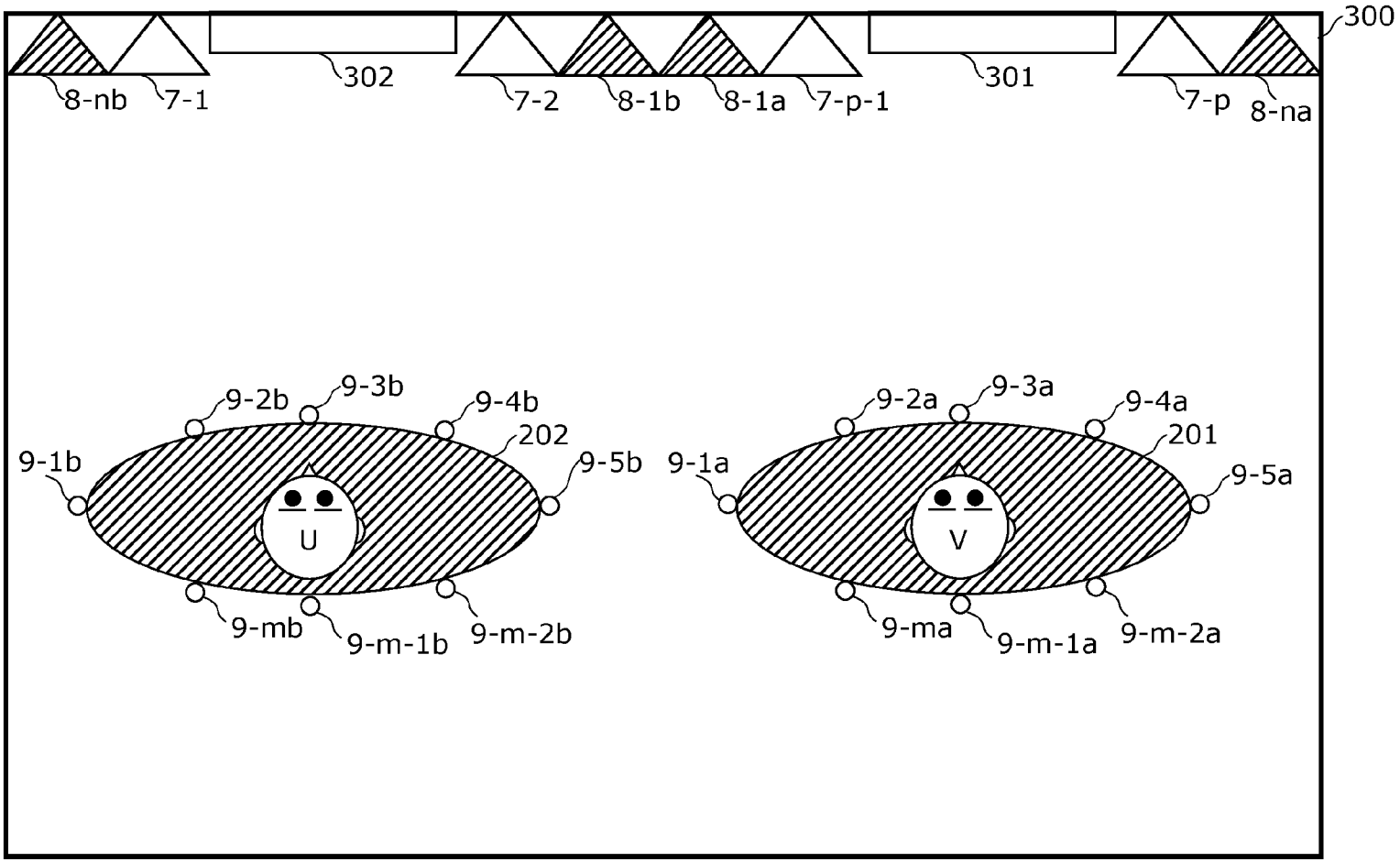
FIG. 30 is a diagram explaining a listening area and a quiet area of another sound field control apparatus in Embodiment 2.

Moreover, the sound field control apparatus in Embodiment 2 can be applied to different sound sources as shown by a sound field control apparatus of a system 203 shown in FIG. 29. As shown in FIG. 29, the sound field control apparatus of the system 203 includes the sound source 100 shown in FIG. 26 as two different sound sources which are a sound source 111 and a sound source 112. A signal from the sound source 111 is controlled by the listening compensation filter 1*a* and the control filters 5-1*a* to 5-*na*. A signal from the sound source 112 is controlled by the listening compensation filter 1*b* and the control filters 5-1*b* to 5-*nb*. Here, suppose, as an example, that the viewer V and the viewer U watch different TVs 301 and 302 in the same space 300 as shown in FIG. 30. In this case, the viewer V hears the sound of the TV 301 (=the signal from the sound source 111) with the desired target acoustic characteristic, and the viewer U hears the sound of the TV 302 (=the signal from the sound source 112) with the desired target acoustic characteristic.

As in the cases shown in FIG. 26 and FIG. 27, the number of areas to be controlled can be increased to two or more. Furthermore, the sound field control apparatus in Embodiment 2 may include adders 14-1 to 14-*n* in addition to the sound sources 111 and 112 as shown by a sound field control apparatus of a system 204 in FIG. 31. With this, the speakers 8-1*b* to 8-*nb* can be omitted, thereby reducing the cost and simplifying the speaker arrangement.

As described thus far, like the sound field control apparatus in Embodiment 2 for example, a sound field control apparatus in an aspect according to the present invention includes a first listening compensation filter and a first control filter that are the aforementioned listening compensation filter and control filter, and further includes a second listening compensation filter and a second control filter. The second listening compensation filter generates a third output signal by performing, according to a control characteristic that is previously set, signal processing on a current acoustic signal to be processed, and outputs the third output signal to a third speaker. The second control filter generates a fourth output signal by performing signal processing on the third output signal from the second listening compensation filter according to a control characteristic that is previously set, and outputs the fourth output signal to the first speaker. Here, the control characteristic of the second control filter is previously set as a third control characteristic that allows a reproduced sound from the third speaker to be reduced at the second control position by the reproduced sound from the first speaker. Moreover, the control characteristic of the second listening compensation filter is previously set as a fourth control characteristic that allows a sound having a predetermined target acoustic characteristic to be presented at the first control position by the reproduced sounds from the first and third speakers.

It should be noted that the first listening compensation filter, the second listening compensation filter, the first control filter, the second control filter, and the third speaker described above correspond, respectively, to the listening compensation filter 1*a*, the listening compensation filter 1*b*, any one of the control filters 5-1*a* to 5-*na*, any one of the control filters 5-1*b* to 5-*nb*, and at least one of the speakers 8-1*b* to 8-*nb* shown in FIG. 26, FIG. 28, FIG. 29, and FIG. 31. Moreover, in this case, the second speaker described above corresponds to at least one of the speakers 8-1*a* to 8-1*n* shown in FIG. 26, FIG. 28, FIG. 29, and FIG. 31.

Figure 31:
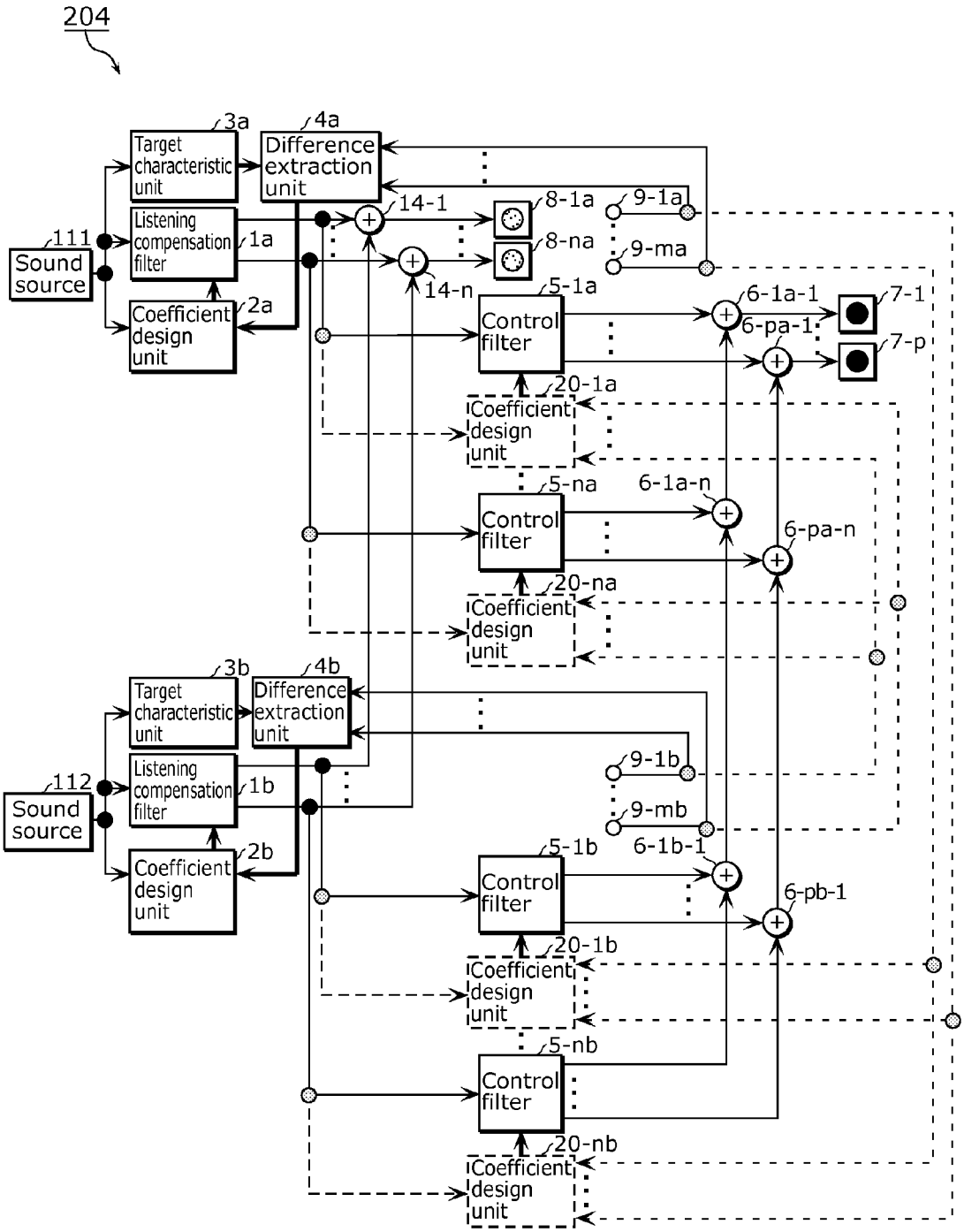
FIG. 31 is a diagram showing a configuration of a system including another sound field control apparatus in Embodiment 2.

Moreover, as shown in FIG. 26 and FIG. 28 for example, in a sound field control apparatus in an aspect according to the present invention, the second listening compensation filter may perform signal processing on the input signal, as the aforementioned acoustic signal, which is from the sound source and on which signal processing is performed by the first listening compensation filter. Alternatively, as shown in FIG. 29 and FIG. 31, the second listening compensation filter may perform signal processing on the signal, as the aforementioned acoustic signal, which is different from the input signal from the sound source and on which signal processing is performed by the first listening compensation filter. In this case, the aforementioned input signal refers to the signal from the sound source 111 shown in FIG. 29 and FIG. 31, and the aforementioned acoustic signal refers to the signal from the sound source 112 shown in FIG. 29 and FIG. 31. Here, in a sound field control apparatus in an aspect according to the present invention, the third output signal outputted from the second listening compensation filter may be added to the second output signal outputted from the first listening compensation filter by an adder, and then may be outputted to the second speaker instead of the third speaker.

Although the sound field control apparatus according to the present invention has been described by way of Embodiments above, it should be obvious that the present invention is not limited to Embodiments described above. Moreover, each of the structural elements described above may be configured with a circuit, or with a system large scale integration (system LSI) in part or in whole. Furthermore, Embodiments described above may be combined.

INDUSTRIAL APPLICABILITY

The sound field control apparatus according to the present invention has an advantageous effect of appropriately presenting a desired sound in a listening area and sufficiently reducing the sound in a nearby area without any constraint on an arrangement of a configuration. For example, the sound field control apparatus can be applied to a facility in which an area where a person is present can be specified. To be more specific, the sound field control apparatus can be used for controlling a sound field in, for example, a barber shop, a beauty salon, a gallery, a museum, a car, or a train. More specifically, any sound can be reproduced for each of persons sitting on chairs in a barber shop or a beauty salon without any mutual adverse influences. Moreover, any sound can be reproduced for each of persons standing in front of different exhibits without any mutual adverse influences. Furthermore, an individual sound can be reproduced for each of seats in a car or a train.

REFERENCE SIGNS LIST

1 Listening compensation filter
2 Coefficient design unit
3 Target characteristic unit
4 Difference extraction unit
5-1, . . . , 5-*n* Control filter
6-1, . . . , 6-*p* Adder
7-1, . . . , 7-*p*, 8-1, . . . , 8-*n* Speaker
9-1, . . . , 9-*m*, 10-1, . . . , 10-*q* Microphone
100 Sound source
102, 102 Sound field control apparatus
101A, 101B, 101C, 201, . . . , 204 System

The invention claimed is:

1. A sound field control apparatus comprising:

a listening compensation filter which generates a second output signal by performing signal processing on an input signal from a sound source according to a control characteristic that is previously set, and outputs the second output signal to a second speaker; and a control filter which generates a first output signal by performing signal processing on the second output signal from the listening compensation filter according to a control characteristic that is previously set, and outputs the first output signal to a first speaker, wherein the control characteristic of the control filter is previously set as a first control characteristic that allows a reproduced sound from the second speaker to be reduced at a first control position by a reproduced sound from the first speaker, and the control characteristic of the listening compensation filter is previously set as a second control characteristic that allows a sound having a predetermined target acoustic characteristic to be presented at a second control position by the reproduced sounds from the first and second speakers.

2. The sound field control apparatus according to claim 1, wherein, by performing:

generating a target characteristic signal by performing signal processing on the input signal from the sound source according to the predetermined target acoustic characteristic;

generating a second detection signal by detecting the reproduced sounds from the first and second speakers using a microphone located at the second control position; and updating the control characteristic of the listening compensation filter according to the input signal, the target characteristic signal, and the second detection signal, the updated control characteristic is calculated and set as the second control characteristic.

3. The sound field control apparatus according to claim 2, wherein, in the updating, a difference between the target characteristic signal and the second detection signal is calculated and the control characteristic of the listening compensation filter is updated using the input signal to reduce the difference.

4. The sound field control apparatus according to claim 1, wherein the first control characteristic of the control filter is calculated and set before the second control characteristic is set.

5. The sound field control apparatus according to claim 1, wherein, by performing:

generating a first detection signal by detecting the reproduced sounds from the first and second speakers using a microphone located at the first control position; and updating the control characteristic of the control filter according to the second output signal from the listening compensation filter and the first detection signal, the updated control characteristic is calculated and set as the first control characteristic.

6. The sound field control apparatus according to claim 1, comprising an n number of the control filters, n being an integer that is at least 2, wherein the listening compensation filter outputs the second output signal to an n number of the second speakers, and each of the n control filters performs signal processing on the second output signal to be outputted to one of the n second speakers that corresponds to the control filter.

7. The sound field control apparatus according to claim 6, further comprising an adder which adds the first output signals outputted from the n control filters and outputs an addition signal, wherein the first speaker outputs the reproduced sound according to the addition signal outputted from the adder.

8. The sound field control apparatus according to claim 1, comprising:

a first listening compensation filter and a first control filter which are the listening compensation filter and the control filter, respectively; and a second listening compensation filter and a second control filter, wherein the second listening compensation filter generates a third output signal by performing, according to a control characteristic that is previously set, signal processing on a current acoustic signal to be processed, and outputs the third output signal to a third speaker, the second control filter generates a fourth output signal by performing signal processing on the third output signal from the second listening compensation filter according to a control characteristic that is previously set, and outputs the fourth output signal to the first speaker, the control characteristic of the second control filter is previously set as a third control characteristic that allows a reproduced sound from the third speaker to be reduced at the second control position by the reproduced sound from the first speaker, and the control characteristic of the second listening compensation filter is previously set as a fourth control characteristic that allows a sound having a predetermined target acoustic characteristic to be presented at the first control position by the reproduced sounds from the first and third speakers.

9. The sound field control apparatus according to claim 8, wherein the second listening compensation filter performs signal processing on the input signal, as the acoustic signal, which is from the sound source and on which signal processing is performed by the first listening compensation filter.

10. The sound field control apparatus according to claim 8, wherein the second listening compensation filter performs signal processing on a signal as the acoustic signal, the signal being different from the input signal which is outputted from the sound source and on which signal processing is performed by the first listening compensation filter.

11. The sound field control apparatus according to claim 8, wherein the third output signal from the second listening compensation filter is added to the second output signal from the first listening compensation filter by an adder, and a resulting signal is outputted to the second speaker instead of the third speaker.

12. The sound field control apparatus according to claim 1, wherein each of the listening compensation filter and the control filter includes a plurality of taps and performs filtering using previous data included in a current signal to be processed.

13. A sound field control method comprising:

generating a second output signal by performing signal processing on an input signal from a sound source according to a second control characteristic, and outputting the second output signal to a second speaker; and generating a first output signal by performing signal processing on the second output signal from a listening compensation filter according to a first control characteristic, and outputting the first output signal to a first speaker, wherein the first control characteristic allows a reproduced sound from the second speaker to be reduced at a first control position by a reproduced sound from the first speaker, and the second control characteristic allows a sound having a predetermined target acoustic characteristic to be presented at a second control position by the reproduced sounds from the first and second speakers.

* * * * *